US011132859B2

(12) United States Patent
Gordon et al.

(10) Patent No.: US 11,132,859 B2
(45) Date of Patent: Sep. 28, 2021

(54) BANKNOTE PROCESSING DEVICE AND METHODS

(71) Applicant: Cummins-Allison Corp., Mt. Prospect, IL (US)

(72) Inventors: Glenn S. Gordon, Cameron Park, CA (US); Roy C. Schoon, Glenview, IL (US); Ralf H. Jaeger, Kildeer, IL (US); Scott Michael Minch, Wheeling, IL (US)

(73) Assignee: Cummins-Allison Corp., Mt. Prospect, IL (US)

( * ) Notice: Subject to any disclaimer, the term of this patent is extended or adjusted under 35 U.S.C. 154(b) by 0 days.

(21) Appl. No.: 16/844,918

(22) Filed: Apr. 9, 2020

(65) Prior Publication Data

US 2020/0327763 A1 Oct. 15, 2020

Related U.S. Application Data

(60) Provisional application No. 62/831,565, filed on Apr. 9, 2019.

(51) Int. Cl.

| | |
|---|---|
| ***G07D 11/14*** | (2019.01) |
| ***G07D 7/20*** | (2016.01) |
| ***G07D 11/16*** | (2019.01) |
| ***G07D 11/40*** | (2019.01) |
| ***G07D 11/237*** | (2019.01) |
| ***G07D 11/60*** | (2019.01) |

(52) U.S. Cl.

CPC ..... *G07D 11/14* (2019.01); *G07D 7/20* (2013.01); *G07D 11/16* (2019.01); *G07D 11/237* (2019.01); *G07D 11/40* (2019.01); *G07D 11/60* (2019.01); *G07D 2207/00* (2013.01); *G07D 2211/00* (2013.01)

(58) Field of Classification Search

CPC ..... G07D 11/14; G07D 7/20; G07D 11/16; G07D 11/40; G07D 11/237; G07D 2211/00; G07D 2207/00; G07D 11/26; G07D 11/60

See application file for complete search history.

(56) References Cited

U.S. PATENT DOCUMENTS

| | | | |
|---|---|---|---|
| 5,790,697 | A | 8/1998 | Munro et al. |
| 5,815,592 | A | 9/1998 | Mennie et al. |
| 8,401,268 | B1 | 3/2013 | Yacoubian et al. |
| 8,437,530 | B1 | 5/2013 | Mennie et al. |
| 8,781,206 | B1 | 7/2014 | Yacoubian et al. |

(Continued)

*Primary Examiner* — Jeffrey A Shapiro

(57) ABSTRACT

A banknote processing device comprises a banknote transport path defined at least in part by a transport plate on one side of the banknote transport path, the banknote transport plate being pivotally mounted about a first axis near an upstream end of the transport plate, the transport plate including a working position and an open position, a display assembly being pivotally mounted about a second axis spaced a defined distance apart from the first axis, the display assembly including an operational position and a non-operational position, and a linkage coupled to display assembly and to the transport plate near a downstream end of the transport plate, wherein, when the display assembly is rotated from the operational position to the non-operational position, the linkage causes the transport plate to move from the working position to the open position.

20 Claims, 40 Drawing Sheets

(56) References Cited

U.S. PATENT DOCUMENTS

| | | | | |
|---|---|---|---|---|
| 9,355,295 | B1 | 5/2016 | Jones et al. | |
| 2009/0242624 | A1 * | 10/2009 | Matsuura | G07D 11/50 235/379 |

* cited by examiner

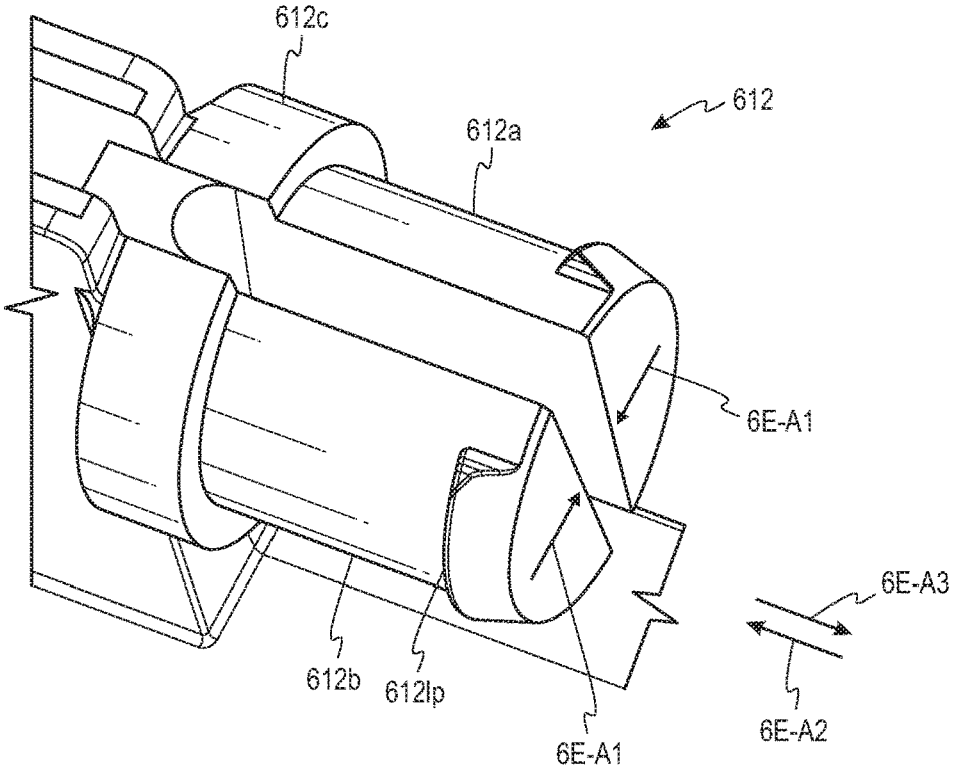
*Fig. 6E1*
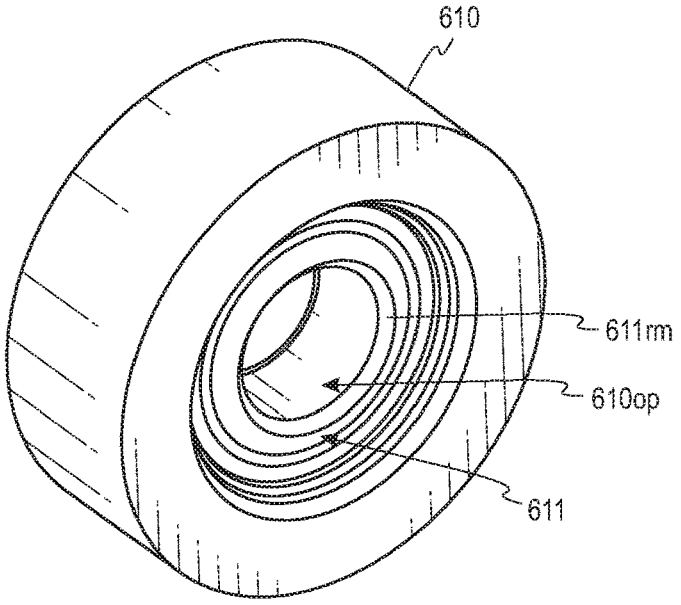
*Fig. 6E2*

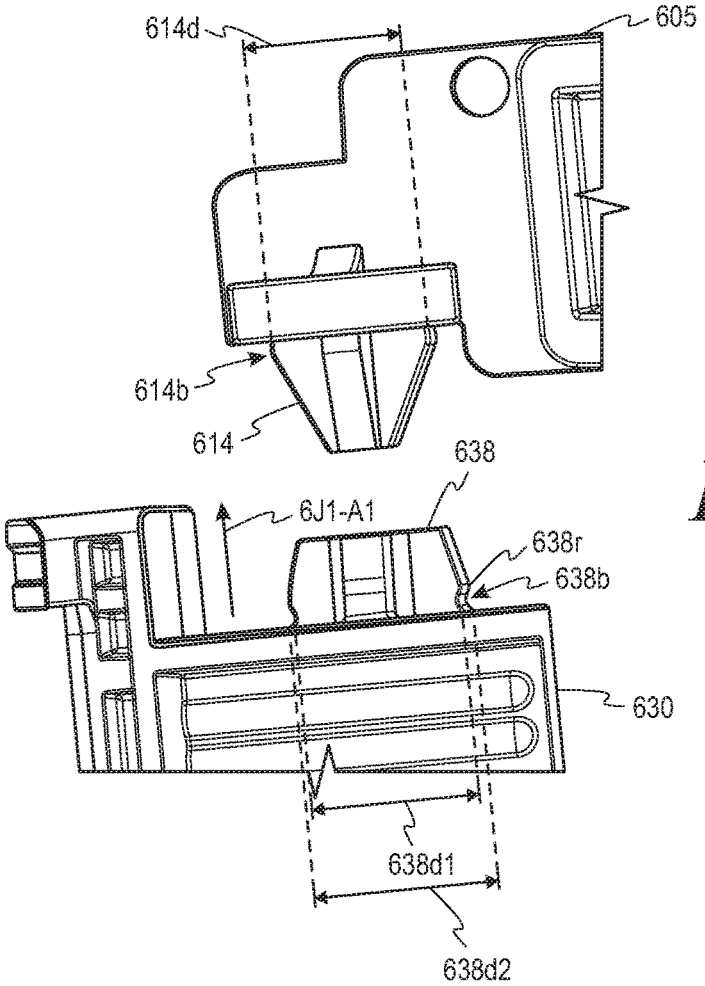
Fig. 6J1
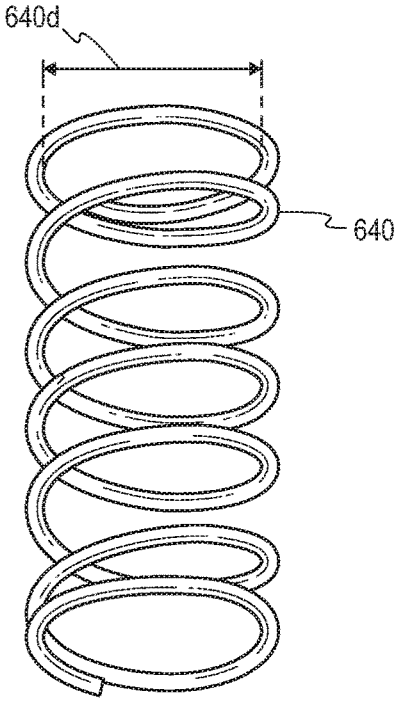
Fig. 6J2

BANKNOTE PROCESSING DEVICE AND METHODS

CROSS-REFERENCE TO RELATED APPLICATIONS

This application claims priority to and the benefit of U.S. Provisional Patent Application No. 62/831,565, filed Apr. 9, 2019, and entitled BANKNOTE PROCESSING DEVICE AND METHODS, which is incorporated by reference herein in its entirety.

TECHNICAL FIELD

The present disclosure relates generally to banknote or currency bill processing devices and related methods.

SUMMARY

According to some embodiments, a banknote processing device comprises a feeder bracket fixedly coupled to side walls of a banknote processing device, the feeder bracket having longitudinal length and a pair of hopper lug openings positioned near opposite ends of the longitudinal length of the feeder bracket. The banknote processing device further comprising a feeder plate resting upon but not coupled the feeder bracket, the feeder plate having longitudinal length and a pair of slot openings positioned near opposite ends of the longitudinal length of the feeder plate; wherein when the feeder plate is properly positioned relative to the feeder bracket, the slot openings of the feeder plate align with the hopper lug openings of the feeder bracket. The banknote processing device further comprising a hopper bracket having a bottom surface resting on an upper surface of the feeder plate, the hopper bracket having a longitudinal length and a pair of hopper lugs positioned near opposite ends of the longitudinal length of the hopper bracket and extending downward from the bottom surface of the hopper bracket through the slot openings of the feeder plate and the hopper lug openings of the feeder bracket; wherein when the hopper bracket and feeder plate are in an operational position with respect to the feeder bracket, top surfaces of the hopper lugs contact a bottom surface of the feeder bracket establishing an interference fit therebetween so as to maintain the hopper bracket and feeder plate in their operational positions without either the hopper bracket or the feeder plate being fixedly coupled to feeder plate or the rest of the banknote processing device; wherein the hopper bracket is instead removably coupled to the feeder bracket and the feeder plate is sandwiched therebetween.

According to some embodiments, an output receptacle of a banknote processing device comprises a stacker tray having a longitudinal length and having an upper edge that has a central, downward curved portion in a middle portion of the longitudinal length and two curved portions, one on each side of the middle portion, wherein the two curved portions arc upward toward the middle of the stacker tray and a middle of the output receptacle.

According to some embodiments, a banknote processing device comprises a display assembly pivotally mounted about a first axis near a first end of the transport plate, the display assembly having an operational position and an open position; a banknote transport path defined at least in part by a transport plate on one side of the transport path, the transport plate being pivotally mounted about a second axis near a first upstream end of the transport plate, the transport plate having an operational position and an open position; and a linkage coupled on one end to the display assembly and coupled on a second end to the transport plate near a second downstream end of the transport plate; wherein when the display assembling is rotated from its operational position to an open position, the linkage causes the transport plate to move from its operational position to an open position.

According to some embodiments, a banknote processing device comprises a pair of opposing side plates in spaced relation from each other, each side plate having at least one cleat hooked thereon; a beam having a longitudinal length having two ends which when the beam is positioned in an operational position the longitudinal length extends between the two side plates; and a pair of springs, each of the spring being mounted between a respective end of the beam and a corresponding cleat.

According to some embodiments, a banknote processing device comprises a driven transport shaft having a magnetic coupled to an end thereof; and a magnetic encoder adjacent to but spaced from the magnet.

According to some embodiments, a banknote processing device comprises a transport shaft mounted between two sides plates of the banknote processing device, wherein a first end of the shaft is coupled to a hold-down screw; a shaft adjustment mechanism comprising an adjustment plate pivotally mounted about a first axis to a first one of the side plates, wherein the adjustment plate comprises an arc-shaped aperture defined by an arc-shaped edge, wherein the arc-shaped aperture and edge are slightly non-concentric with respect to the first axis; wherein the adjustment plate comprises an arc-shaped edge which is concentric with respect to the first axis and wherein the arc-shaped edge has a plurality of teeth; wherein the first one of the side plates has a vertical slot opening therein and wherein the hold-down screw passes through both the arc-shaped aperture in the adjustment plate and the vertical slot opening in the first one of the side plates; wherein the first one of the side plates has an adjustment tool receiving aperture therein, wherein when an end of an adjustment tool having a plurality of teeth thereon is inserted in the adjustment tool receiving aperture, a rack and pinion type of mesh is established between the adjustment plate teeth and the teeth on the end of the adjustment tool such that rotating the adjustment tool causes the rotation of the adjustment plate and the associated adjustment plate arc opening and adjustment plate arc opening edge which in turn vertically moves the hold-down screw within the vertical slot opening and vertically moves the end of the shaft to which the hold-down screw is coupled.

According to some embodiments, a banknote processing device comprises a banknote transport path defined at least in part by a transport plate on one side of the banknote transport path, the banknote transport plate being pivotally mounted about a first axis near an upstream end of the transport plate, the transport plate including a working position and an open position, a display assembly being pivotally mounted about a second axis spaced a defined distance apart from the first axis, the display assembly including an operational position and a non-operational position, and a linkage coupled to display assembly and to the transport plate near a downstream end of the transport plate, wherein, when the display assembly is rotated from the operational position to the non-operational position, the linkage causes the transport plate to move from the working position to the open position.

According to some embodiments, a method of a banknote processing device comprises rotating a display assembly from an operational position to a non-operational position, wherein a linkage is coupled to the display assembly and to a transport plate near a downstream end of the transport plate, wherein the transport plate defines, at least in part, a banknote transport path, wherein the transport plate is pivotally mounted about a first axis near an upstream end of the transport plate, and wherein the display assembly is pivotally mounted about a second axis spaced a defined distance apart from the first axis, and moving the transport plate from a working position to an open position, wherein the movement is caused by the coupling of the linkage to the display assembly and the transport plate and the rotation of the display assembly.

The above summary is not intended to represent every embodiment or every aspect of the present disclosure. Rather, the foregoing summary merely provides an exemplification of some of the novel aspects and features set forth herein. The above features and advantages, and other features and advantages of the present disclosure, which are considered to be inventive singly or in any combination, will be readily apparent from the following detailed description of representative embodiments and modes for carrying out the present inventions when taken in connection with the accompanying drawings and the appended claims.

Other technical features may be readily apparent to one skilled in the art from the following figures, descriptions, and claims.

Definitions for other certain words and phrases are provided throughout this patent document. Those of ordinary skill in the art should understand that in many if not most instances, such definitions apply to prior as well as future uses of such defined words and phrases.

BRIEF DESCRIPTION OF THE DRAWINGS

For a more complete understanding of this disclosure, reference is now made to the following description, taken in conjunction with the accompanying drawings, in which:

FIG. 6E1 is an enlarged perspective view of an idler roller mounting post;

FIG. 6E2 is a perspective view of an idler roller;

FIG. 6J1 is an enlarged perspective view of a spring post of an idler roller beam and a spring post of a spring cleat;

FIG. 6J2 is an enlarged perspective view of a coil spring;

Figure 1A:
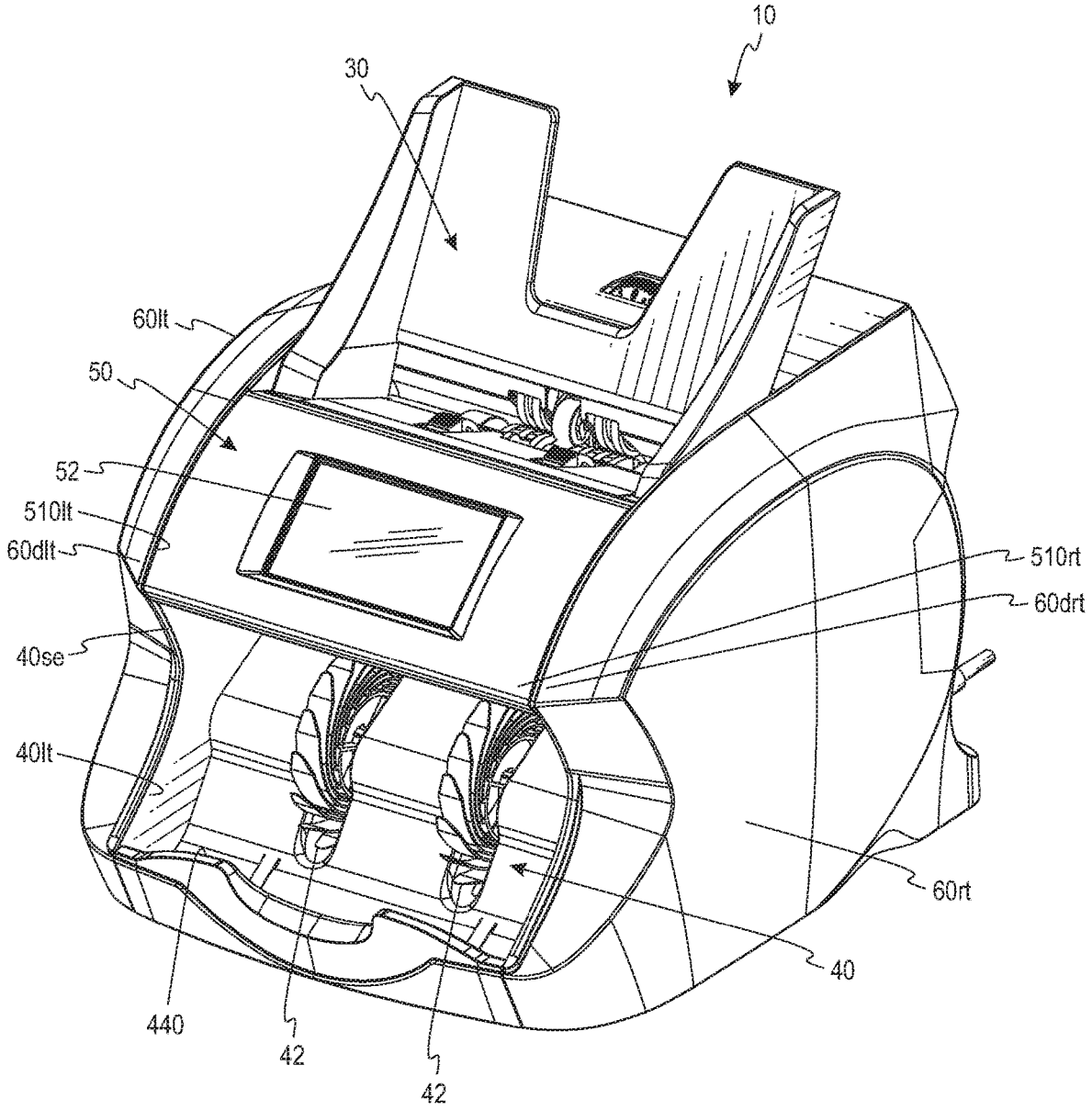
FIG. 1A is a perspective view of a banknote processing device according to some embodiments of the present disclosure.
Figure 1B:
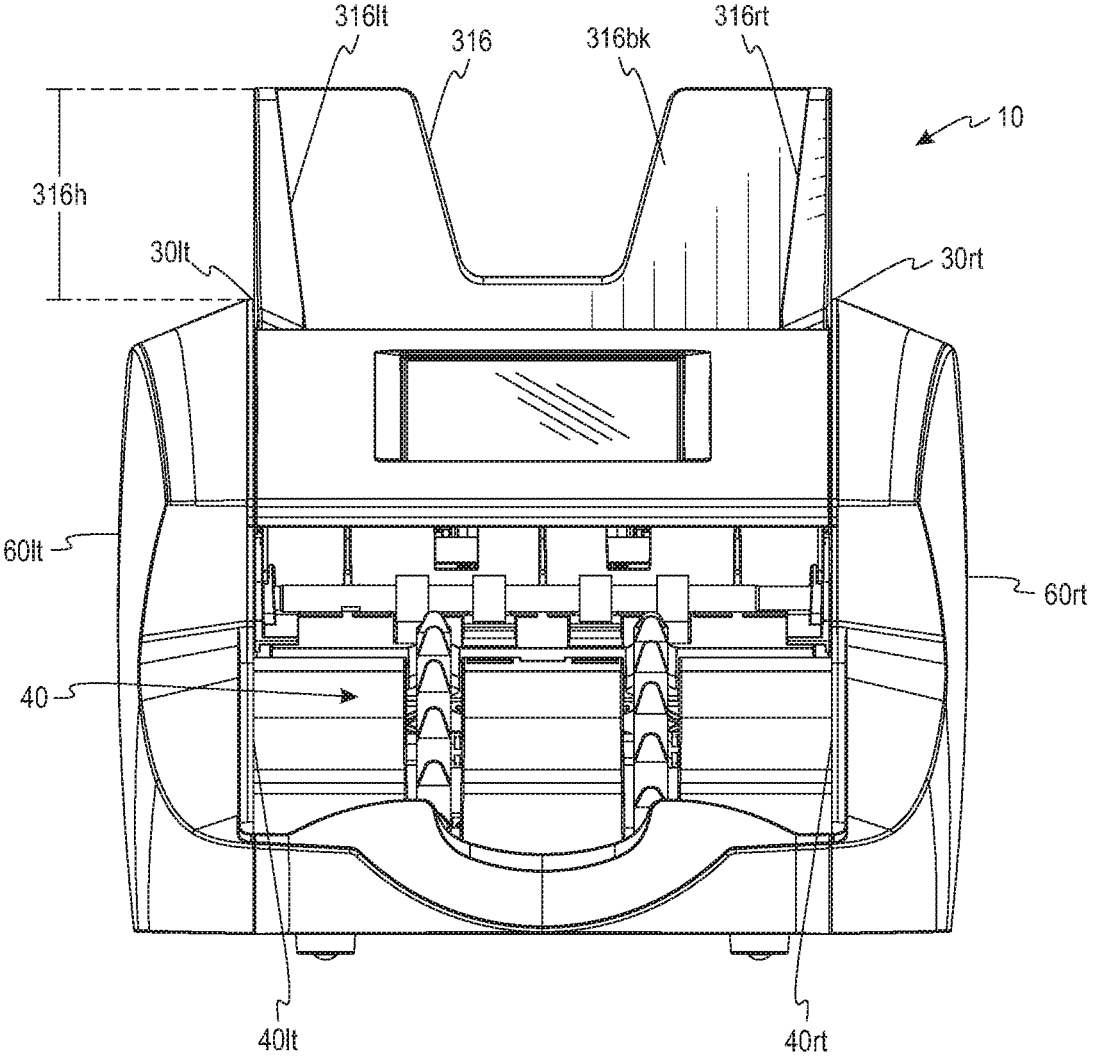
FIG. 1B is a front view of the banknote processing device of FIG. 1A.

The present disclosure is susceptible to various modifications and alternative forms, and some representative embodiments have been shown by way of example in the drawings and will be described in detail herein. It should be understood, however, that the inventive aspects are not limited to the particular forms illustrated in the drawings. Rather, the disclosure is to cover all modifications, equivalents, combinations, and alternatives falling within the spirit and scope of the inventions as defined by the appended claims.

DETAILED DESCRIPTION

Referring to FIGS. 1A-2G a banknote processing device 10 and/or components thereof according to some embodiments of the present disclosure are shown. The banknote processing device 10 comprises in input hopper or receptacle 30 and an output receptacle 40. According to some embodiments, two stacker wheels 42 stack processed banknotes or other documents in the output receptacle 40. According to some embodiments, the banknote processing device 10 comprises a display assembly 50 which comprises a user interface 52. According to some embodiments, the banknote processing device 10 comprises two side covers 60*rt*, 60*lt*.

Banknotes or documents to be processed by the banknote processing device 10 are stacked within input hopper 30. A transport mechanism 70 then transports the banknotes or documents along a transport path, past one or more sensors or detectors 72, and to the output receptacle 40. With reference to FIG. 2G, according to some embodiments, the banknote processing device 10 comprises one or more processors and/or controllers 75 such as a CPU communicatively coupled to a memory 74, one or more hopper sensors 32, one or more output receptacle sensors 34, components controlling the transport mechanism 70 such as one or motors controlling movement of various driven rollers and the stacking wheels 42, the one or more banknote or document sensors or detectors 72, one or more encoders 797, and/or the user or operator interface 52. According to some embodiments sensors or detectors 72 include one or more denomination sensors, one or more image scanner(s), one or more authentication sensors, one or more density sensors, one or more fitness sensors, or a combination thereof According to some embodiments, the operation of banknote processing device 10 and its components are similar to those described in U.S. Pat. No. 5,815,592, incorporated herein by reference in its entirety. According to some embodiments, the operation of banknote processing device 10 and its components are similar to those described in U.S. Pat. Nos. 5,815,592 and 5,790,697, each of which is incorporated here by reference, including the modes of operation described therein (e.g., Mixed Mode, Stranger Mode, etc.).

With reference to FIGS. 2A-2F, the banknote processive device 10 comprises a transport mechanism 70 which may comprise stripping or auxiliary wheels 274, a driven drive or drum roll 275, a retard bracket assembly 279RA comprising an idler roll 276, retard rollers 279, pressure roll 236, retard assembly mounting shaft 279SH, passive or idler rollers 610, and/or downstream driven rolls 298 which cooperate to strips banknotes from the bottom of a stack of banknotes residing in input hopper 30 and transport them sequentially in a non-overlapping manner along a transport path from the input hopper 30 to the stacker wheels 42. The driven drive roll 275, the downstream driven rolls 298, and the stacker wheels 42 are driven and controlled by one or more motors controlled by the more or more processors 75. For example, a drive motor shaft may rotational drive shafts on which drum roll 275 and downstream driven rolls 298 are mounted using one or more drive belts 251. More details about an exemplary transport mechanism such as a transport mechanism 70 that may be used in banknote processing device 10 are contained in U.S. Pat. No. 5,815,592, incorporated herein by reference in its entirety (see, e.g., FIGS. 19-21*a* and the related description thereof).

According to some embodiments, banknotes to be transported by the transport mechanism 70 are generally rectangularly shaped having two generally parallel wide or long edges and two generally orthogonal narrow or short edges and two banknote surfaces or faces. According to some embodiments, the banknote transport mechanism 70 is employed to transport banknotes in a wide-edge leading manner. According to some embodiments, the banknote transport mechanism 70 is configured to transport U.S. banknotes.

According to some embodiments, the transport mechanism 70 is operated at high speeds and can transport banknotes at a rate of at least 1000 banknotes per minute along the transport path such as, for example, at a rate of at least 1000 U.S. banknotes per minute in a wide-edge leading manner.

According to some embodiments, the transport mechanism 70 transports banknotes at a rate of at least 600 banknotes per minute along the transport path such as, for example, at a rate of at least 600 U.S. banknotes per minute in a wide-edge leading manner.

According to some embodiments, the transport mechanism 70 transports banknotes at a rate of at least 800 banknotes per minute along the transport path such as, for example, at a rate of at least 800 U.S. banknotes per minute in a wide-edge leading manner.

According to some embodiments, the transport mechanism 70 transports banknotes at a rate of at least 1200 banknotes per minute along the transport path such as, for example, at a rate of at least 1200 U.S. banknotes per minute in a wide-edge leading manner.

According to some embodiments, the transport mechanism 70 transports banknotes at a rate of at least 1400 banknotes per minute along the transport path such as, for example, at a rate of at least 1400 U.S. banknotes per minute in a wide-edge leading manner.

According to some embodiments, the transport mechanism 70 transports banknotes at a rate of at least 1500 banknotes per minute along the transport path such as, for example, at a rate of at least 1500 U.S. banknotes per minute in a wide-edge leading manner.

According to some embodiments, the banknote processing device 10 comprises one or more sensors configured to retrieve information from processed banknotes to denominate the banknotes such as, for example, determining the denomination of U.S. banknotes of a plurality of denominations and generating a total of the value of a stack or batch of banknotes processed by the banknote processing device 10.

According to some embodiments, the banknote processing device 10 comprises one or more scanheads configured to optically detect patterns from passing banknotes and determine the denomination of each passing banknote as described in U.S. Pat. No. 5,815,592, incorporated herein by reference in its entirety (see, e.g., scanheads 18*a* and 18*b* in FIGS. 24-28, FIGS. 2-5 and 29, and the related description thereof).

According to some embodiments, in place of or in addition to scanheads 18*a*, 18*b* described in U.S. Pat. No. 5,815,592, banknote processing device employs a first one-inch wide imaging sensor having a resolution of 288 pixels which employs 288 photosensors instead of the single photodetector found in each of the scanheads 18*a*, 18*b*. A second one-inch wide imaging sensor having a resolution of 288 pixels may additionally be employed and be positioned on the opposite side of the transport path in a manner similar to the positioning of scanheads 18*a*, 18*b* to enable imaging of a central strip on both sides of a passing banknote. The one-inch 288-pixel sensor is more robust and accurate than the half-inch wide scanhead 18*a*, 18*b* described in U.S. Pat. No. 5,815,592 that contains only a single photodetector. According to some embodiments, the one-inch 288-pixel sensor provides a low-cost alternative for denominating US currency that is accurate and operates at very high speeds. For example, according to some embodiments, the transport mechanism, the one-inch 288-pixel sensor(s), and the one or more processors 75 transport and denominate U.S. banknotes at rates of at least 600 banknotes per minute, at least 800 banknotes per minute, at least 1000 banknotes per minute, at least 1200 banknotes per minute, and/or at least 1400 banknotes per minute. According to some embodiments, the one-inch 288-pixel sensor improves throughput of the banknote processing device 10 by reducing the number of no-calls and the corresponding number of times the transport mechanism 70 must be stopped.

According to some embodiments, the one-inch 288-pixel sensor improves denominating accuracy and provides more data to the one or more processors 75 of the banknote processing device 10 that enables greater resiliency to accommodate changes in new US banknote designs.

Additional sensors or detectors 72 such as, for example, authentication sensors may also be employed in the banknote processing device 10.

According to some embodiments, instead of or in addition to scanheads 18*a*, 18*b* described in U.S. Pat. No. 5,815,592 and/or the one-inch 288-pixel imaging sensor(s) described above, the banknote processing device may employ one or more full-width imaging scanheads such as those described in U.S. Pat. Nos. 8,401,268; 8,437,530; 8,781,206; 9,355,295, each incorporated herein by reference in its entirety.

Figure 1C:
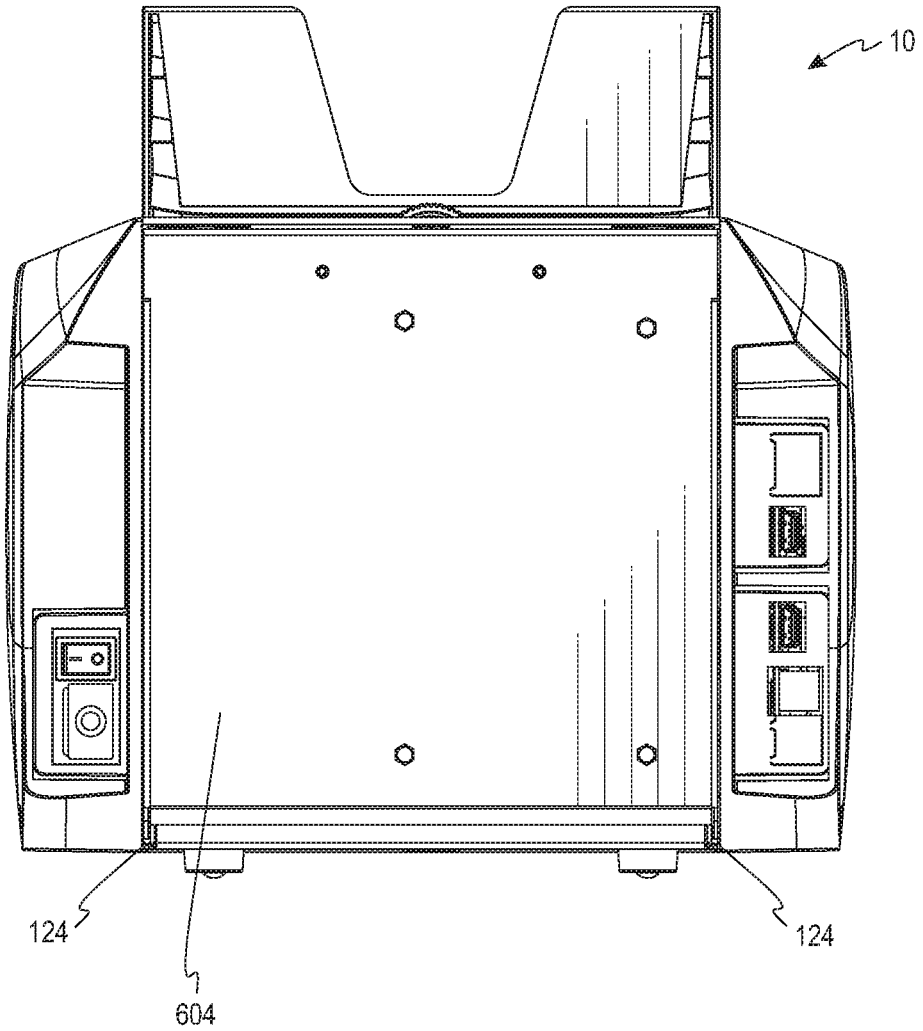
FIG. 1C is a rear view of the banknote processing device of FIG. 1A.

Referring to FIG. 1C, according to some embodiments the banknote processing device 10 has a rear access panel 604. Referring to FIG. 1G, according to some embodiments the banknote processing device 10 has a bottom access panel 602. According to some embodiments, the rear 604 and/or bottom 602 access panels are configured to be easily opened to permit a person such as a service technician easy access to the interior of the banknote processing machine 10. For example, rear panel 604 and/or bottom panel 602 may be hingedly coupled to the banknote processing device such as to the side walls or plates 206*lt*, 206*rt* at points 124 in FIG. 1C and points 121 in FIG. 1G. For example, referring to FIG. 1G, bottom panel 602 may be hingedly coupled to side plates 206*rt*, 206*lt* about axis 123 and the bottom plate may be pivotally opened after simply removing two screws 122.

Figure 3A:
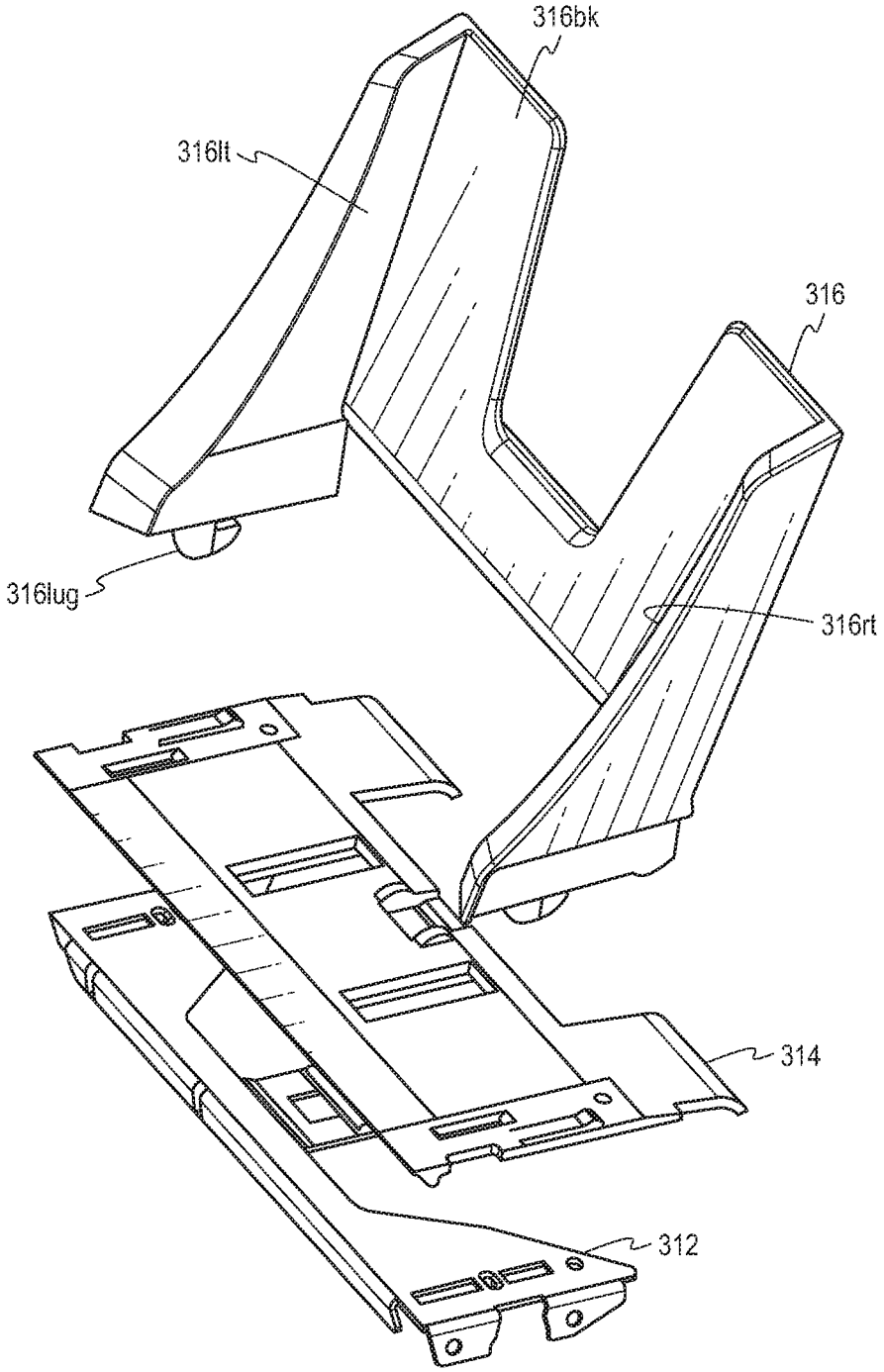
FIG. 3A is an exploded perspective view of select components associated with an input hopper according to some embodiments.
Figure 3B:
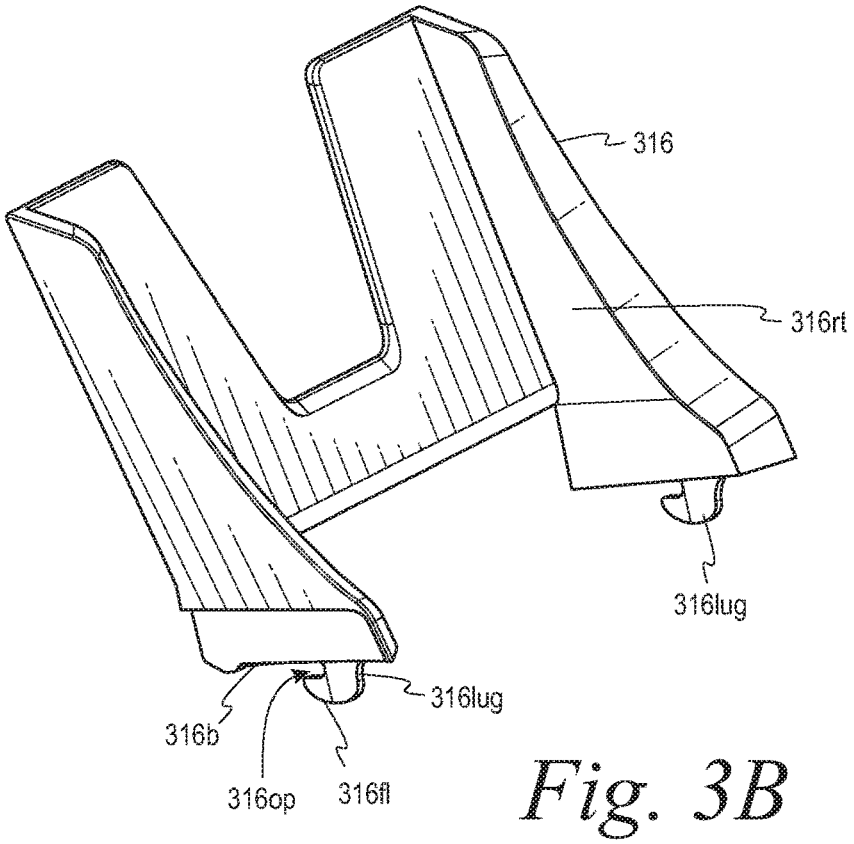
FIG. 3B is a front perspective view and FIG. 3C is a side perspective view of a hopper extension guide or bracket according to some embodiments.
Figure 3C:
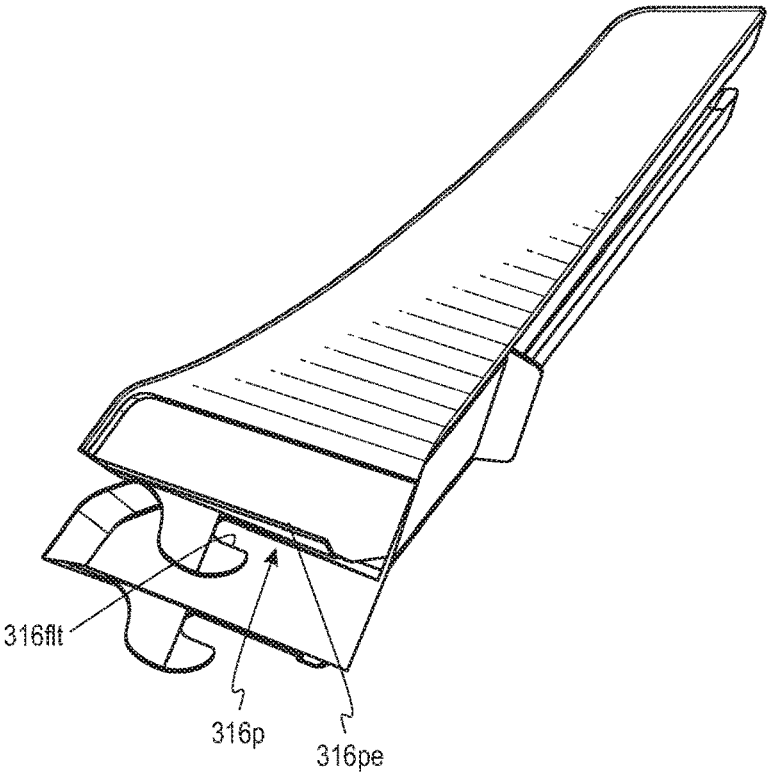
Figure 3D:
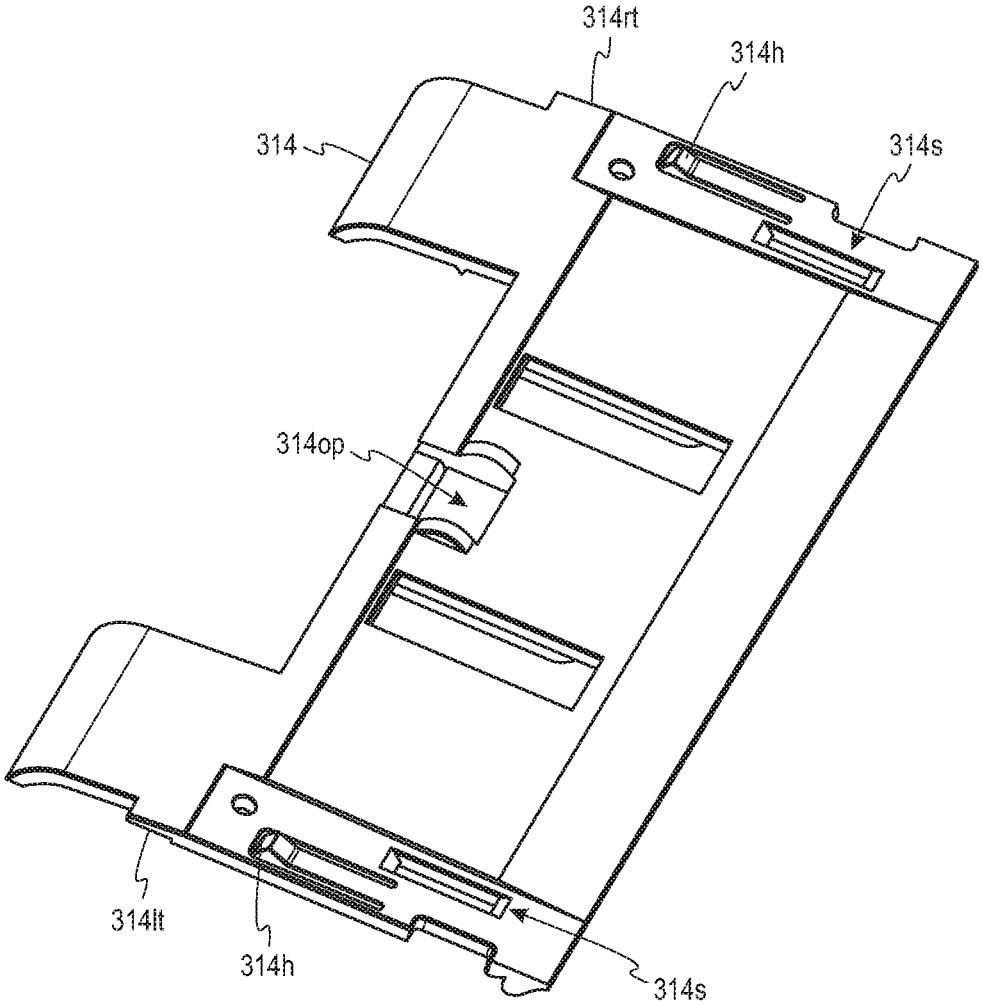
FIG. 3D is a top perspective view and FIG. 3E is a bottom perspective view of a feeder plate according to some embodiments.
Figure 3E:
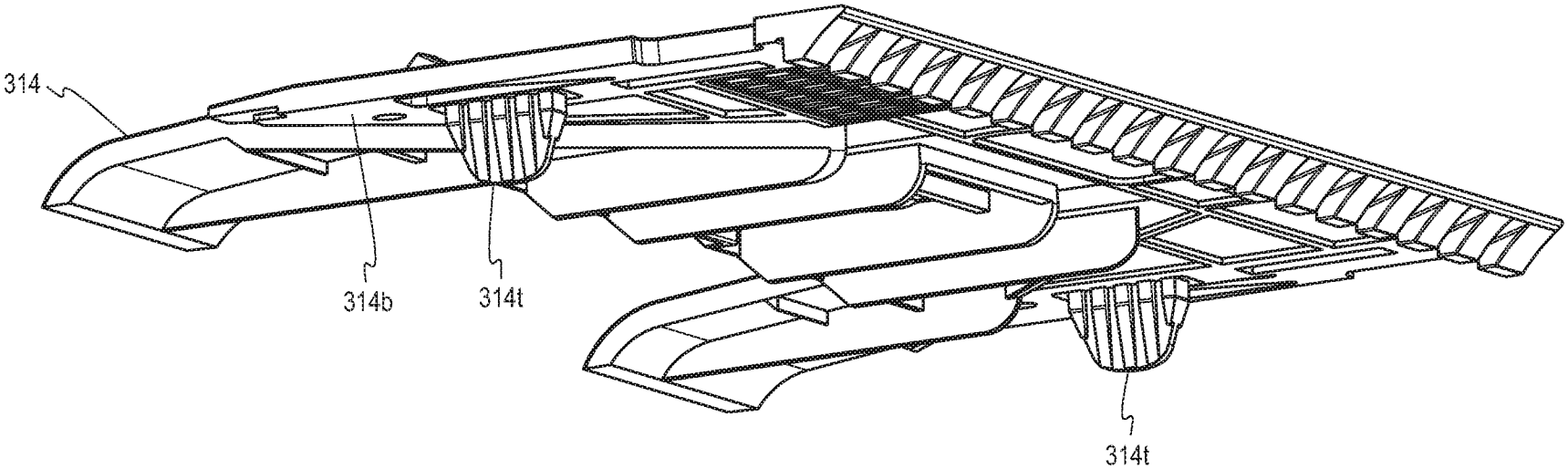
Figure 3F:
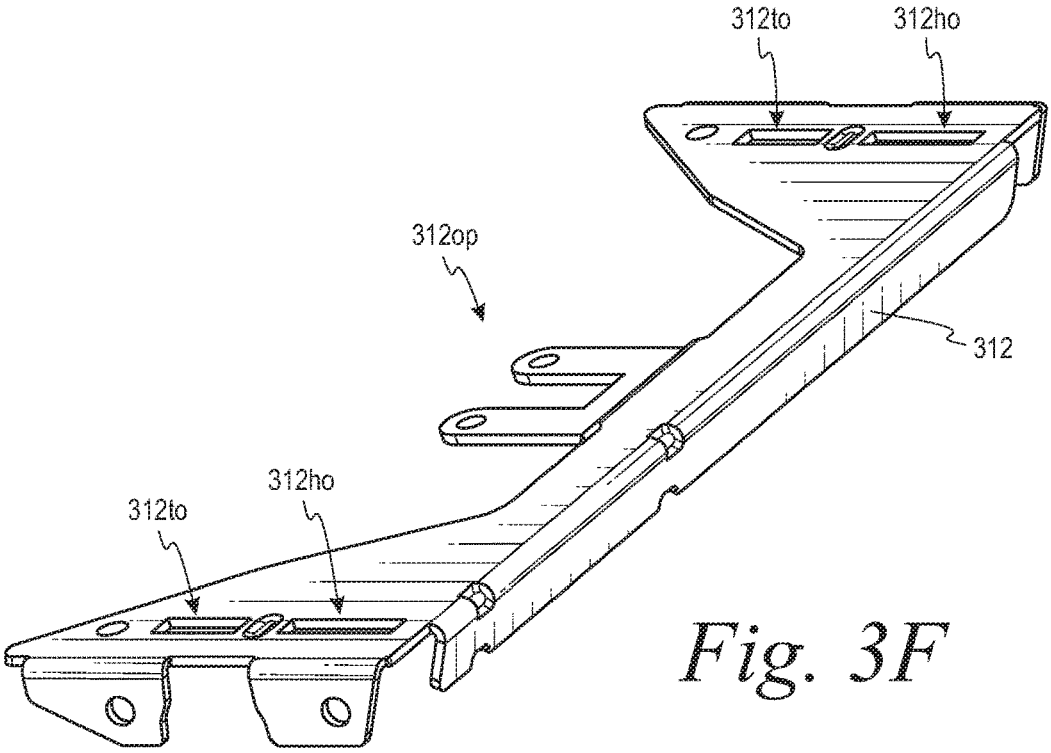
FIG. 3F is a top perspective view and FIG. 3G is a bottom perspective view of a feeder bracket according to some embodiments.
Figure 3G:
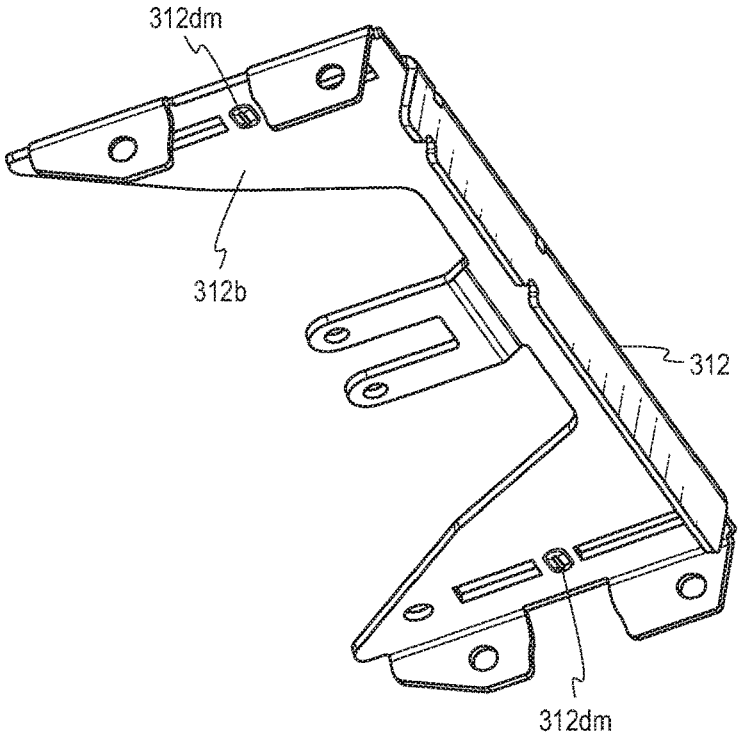
Figure 3H:
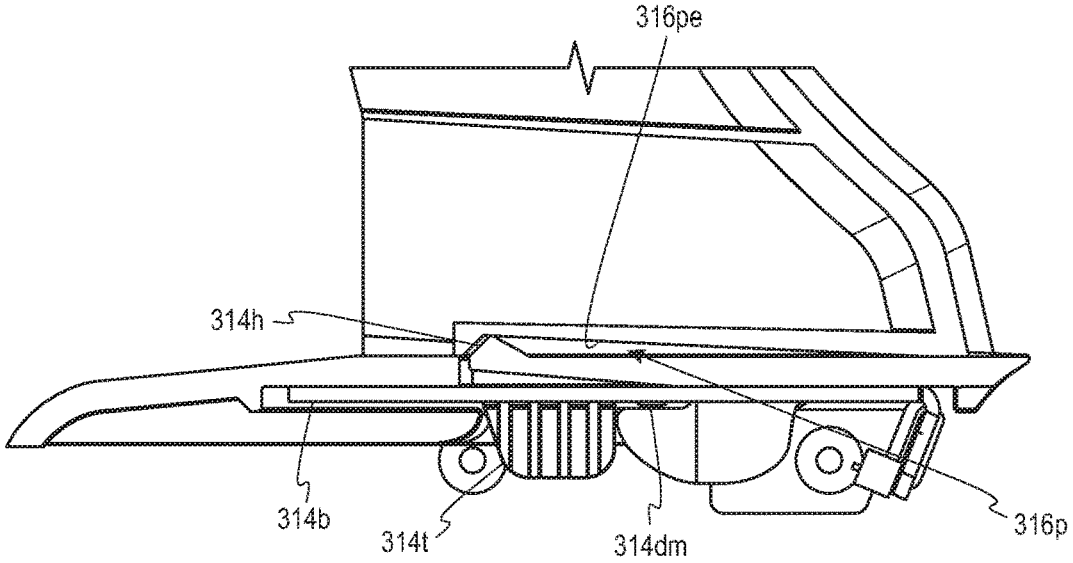
FIG. 3H is a side view and FIG. 3I is a partial bottom perspective of select components associated with an input hopper in an operational assembled state according to some embodiments.
Figure 3I:
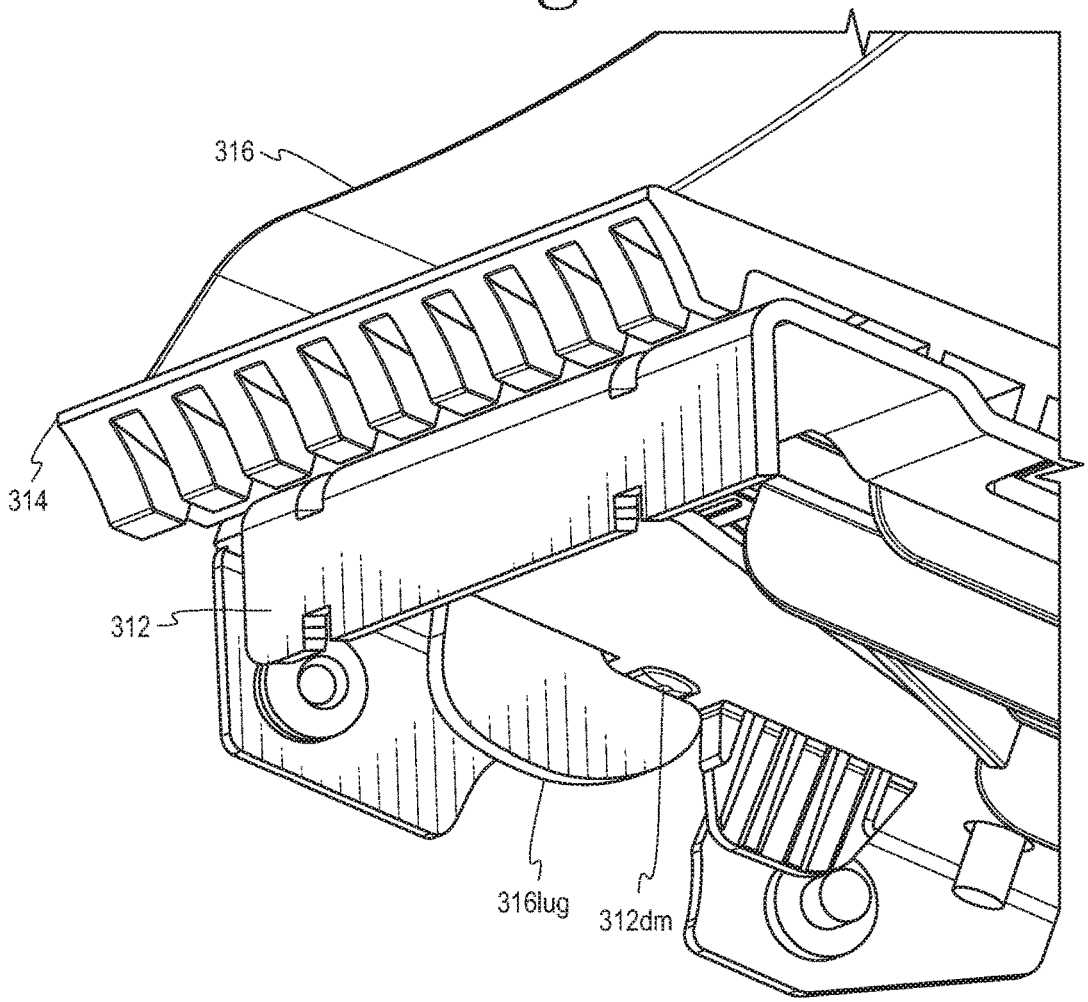
Figure 3J:
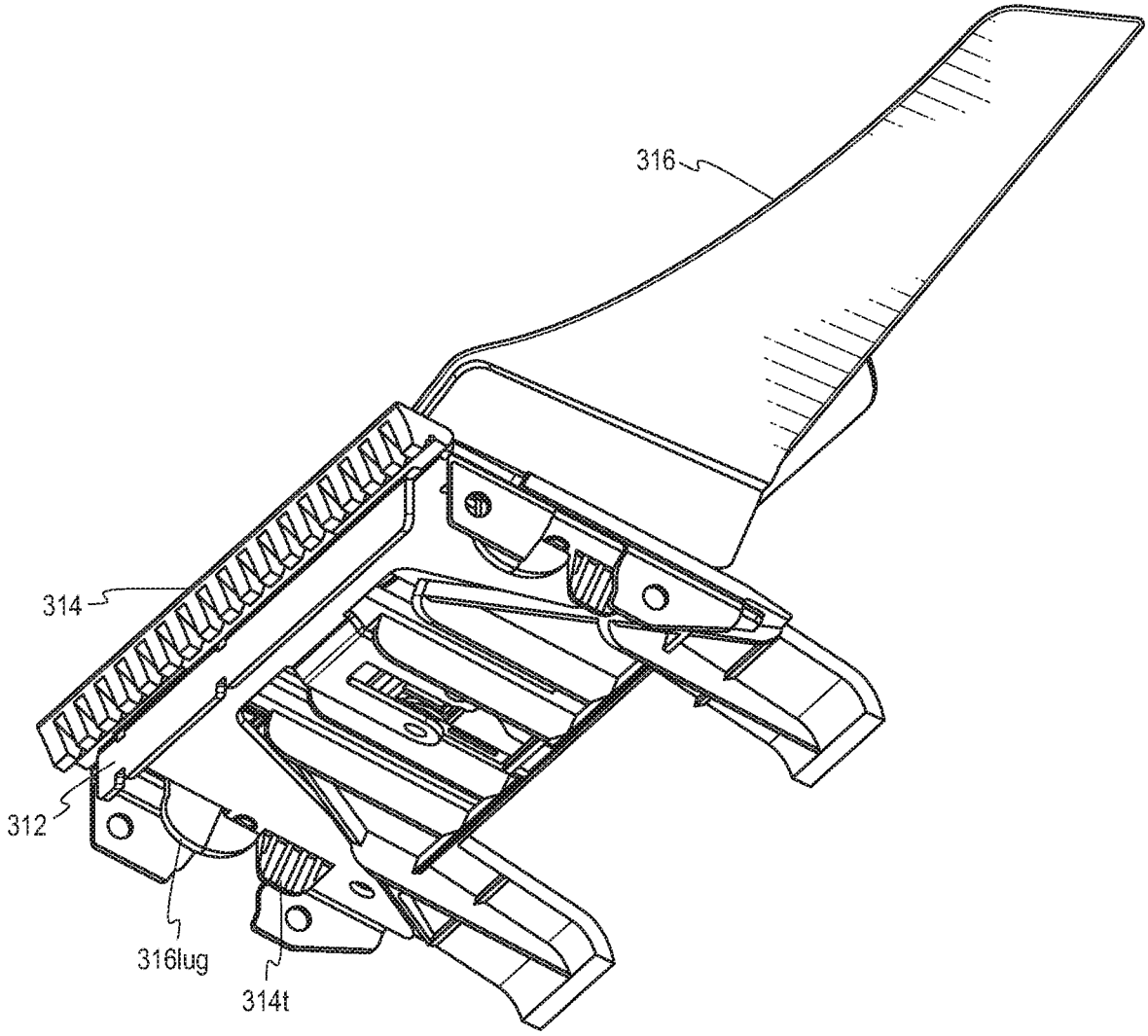
FIG. 3J is a bottom perspective of select components associated with an input hopper in an operational assembled state according to some embodiments.
Figure 3K:
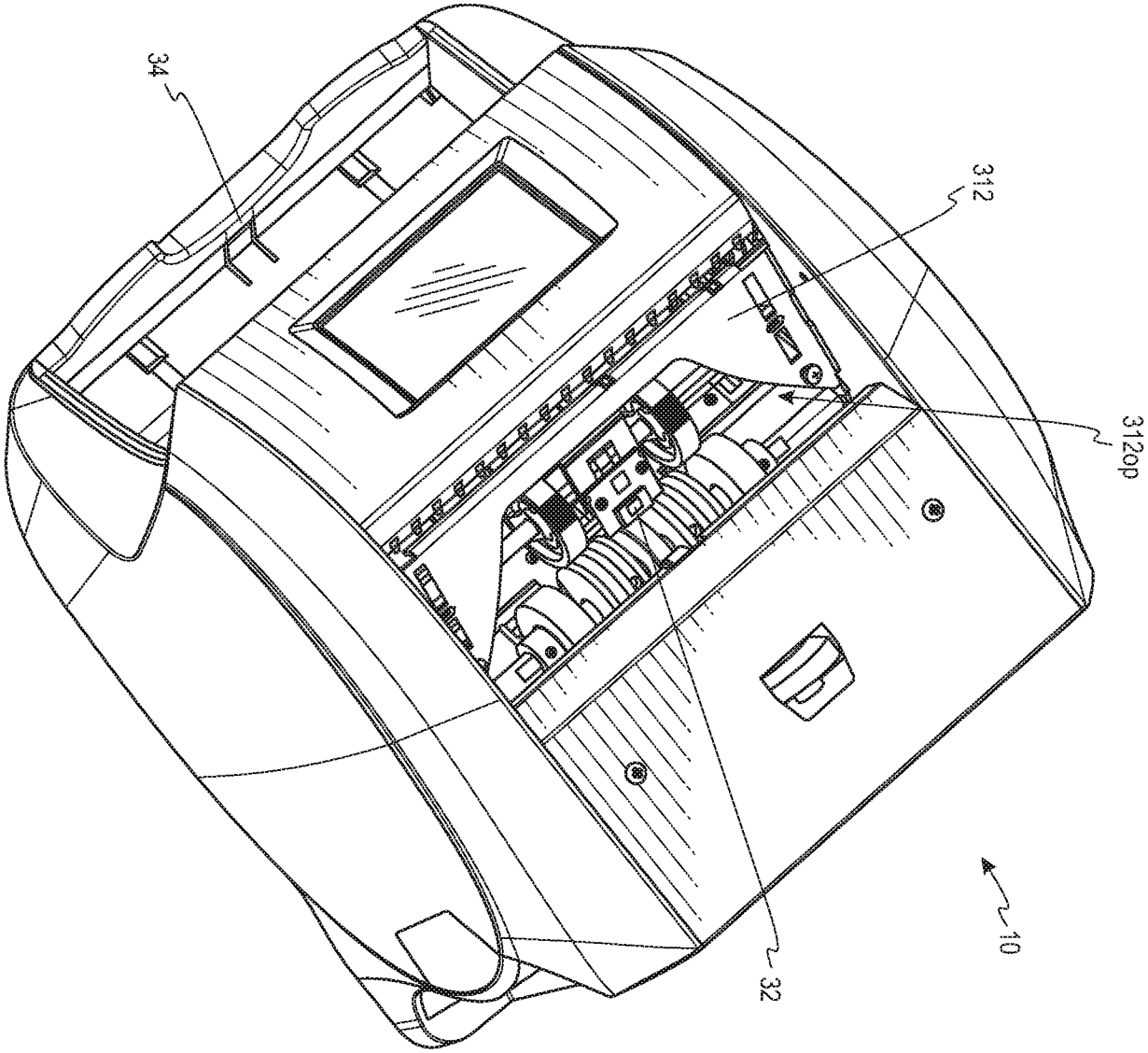
FIG. 3K is a downward perspective view of a banknote processing device according to some embodiments of the present disclosure having a hopper extension guide or bracket and a feeder plate removed.

Referring now to FIGS. 3A-3K, FIG. 3A is an exploded perspective view of select components associated with an input hopper such as input hopper 30 shown in FIG. 1 according to some embodiments. FIG. 3B is front perspective view and FIG. 3C is side perspective view of a hopper extension guide or bracket 316 according to some embodiments. FIG. 3D is top perspective view and FIG. 3E is bottom perspective view of a feeder plate 314 according to some embodiments. FIG. 3F is top perspective view and FIG. 3G is bottom perspective view of a feeder bracket 312 according to some embodiments. FIG. 3H is side view and FIG. 3I is a partial bottom perspective of select components associated with an input hopper in an operational assembled state according to some embodiments. FIG. 3J is a bottom perspective of select components associated with an input hopper in an operational assembled state according to some embodiments. FIG. 3K is a downward perspective view of a banknote processing device 10 according to some embodiments of the present disclosure having a hopper extension guide or bracket 316 and a feeder plate 314 removed.

The feeder bracket 312 is fixedly coupled to side walls of the banknote processing device 10 such as via screws according to some embodiments. The feeder plate 314 rests upon to the feeder bracket 312 according to some embodiments. The hopper extension bracket 316 is removably coupled to the feeder bracket 312 according to some embodiments. According to some embodiments, the feeder plate 314 has a longitudinal length and a pair of slot openings 314*s* positioned near opposite left and right ends 314*lt*, 314*rt* of the longitudinal length of the feeder plate. The hopper bracket 316 has a pair of hopper lugs 316*lug* extending from a bottom surface 316*b* of the hopper bracket 316. The hopper lugs 316*lug* have lower flanges or hooks 316*fl* which along with the bottom surface 316*b* define a feeder plate engagement opening 316*op*. The lower flanges or hooks 316*fl* are sized and configured to fit through the slot openings 314*s*. The lower flanges or hooks 316*fl* are also sized and configured to fit through hopper lug or hook openings 312*ho* in the feeder bracket 312. When the hopper bracket 316 is moved rearward with respect to the feeder plate 314 and the feeder bracket 312, top surfaces 316*flt* of the lower flanges or hooks 316*fl* of the hopper lugs 316*lug* contact a bottom surface 312*b* of the feeder bracket 312 so that hopper bracket 316 clips into the feeder bracket 312 via an interference fit. According to some embodiments, the top surfaces 316*flt* of each lower flange or hook 316*fl* of the hopper lugs 316*lug* contact a bump, projection, or dimple 312*dm* on the bottom surface 312*b* of the feeder bracket 312 so that hopper bracket 316 clips into the feeder bracket 312 via an interference fit with the feeder plate 314 positioned between the hopper bracket 316 and the feeder bracket 312. Dimple 312*dm* also creates a gap between the inside surface of the hopper lugs 316*lug* relative to the primary underside surface of feeder bracket 312. Without the gap created by the dimple 312*dm,* when hopper lugs 316*lug* are pushed back to engage the feeder bracket 312, the hopper lugs 316*lug* would contact the sheet metal edge adjacent to hook openings 312*ho,* which would likely shave or scrape material from the hopper lugs 316*lug*. Dimple 312*dm* prevents the aforementioned scraping or shaving, while simultaneously providing a surface with which to create the interference fit between the feeder bracket 312 and the hopper lugs 316*lug*.

To remove the hopper bracket 316 from the feeder plate 314 and feeder bracket 312, the hopper bracket 316 is manually slid forward relative to the feeder bracket 312 so that the interference fit between the top surfaces of the lower flanges or hooks 316*fl* of the hopper lugs 316*lug* and the bottom surface 312*b* of the feeder bracket 312 is disengaged and then the hopper lugs 316*lug* are lifted out of hopper lug or hook openings 312*ho* in the feeder bracket 312 and the slot openings 314*s* of the feeder plate 314. The feeder plate 314 may then be vertically lifted off the feeder bracket 312.

The interference fit between the hopper bracket 316 and the feeder plate 314 enables the hopper extension bracket 316 to be easily snap coupled to and removed from the feeder plate 314 without the use of tools and fasteners such as screws.

To assemble the feeder plate 314 and hopper extension 316, the feeder plate 314 is first placed on the feeder bracket 312. According to some embodiments, the feeder plate 314 has one or more projections or tabs 314*t* on the bottom surface 314*b* thereof and the feeder bracket 312 has a corresponding one or more tab openings 312 to sized and positioned to accommodate the tabs 314*t* fitting therethrough so as to aid in the feeder plate 314 being easily positioned on top of the feeder bracket 312 in the correct location. According to some embodiments, the tabs 314*t* on the bottom surface 314*b* and the corresponding tab openings 312 to constrain the movement of the feeder plate 314 left or right or forward or backward relative to the feeder bracket 312.

Next, the two lugs 316*lug* on the bottom of the hopper bracket 316 are lined up with openings 314*s* in the feeder plate 314. Once the lugs 316*lug* on the hopper bracket 316 are inserted into the openings 314*s* in the feeder plate 314, the lugs 316*lug* pass through corresponding hopper lug or hook openings 312*ho* in the feeder bracket. Then the hopper bracket 316 is manually forced or moved rearward away from the front of banknote processing device 10, thereby securing the hopper bracket 316 in place by an interference fit between the edge of the opening 316*op* in the lug 316*lug* and a dimple 312*dm* in the feeder bracket 312. According to some embodiments, the hopper extension bracket 316 and the feeder plate 314 are thus firmly secured in place, eliminating rattling. Yet, the hopper extension bracket 316 and the feeder plate 314 can be easily removed without any tools.

According to some embodiments, a cantilever hook 314*h* in the feeder plate 314 seats in a pocket 316*p* having a pocket edge 316*pe* on the hopper bracket 316 providing a person coupling the hopper bracket 316 to the feeder bracket 312 with a tactile and audible indicator that the hopper extension bracket 316 is properly seated with respect to the feeder bracket 312 and the feeder plate 314.

In addition to the hopper extension 316, the feeder plate 314 can also be simply removed without tools once the extension is removed. Once hopper extension bracket 316 has been removed from the feeder plate 314, the feeder plate 314 can easily be removed by lifting the feeder plate 314 away from the feeder bracket 312 and out of banknote processing device 10. With reference to FIG. 3K, once the feeder plate 314 has been removed, easy access to a feeder area is provided to a person such as an operator or service personnel which can facilitate, for example, the removal of any coins or debris that have fallen into the feeder area and/or to facilitate clearing any jams of one or more banknotes or other documents processed by the banknote processing device. As can be seen in FIG. 3K, after the hopper extension bracket 316 and the feeder plate 314 have been removed, an opening 312*op* in the feeder bracket 312 allows a person access to the area below within the banknote processing device 10 such as to the area near various rollers and transport plates.

According to some embodiments, a hopper sensor 32 (see e.g., FIGS. 1F and 3K) communicatively coupled to a processor, e.g., processor 75, detects the presence or absence of the feeder plate 314 relative to the feeder bracket 312. When the sensor detects the absence of the feeder plate 314 relative to its proper location with respect to the feeder bracket 312, the processor prevents one or more motors of the banknote processing device 10 from automatically starting such as when a banknote hopper sensor otherwise would signal a transport motor to start rotating a feed roller.

According to some embodiments, a hopper sensor 32 is mounted in the banknote processing device 10 by being coupled to the feeder bracket 312 and not to the feeder plate 314, which simplifies the installation and/or removal of the feeder plate 314. According to some embodiments, the feeder plate 314 has an opening 314*op* to allow the hopper sensor 32 positioned below to detect when banknotes are resting on the feeder plate 314.

According to some embodiments, the hopper bracket 316 has one or more banknote surfaces to constrain the movement of banknotes stacked in the hopper 30 on the feeder plate 314 such as a left side surface 316*lt,* a right side surface 316*rt,* and/or a rear surface 316*bk.* When a stack of banknotes is placed in the hopper 30 on feeder plate 314, edges of the banknotes in the stack are constrained from moving left, right, or rearwardly by the left side surface 316*lt,* the right side surface 316*rt,* and the rear surface 316*bk,* respectively. The vertical height of the banknote surfaces of the hopper bracket 316 allow for a higher stack of banknotes to be placed in the input receptacle or hopper 30 without the stack of banknotes falling out of the hopper 30. For example, with reference to FIGS. 1B and 1D, without the hopper extension bracket 316 in place, the top of the hopper 30 would be set by the height of the left side 30*lt,* the right side 30*rt,* and back or rear side 30*bk* of the hopper 30. If a stack of banknotes rises above any of the sides 30*lt,* 30*rt,* or 30*bk,* banknotes could fall out of the hopper 30. With the hopper extension bracket 316 in place, an additional height 316*h* is added to the hopper 30 allowing for a higher stack of banknotes to be reliably maintained in the hopper 30.

Figure 4:
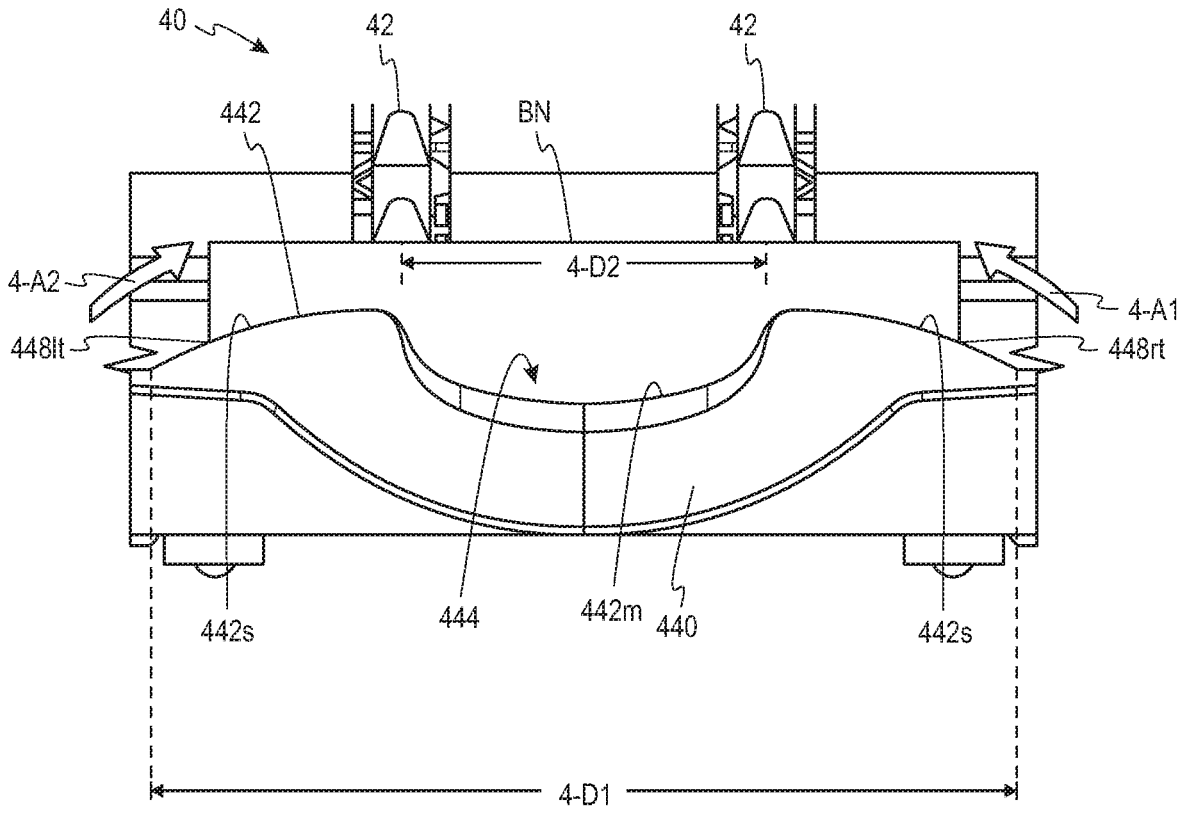
FIG. 4 is a front view of stacker tray of an output receptacle of a banknote processing device according to some embodiments.

FIG. 4 is a front view of stacker tray 440 of an output receptacle 40 of a banknote processing device such as banknote processing device 10 according to some embodiments. According to some embodiments, the stacker tray 440 has an upper edge 442 that has a central, downward curved portion 442*m* in a middle portion and two curved portions 442*s*, one on each side of the middle portion 442*m*. See also FIGS. 1A, 1B, 1D, and 2A. According to some embodiments, the stacker tray 440 is tilted forward such that the upper edge 442 of an inside surface 440*in* of the stacker tray 440 is positioned forward of a lower portion 440*lw* of the inside surface 440*in* of the stacker tray. See FIG. 2A. The forward tilt of the inside surface 440*in* of the stacker tray 440 assists with banknotes BN leaning against the stacker tray 440 after being deposited in the output receptacle 40 by the stacker wheels 42 and the stacking of the banknotes BN in the output receptacle neatly on their edges.

According to some embodiments, the two curved portions 442*s* arc upward toward the middle of the stacker tray 440 and the middle of the output receptacle 40. According to some embodiments, the curve of the two curved portions 442*s* mirror each other about the middle of the stacker tray 440 and the middle of the output receptacle 40. Accordingly, the curve of the curved portions 442*s* of the upper edge 442 of the stacker tray facilitates an operator's ability to easily slide one or more fingers along the upper edge 442 to tap or push banknotes BN such as U.S. banknotes either to the left (see arrow 4-A1) to align banknotes against the left side wall 40*lt* of the output receptacle 40 or to the right (see arrow 4-A2) to align banknotes against the right side wall 40*rt* of the output receptacle 40. Additionally or alternatively, the mirrored curve of the curved portions 442*s* of the upper edge 442 of the stacker tray facilitates an operator's ability to easily slide one or more fingers on each hand along the upper edge 442 to tap or push banknotes BN such as U.S. banknotes toward the middle (see arrows 4-A1 and 4-A2) of the output receptacle to align banknotes in the middle of the output receptacle 40 while providing a visual indication to an operator to assist in positioning one or more banknotes in the center of the output receptacle 40 such as the height at which the left edge of a banknote BN touches the stacker tray (see point 448*lt*) and the height at which the right edge of a banknote BN touches the stacker tray (see point 448*rt*) and assessing whether these two heights are equal. According to some embodiments, the above design allows an operator to left justify or right justify a stack of banknotes such as U.S. banknotes using a single finger and/or centrally justify a stack of banknotes such as U.S. banknotes using a single finger on each hand.

As stated above, according to some embodiments, the stacker tray 440 has a central, downward curved portion 442*m*. The central portion 442*m* may comprise two curved portions that each arc from a high point on the outside near portions 442*s* to a low point in the center of the output receptacle and the two curved portions may mirror each other about the center of the output receptacle 40. The downward curved portion 442*m* provides a central opening 444 which facilitates the ability of an operator to easily reach a hand into the output receptacle 40 and grasped and remove a stack of banknotes BN contained therein.

Figure 1D:
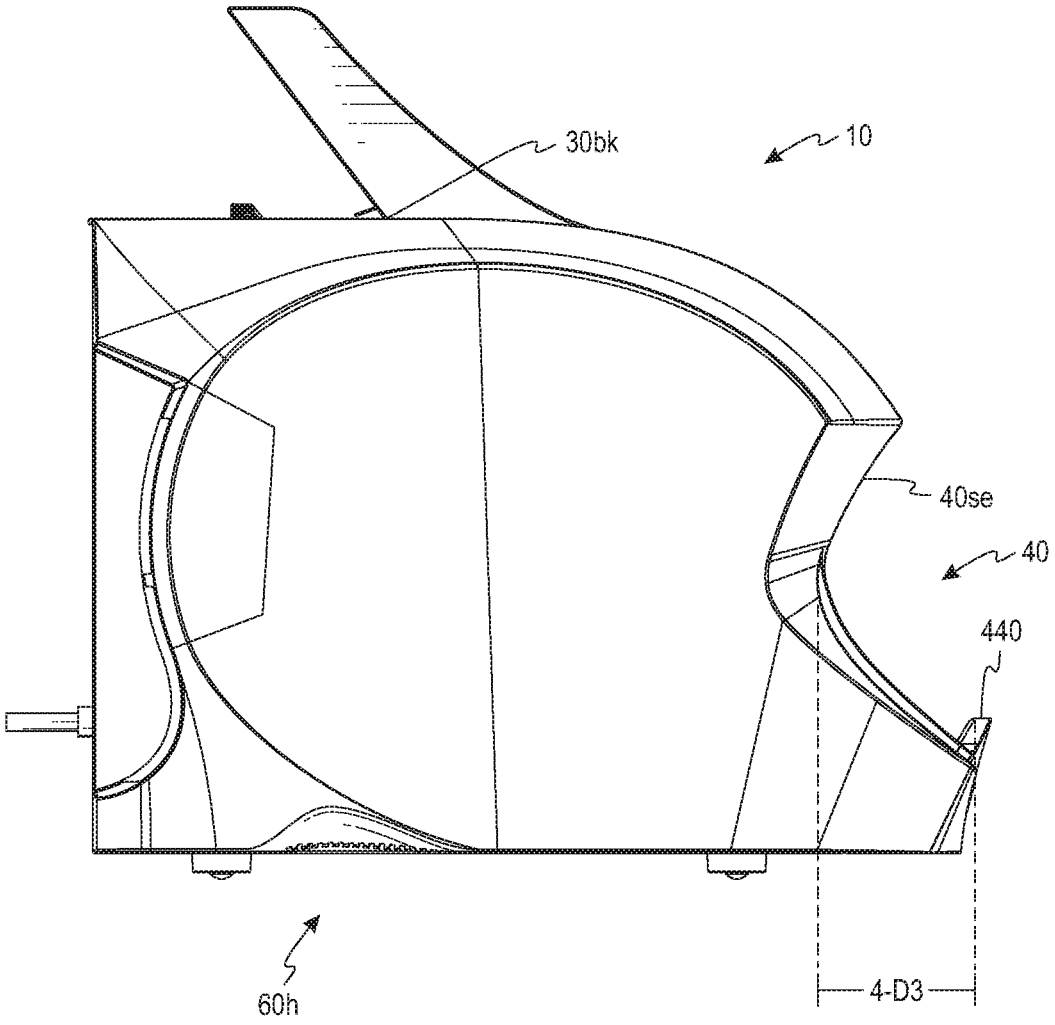
FIG. 1D is a left side view of the banknote processing device of FIG. 1A.

As best seen in FIGS. 1A, 1B, 1D, 1E, and 1F, according to some embodiments, to facilitate the ability of an operator to easily reach a hand and/or one or more fingers into the output receptacle 40 and grasped and remove a stack of banknotes BN contained therein and/or to justify banknotes BN stacked in the output receptacle 40, the output receptacle 40 has left 40*lt* side wall and/or right 40*rt* side wall curved rearwardly away from the stacker tray 440 thereby providing the output receptacle 40 with large side cutouts in the side walls of the output receptacle 40. With reference to FIG. 1D, according to some embodiments, such as embodiments for processing U.S. banknotes, the output receptacle 40 has side walls 40*lt*, 40*rt* having a front edge 40*se* that curve away from the upper edge 442 of the stacker tray 440 by a distance 4-D3 as much as between about 1¾ inches and 2¾ inches such as being about 2 inches.

With reference to FIG. 4, according to some embodiments the width 4-D1 of the curved portions 442*s*, 442*m* and/or the width 4-D2 of the central, downward curved portion 442*m* are sized to assist the justification and/or removal of U.S. banknotes. According to some embodiments, width 4-D1 ranges between about 7¾ inches and 8¼ inches such as being about 8 inches wide. According to some embodiments, width 4-D2 ranges between about 3.4 inches and 2.9 inches such as being 3.2 inches wide.

Figure 5A:
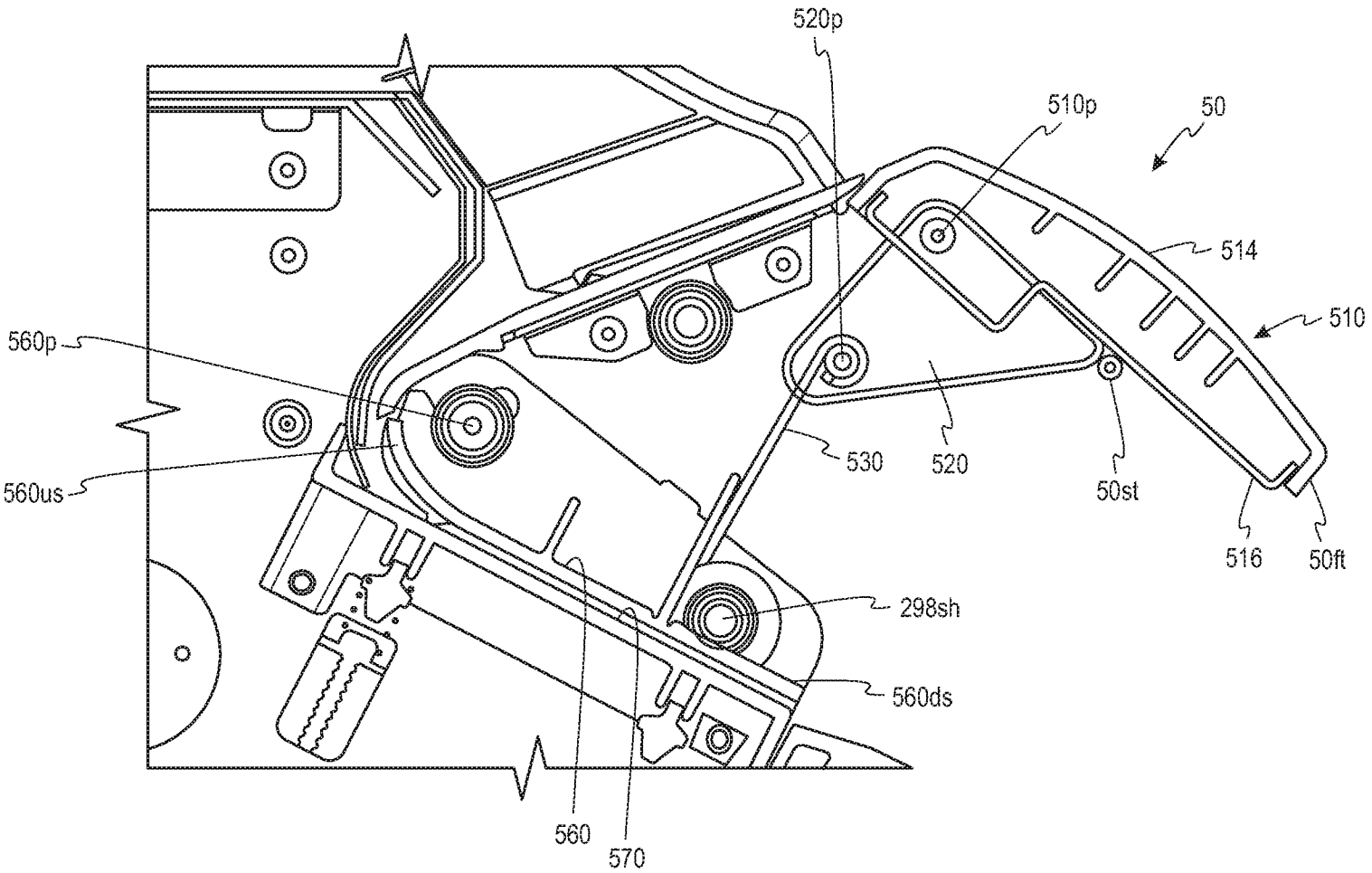
FIG. 5A is a side sectional view of some components of a banknote processing device according to some embodiments illustrating a display assembly and upper transport plate positioned in an operational position.
Figure 5B:
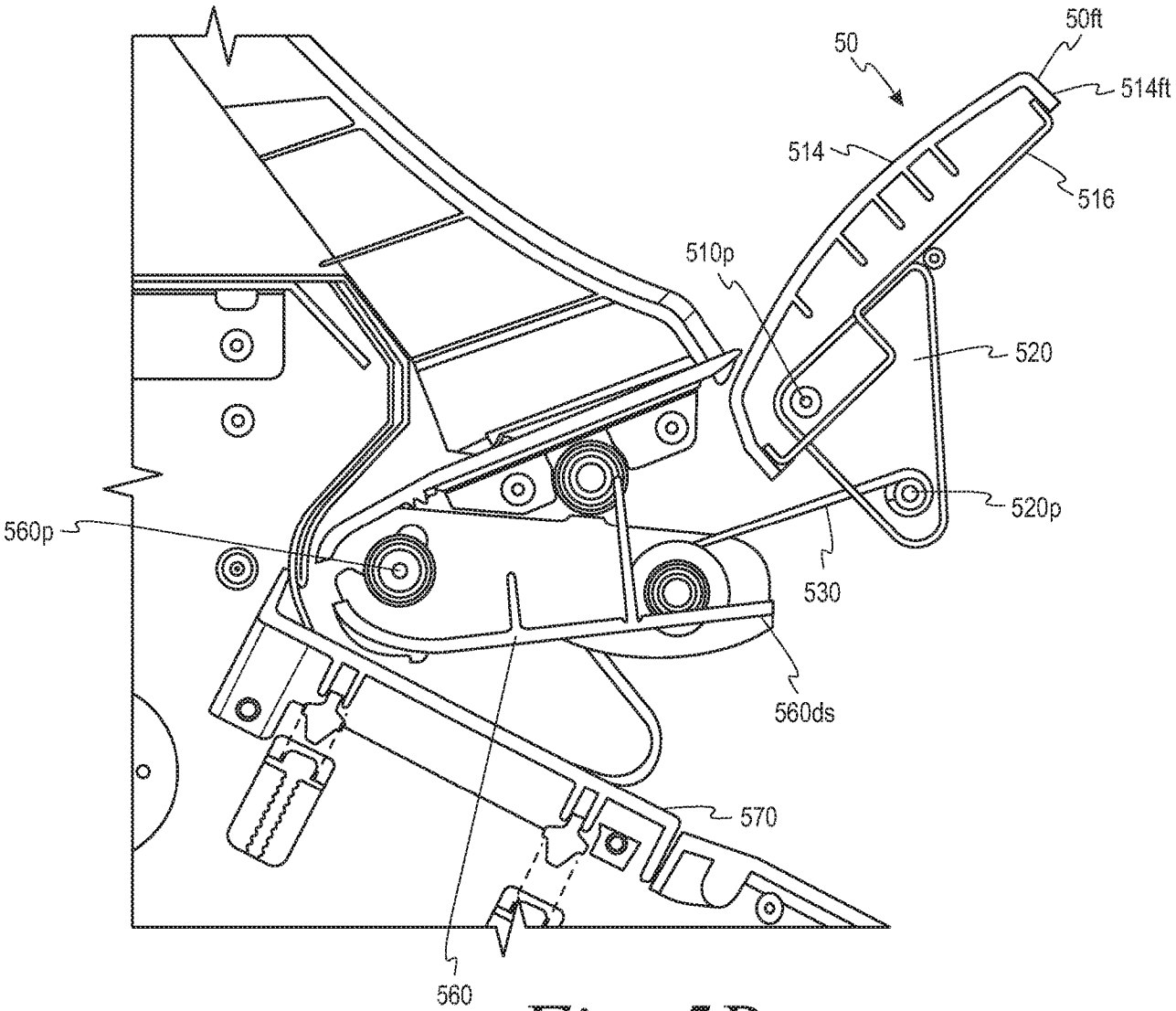
FIG. 5B is a side sectional view of some components of a banknote processing device according to some embodiments illustrating the display assembly and upper transport plate of FIG. 5A positioned in an open, service position.

FIG. 5A is a side sectional view of some components of a banknote processing device such as banknote processing device 10 according to some embodiments illustrating a display assembly 50 and an upper transport plate 560 positioned in an operational position. FIG. 5B is a side sectional view of some components of a banknote processing device according to some embodiments illustrating the display assembly 50 and the upper transport plate 560 of FIG. 5A positioned in an open, service position.

According to some embodiments, the display assembly 50 comprises a display bezel 510 and a display assembly bracket 520 coupled thereto. According to some embodiments, the display bezel 510 may comprise a display 52 (see FIG. 1A), a bezel cover 514 and a bezel backing plate 516. The display assembly 50 is configured to pivot about display assembly pivot axis 510*p* so a front 50*ft* of the display assembly may be manually moved upward and downward about axis 510*p* by an operator.

According to some embodiments, a linkage such as spring link 530 couples the display assembly 50 to the upper transport plate 560 such as near a downstream end 560*ds* of the upper transport plate 560. The upper transport plate 560 is configured to pivot about an axis 560*p* located near an upstream end 560*us* of the transport plate 560. According to some embodiments, the spring link 530 is a wire having a loop at each end. One loop is pivotally connected to the upper transport plate 560 and the other loop is pivotally connected to the display assembly 50. For example, according to some embodiments, one end of the linkage such as spring link 530 may be pivotally connected to the display assembly bracket 520 about an upper link pivot axis 520*p* and the other end of the linkage such as the spring link 530 may be pivotally connected to the upper transport plate 560 about a lower link pivot axis about a downstream driven roll shaft 298*sh*. According to some embodiments, to provide a desired amount of leverage, axis 520*p* is spaced a desired distance apart from axis 510*p* about which the display assembly pivots. In some embodiments, the linkage can be a rigid component, such as a wire, rod, or other components, connected between the transport plate 560 and the display assembly 50 to maintain the distance between the transport plate 560 and the display assembly 50 during movement, and can be made of various materials, such as metal, plastic, or other materials. In some embodiments, the linkage can be an elastic component, such as a compression spring, an extension spring, a torsion spring, or other elastic components, connected between the transport plate 560 and the display assembly 50 that can compress or otherwise provide an elastic force on the transport plate 560 to hold the transport plate 560 in the working position and provide movement to the transport plate 560 when the display assembly 50 is rotated, and can be made of various materials such as metal, plastic, or other materials.

According to some embodiments, the display assembly 50 comprises a display bezel 510 and a pair of lateral display assembly brackets 520, one end the left side and one near the right side of the display bezel 510, and the display assembly 50 comprises a pair of laterally spaced spring links 530 which couple the display assembly 50 via the lateral display assembly brackets 520 to the upper transport plate 560 such as near a downstream end 560*ds* of the upper transport plate 560 near both the left and right sides of the transport plate 560.

When the display assembly 50 is opened by rotating it upward, the spring link 530 pulls the front or downstream end 560*ds* of the upper transport plate 560 upward, pivoting about axis 560*p* (FIG. 5B). According to some embodiments, axis 560*p* coincides with drive or drum roll shaft 275*sh* (see, e.g., FIG. 2F). With the upper transport plate 560 in its upward, open position, operator access is provided to the paper path, for example, to permit the cleaning of sensors and/or the clearing jams of banknotes.

When the display assembly 50 is rotated downward to its working position (shown in FIG. 5A), the spring link 530 rotates the upper transport plate 560 to its working position. According to some embodiments, the spring link 530 will slightly over travel, which provides an appropriate amount of pressure to hold the upper transport plate 560 in its operational or working position relative to a lower transport plate 570.

According to some embodiments, the spring link 530 is an over-center spring link. In addition, when the display bezel 510 is closed, the spring link 530 moves over center to hold the upper transport plate 560 in its working position and locked in place. According to some embodiments, the display assembly 50 comprises one or more display assembly stops 50*st,* e.g., one near each of the left side and the right side of the display assembly 50. According to some embodiments, when the display assembly 50 is rotated downward to its working position (shown in FIG. 5A), the rotation downward of the front 514*ft* of the bezel 514 is stopped when the bezel backing plate 516 engages the one or more display assembly stops 50*st.*

According to some embodiments, when the display assembly 50 is rotated downward to its working position (shown in FIG. 5A) and the display assembly 50 abuts against one or more of the display assembly stops 50*st,* the spring link 530 is in a compressed state and exerts a downward force on the upper transport plate 560. As shown in FIG. 5A, the relationship between the display assembly pivot axis 510*p,* the upper link pivot axis 520*p,* and the lower link pivot axis about a downstream driven roll shaft 298*sh* is such that the line of action between the display assembly pivot axis 510*p* and the lower link pivot axis about a downstream driven roll shaft 298*sh* falls slightly to the right side of the upper link pivot axis 520*p.* In this over-center state, the spring link 530 exerts a clockwise moment to the display assembly 50, holding it against a display assembly stop 50*st.* As the display assembly 50 is opened, the spring link 530 is further compressed as the three pivot points (510*p,* 520*p,* 298*sh*) are aligned. Further rotation of the display assembly 50 initially unloads the spring link 530, then utilizes the link 530 as a tension member to open the upper transport plate 560.

Thus, according to some embodiments, an operator can transition the display assembly 50 and the upper transport plate 560 between their respective operational, working positions and their open, non-operational positions to facilitate access to an area between the upper transport plate 560 and the lower transport plate 570 by simply manually pivoting the display bezel 510 upward and downward. The function of the linkage such as spring link 530 provides a simple mechanism for a person (such as a user or operator or service personnel) to clean sensors and/or clear jams by interacting with one component of the banknote processing machine 10 without having to unlock or remove anything. The pivoting upward of the upper transport plate 560 leaves a wide opening, making it easier for the user to perform one or more desired tasks. The spring link 530 is a low-cost solution that provides a linkage and secures the upper transport plate 560 in its proper working position with an appropriate pressure.

According to some embodiments, the design of the display assembly 50 and the side covers 60*lt,* 60*rt* of the banknote processing device 10 also makes it obvious to the operator when the upper transport plate 560 is not fully closed to its working position. According to some such embodiments, the left 510*lt* and/or right 510*rt* surface of the display assembly 50 is configured to be flush with the adjacent portions 60*dlt,* 60*drt* of the side covers 60*lt,* 60*rt* (see, e.g., FIG. 1A) when the upper transport plate 560 is in its locked, working position.

According to some embodiments, the banknote processing device 10 is provided with a display assembly 50 that permits the angle of the display/user interface 52 to be adjusted to accommodate varying viewing angles preferred by one or more operators. For example, operators may have varying heights and/or the banknote processing device 10 may be placed on counters or table tops having varying heights. According to some such embodiments, the same spring link 530 may be used to provide some adjustability in the display bezel 510 to allow customers to adjust the display bezel 510 to the best viewing angle. According to some such embodiments, this may be accomplished with the use of a separate spring that assures the transport plate stays locked in position while the display bezel 510 moves slightly. For example, according to some embodiments, a spring-loaded detent may be added to the display assembly 50 to allow independent setting of the display angle relative to the bezel backing plate 516 to allow customers to adjust the display bezel 510 to the best viewing angle.

Figure 2A:
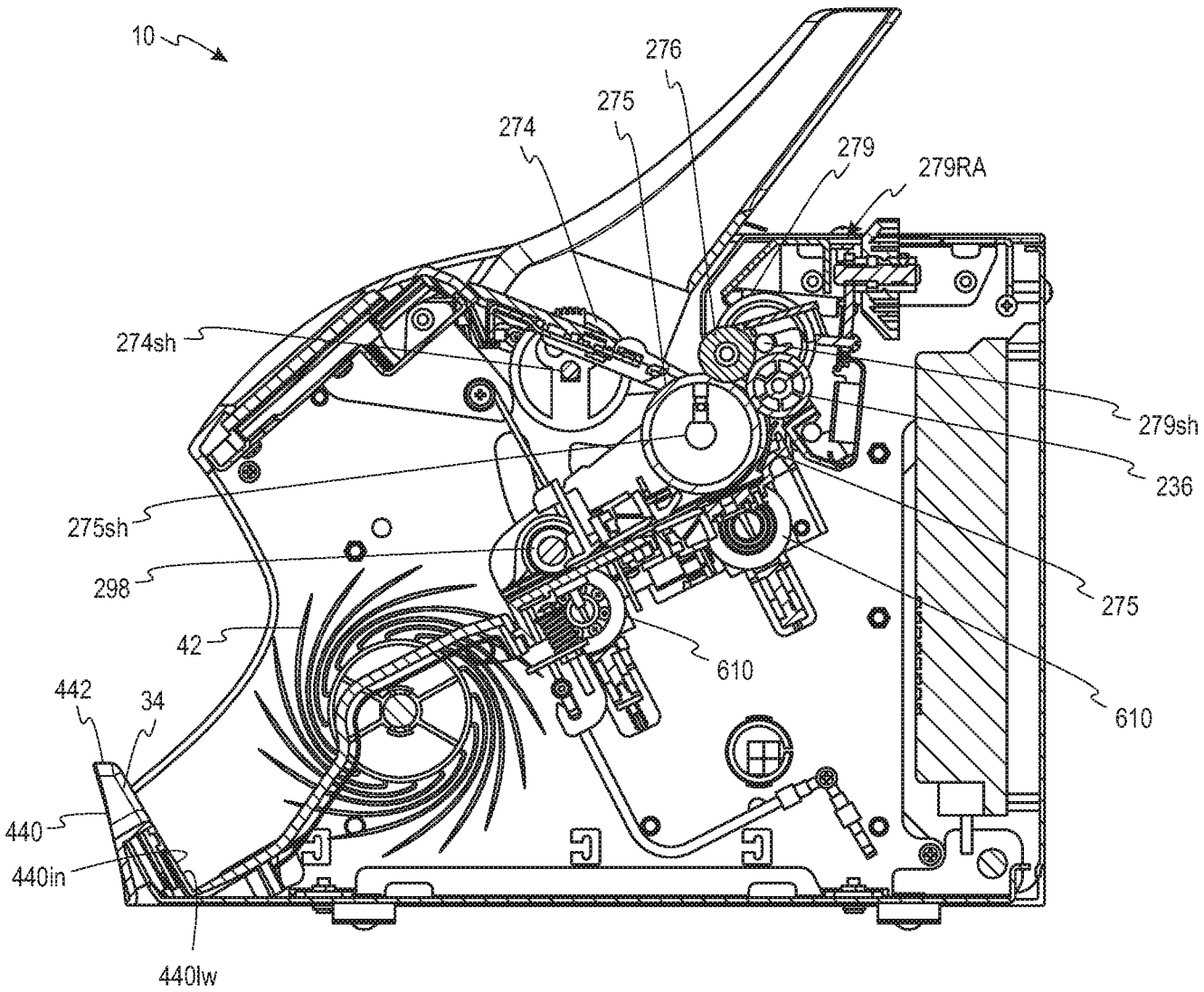
FIG. 2A is a side cross-sectional view of the banknote processing device of FIG. 1A.

Referring to FIG. 2A, opposite a transport path from a drive or drum roll 275, there are plurality of passive or idler rollers 610 which press banknotes or documents passing therebetween into contact with the drive roll 275. Likewise, opposite the transport path from downstream driven rolls 298, there are plurality of passive or idler rollers 610 which press banknotes passing therebetween into contact with the driven rolls 298. Sometimes the idler rollers 610 need to be replaced as part of maintenance of a banknote processing device such as banknote processing device 10. Idler rollers assemblies 600 and efficient ways to install, remove, assemble, disassemble, and service the idler rollers 610 and idler rollers assemblies 600 will be discussed in connection with FIGS. 6A-6I.

Figure 6A:
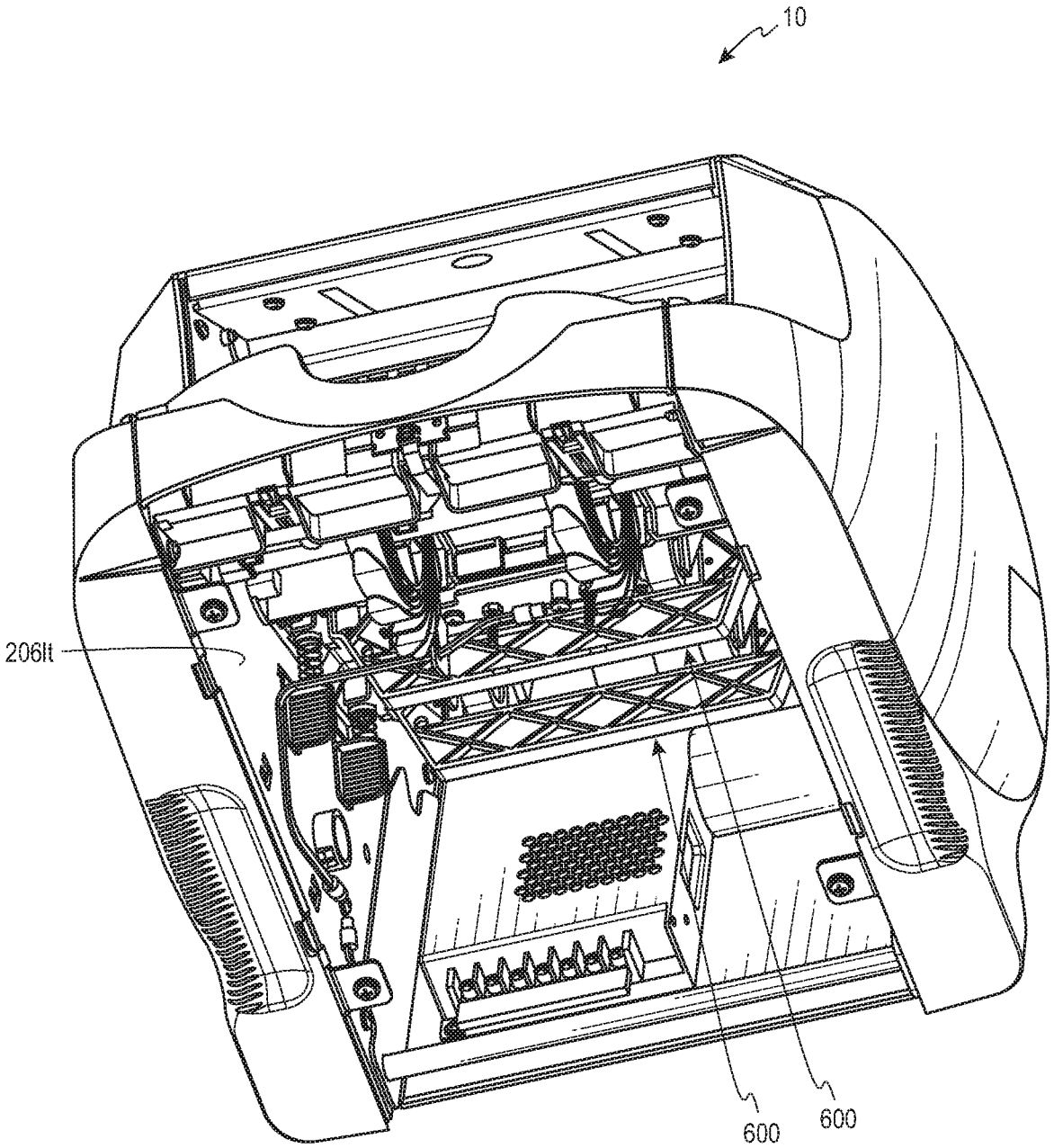
FIG. 6A is a bottom perspective view of a banknote processing device having a bottom panel removed according to some embodiments illustrating idler or passive roller assemblies.
Figure 6B:
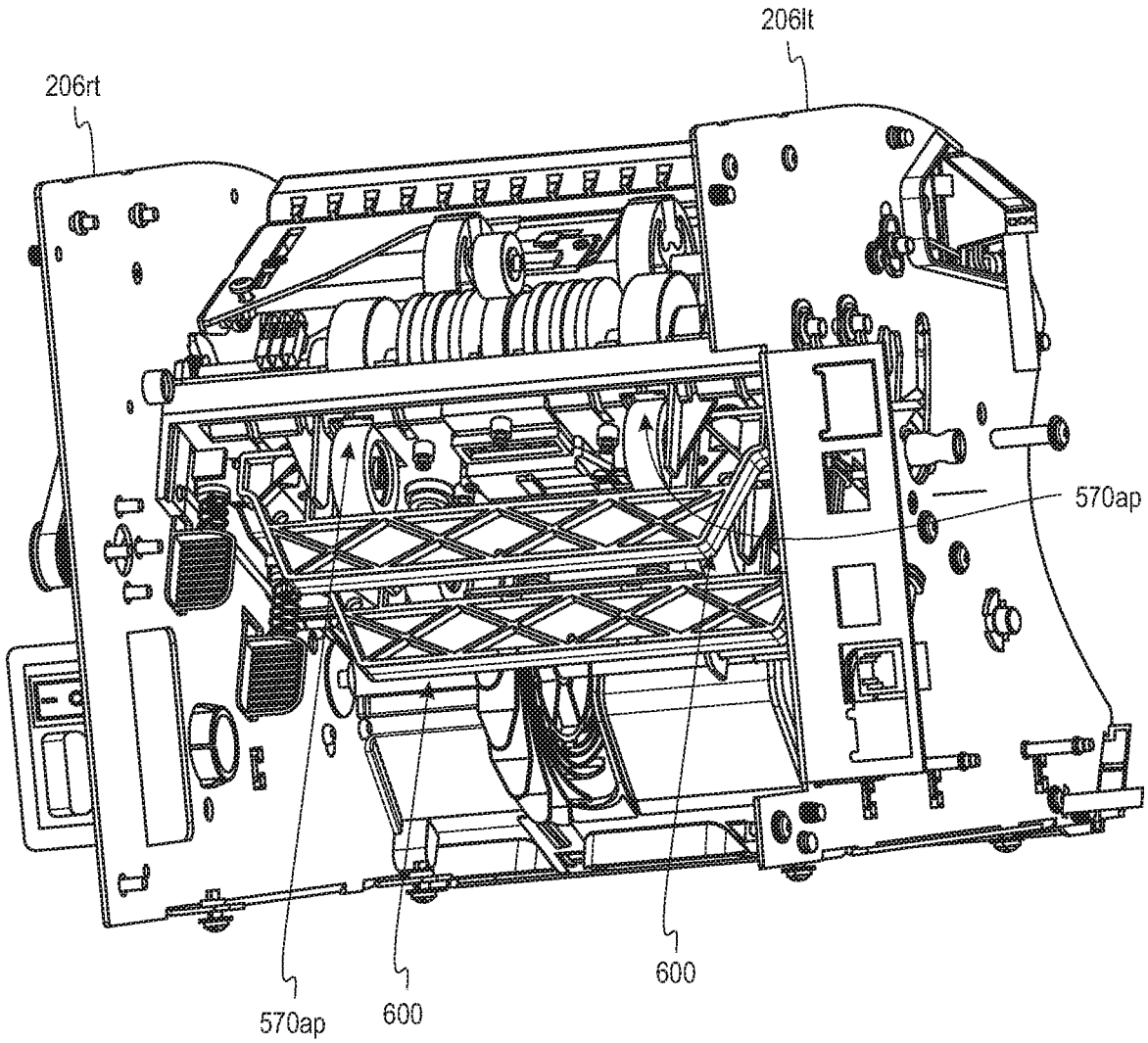
FIG. 6B is a rear perspective view of some components of a banknote processing device having a rear panel removed according to some embodiments illustrating idler or passive roller assemblies.
Figure 6C:
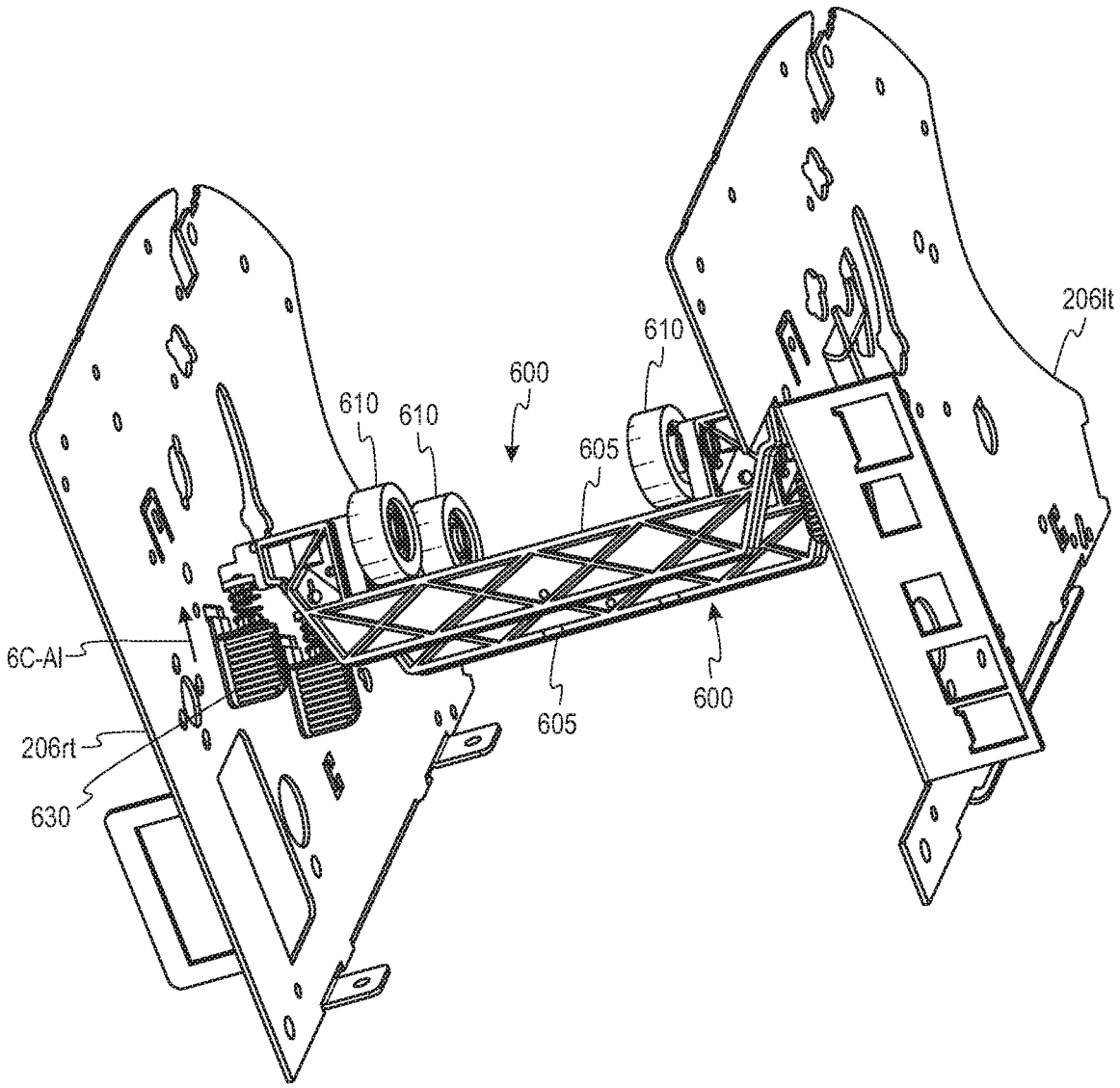
FIG. 6C is a rear perspective view idler or passive roller assemblies mounted between two side walls or plates.
Figure 6D:
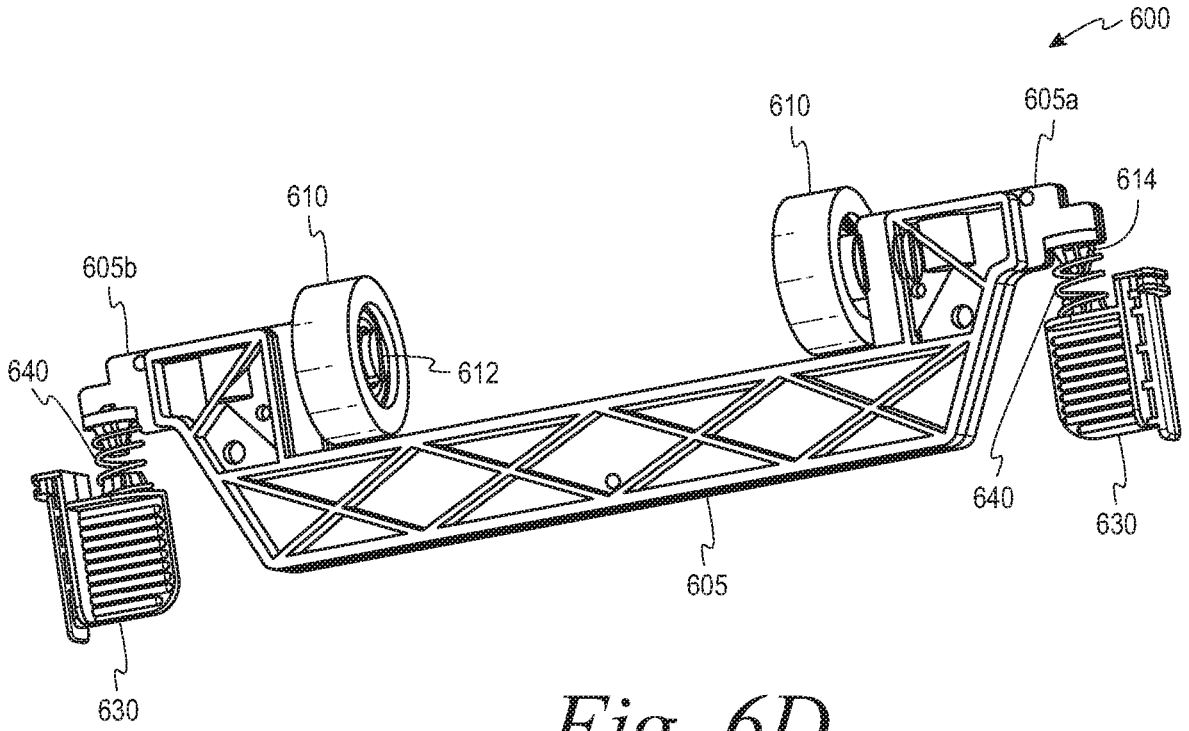
FIG. 6D is a rear perspective view of an idler or passive roller assembly having two idler rollers mounted thereon and FIG. 6E is a rear perspective view of an idler or passive roller assembly having one idler roller mounted thereon and a second idler roller removed and illustrating an idler roller mounting post.
Figure 6E:
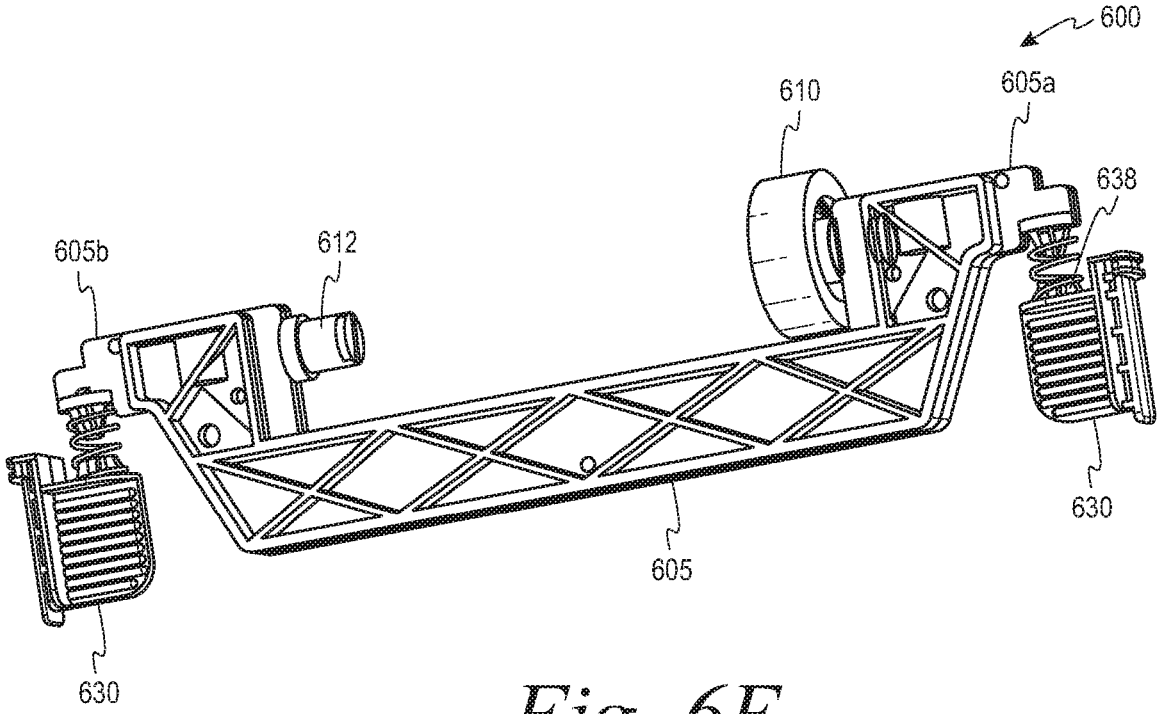

FIG. 6A is a bottom perspective view of a banknote processing device such as banknote processing device 10 having a bottom panel 602 (see FIG. 1G) removed according to some embodiments illustrating idler or passive roller assemblies 600. FIG. 6B is a rear perspective view of some components of a banknote processing device such as banknote processing device 10 having a rear panel 604 (see FIG. 1C) removed according to some embodiments illustrating idler or passive roller assemblies 600. FIG. 6C is a rear perspective view idler or passive roller assemblies 600 mounted between two side walls or plates 206*rt,* 206*lt.* FIG. 6D is a perspective view of an idler or passive roller assembly 600 having two idler rollers 610 mounted thereon and FIG. 6E is a perspective view of an idler or passive roller assembly 600 having one idler roller 610 mounted thereon and a second idler roller removed and illustrating an idler roller mounting post or axle 612. FIG. 6E1 is an enlarged perspective view of an idler roller mounting post 612. FIG. 6E2 is a perspective view of an idler roller 610.

Referring to FIGS. 6C-6D, each idler roller assembly 600 comprises a plurality of idler rollers 610 mounted on an idler roller beam 605. According to some embodiments, each idler roller 610 is mounted on an idler roller mounting post or axle 612 coupled to or formed integral with the idler roller beam 605. In FIG. 6E, one of the idler rollers 610 has been removed illustrating the idler roller mounting post 612 on to which an idler roller 610 may be easily manually mounted and/or removed without the use of tools.

Referring to FIG. 6E1, according to some embodiments, the idler roller post 612 comprises two or more longitudinal projections 612*a*, 612*b* extending from an idler roller post base 612*c*. The distal ends of the two or more longitudinal projections 612*a*, 612*b* are separated from each other by a small gap. The distal ends of the two or more longitudinal projections 612*a*, 612*b* have a lip or flange 612*lp*.

To mount an idler roller 610 onto an idler roller post 612, a center opening or aperture 610*op* of an idler roller 610 (FIG. 6E2) is aligned with the post 612 and pressed into the distal end of the post 612 along direction 6E-A2 causing the distal ends of projections 612*a*, 612*b* to be squeezed toward each other (see arrows 6E-A1 in FIG. 6E1). The idler roller 610 is then moved further along the post 612 toward the base 612*c* until the lips 612*lp* of the distal ends of projections 612*a*, 612*b* pass over a rim 611*rm* of a wheel 611 of idler roller 610. The longitudinal projections 612*a*, 612*b* which are biased outward move away from each other and the lips 612*lp* of the longitudinal projections 612*a*, 612*b* rotatably secure the idler roller 610 on the post 612 by preventing the rim 611*rm* of the wheel 611 from moving off the post in the direction 6E-A3.

To remove an idler roller 610 from an idler roller post 612, the distal ends of projections 612*a*, 612*b* are manually squeezed toward each other (see arrows 6E-A1 in FIG. 6E1) and the idler roller is moved away from the base 612*c* of the post 612 (direction 6E-A3 in FIG. 6E1) with the lips 612*lp* of the longitudinal projections 612*a*, 612*b* sliding inside the center opening 610*op* of the idler roller 610. The idler roller 610 may then be removed from the post 612 by continuing to manually move the idler roller away from the base 612*c*. In FIG. 6I, idler roller 610' is shown removed from post 612.

The idler roller beam 605 has a longitudinal length having two ends 605*a*, 605*b* which when the beam 605 is positioned in an operational position extends between the two side walls or plates 206*rt*, 206*lt* of the banknote processing device 10 (see, e.g., FIG. 6C). Near each longitudinal end 605*a*, 605*b* the beam 605 has a beam spring post 614 (best seen in FIG. 6J1).

Figure 6F:
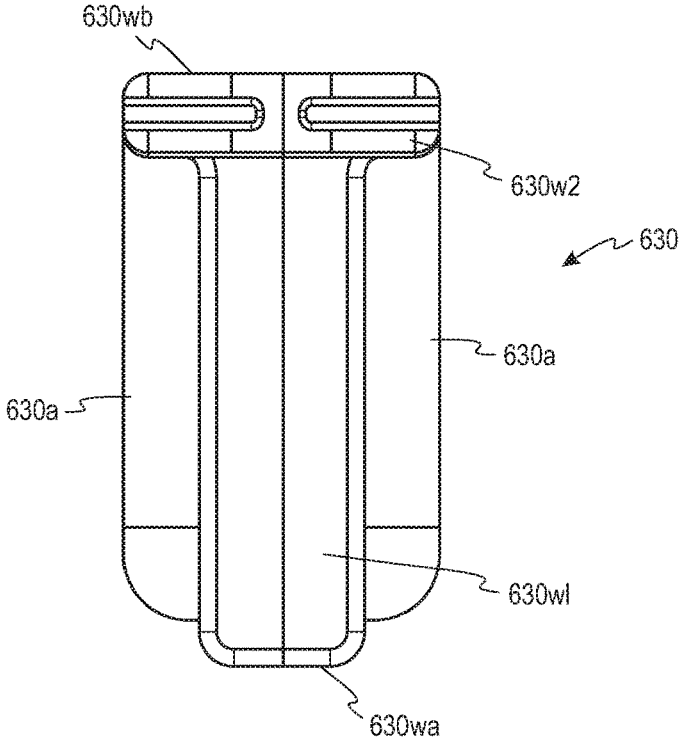
FIG. 6F is an end plan view of one side of an idler clip or spring cleat and FIG. 6G is a perspective view of an idler clip or spring cleat.
Figure 6G:
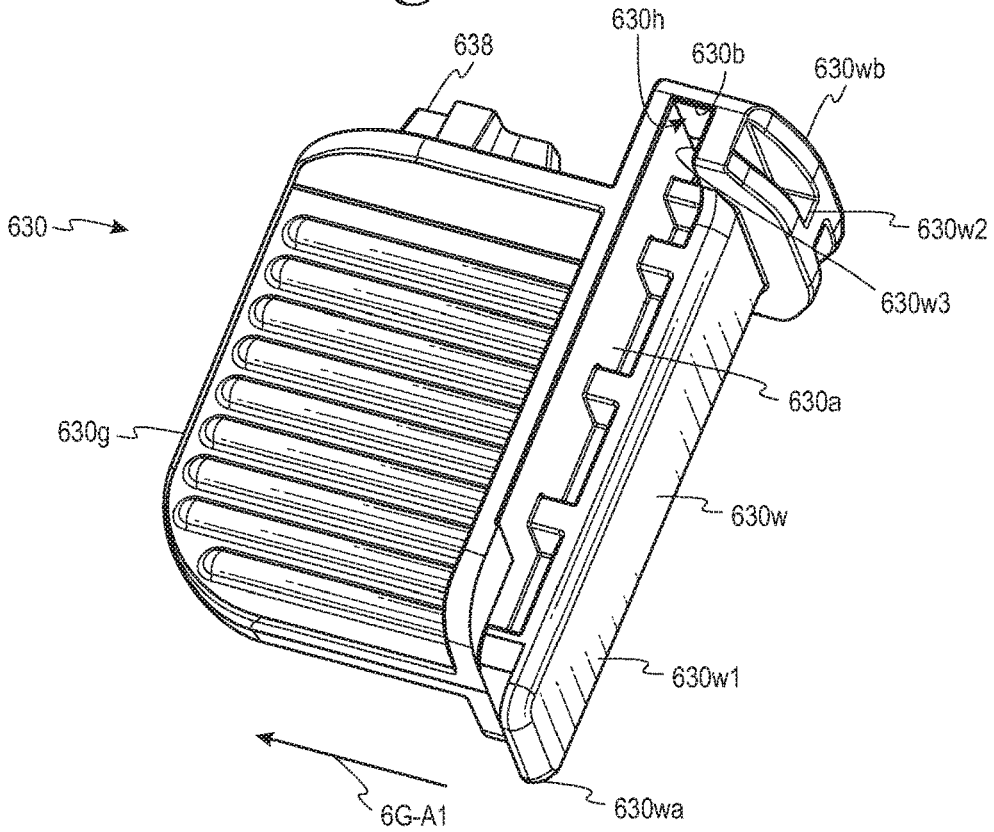
Figure 6H:
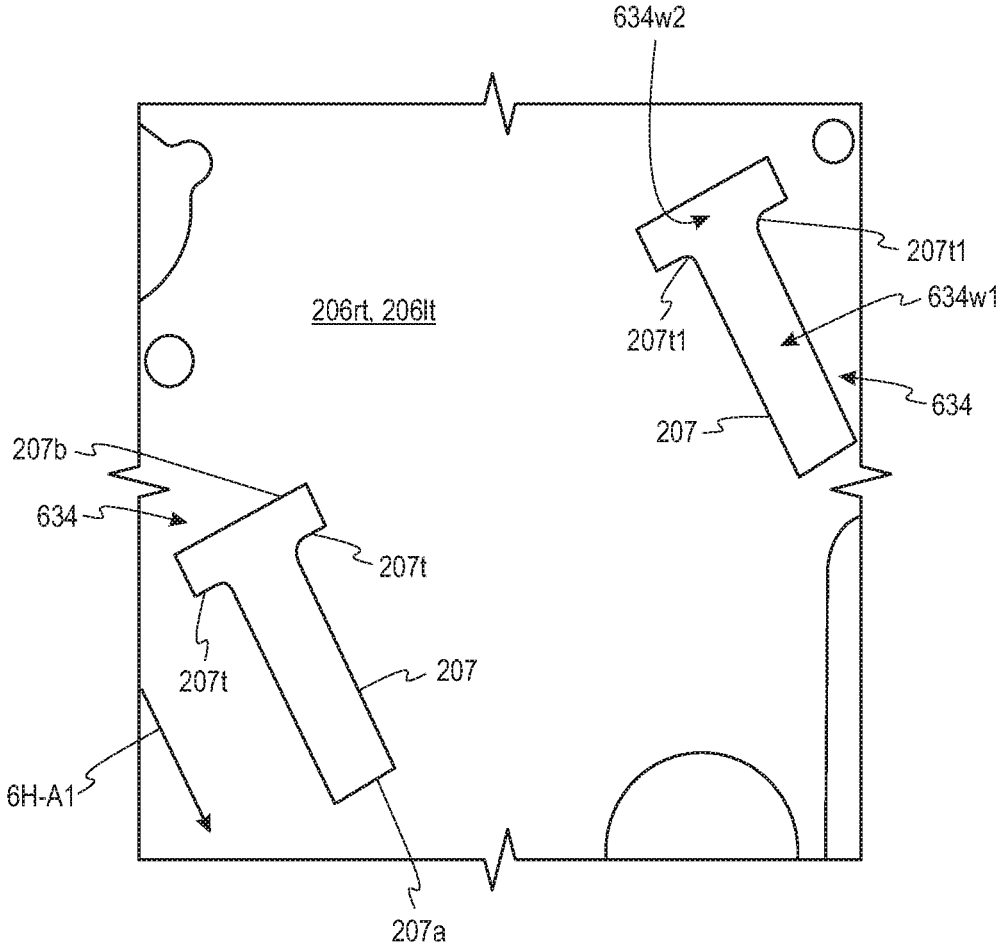
FIG. 6H is a plan view of a portion of a side wall or plate illustrating two idler clip or spring cleat apertures.
Figure 6I:
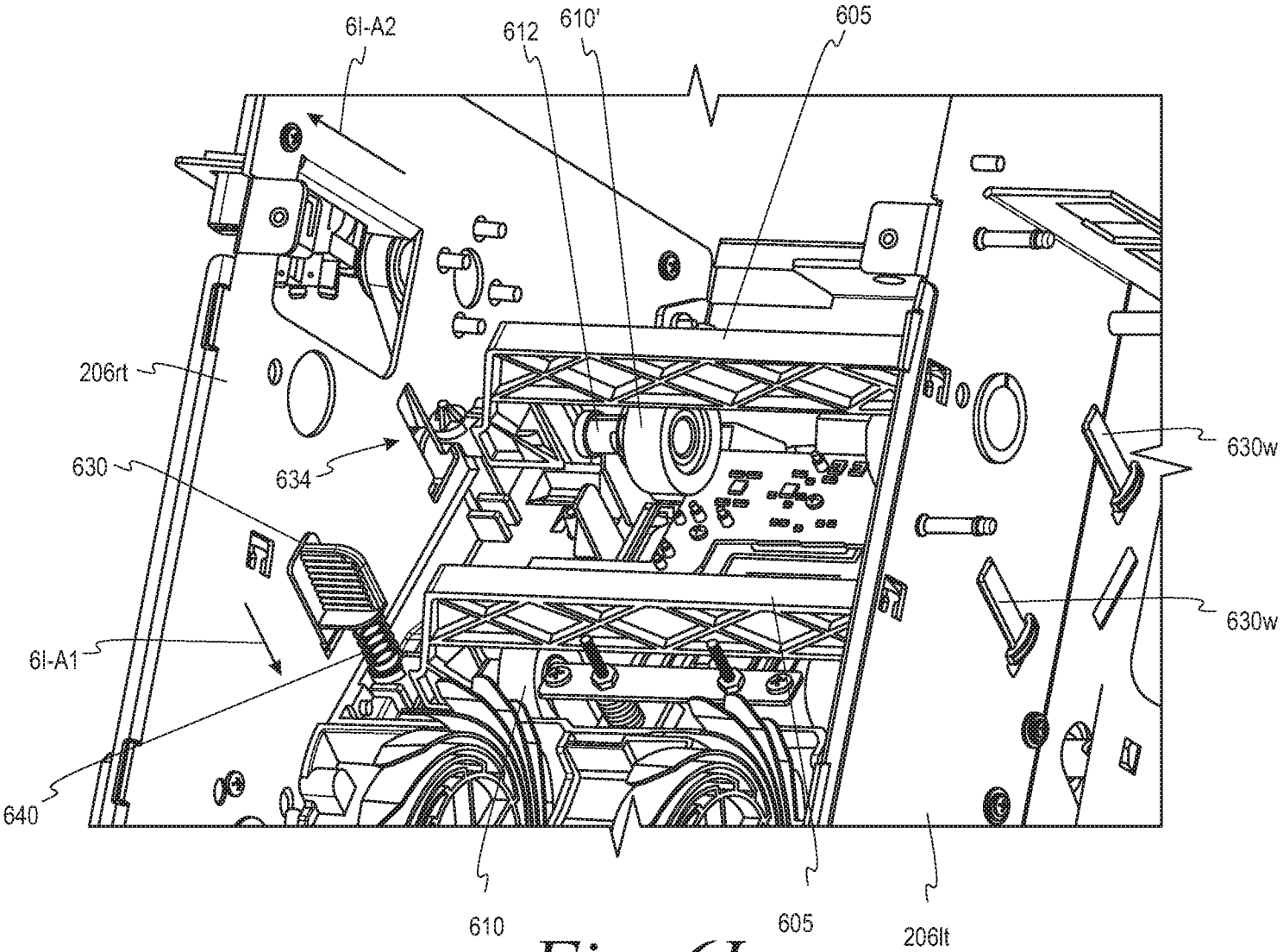
FIG. 6I is a bottom perspective view of some components of a banknote processing device according to some embodiments illustrating the removal of an idler roller assembly and an idler roller.

FIG. 6F is an end plan view of one side of an idler clip or spring cleat 630 and FIG. 6G is a perspective view of an idler clip or spring cleat 630. FIG. 6H is a plan view of a portion of a side wall or plate 206*rt*, 206*lt* illustrating two idler clip or spring cleat retaining apertures or slots 634. FIG. 6I is a bottom perspective view of some components of a banknote processing device 10 according to some embodiments illustrating the removal of an idler roller assembly 600 and an idler roller 610'.

The spring cleat 630 may have a handle portion 630*g* which a person may grasp between a thumb and finger to facilitate the person in holding, moving, and inserting and removing the spring cleat into and out of the aperture 634. The spring cleat 630 has a cleat spring post 638 about which a first end of a coil spring 640 may abut and be constrained by the spring post 638. A second end of the coil spring 640 engages about a spring post 614 located near an end 605*a*, 605*b* of an idler roller beam 605. According to some embodiments, the second end of the coil spring 640 is coupled to the idler roller beam 605 so that it remains attached to the idler roller beam 605 during the installation or removal of the idler roller beam 605 to or from the banknote processing device. According to some such embodiments, the first end of the coil spring 640 is not coupled to the spring post 638 or the spring cleat 630. Alternatively, according to some embodiments, the first end of the coil spring 640 is coupled to the spring cleat 630 such as by spring post 638 so that it remains attached to the spring cleat 630 during the installation or removal of an idler roller beam 605 to or from the banknote processing device. According to some such alternative embodiments, the second end of the coil spring 640 is not coupled to the spring post 614 or the idler roller beam 605.

The spring cleat 630 has an exterior portion 630*w* designed to fit through a spring cleat aperture 634 in a side plate 206*rt*, 206*lt* and a larger surface 630*a* that does not fit through the aperture 634 and that abuts an inside surface of the side plate 206*rt*, 206*lt* when the spring cleat 630 is in an operational position. In FIG. 6I, three cleats 630 are shown in their operational position with exterior portion 630*w* of two of the cleats 630 illustrated on the outside of one of the side plates 206*rt*, 206*lt*. According to some embodiments, the apertures 634 are defined by a T-shaped edge 207 of the side plate 206*rt*, 206*lt*. The edge 207 (and corresponding opening 634 defined thereby) has a longitudinal length extending from a first end 207*a* to a second end 207*b* with the associated T-shape of the aperture 634 having a long, narrower portion 634*w*1 extending from the first end 207*a* associated with the bottom of the T-shape and a transverse, wider portion 634*w*2 associated with the top of the T-shape near end 207*b*. Likewise, the exterior portion 630*w* of the spring cleat 620 may have a corresponding T-shape having a longitudinal length extending from a first end 630*wa* to a second end 630*wb* with the associated T-shape having a long, narrower portion 630*w*1 extending from the first end 630*wa* associated with the bottom of the T-shape and a transverse, wider portion 630*w*2 associated with the top of the T-shape near end 630*wb*.

To install a spring cleat 630 into its operational position, the exterior portion 630*w* is inserted through an aperture 634 in one of the side plates 206*rt*, 206*lt* with the proper orientation (e.g., with narrow portion 630*w*1 positioned near the narrow portion of the aperture 634*w*1 and wider portion 630*w*2 positioned near the wider portion of the aperture 634*w*2. A spring 640 biases the spring cleat 630 toward the first end 207*a* of edge 207 until one or more inside hook surfaces 630*b* abut portions 207*t* of edge 207 (in direction 6H-A1 in FIG. 6H). The spring 640 then maintains the spring cleat 630 so that inside hook surfaces 630*b* abut portions 207*t*. The exterior portion 630*w* has one or more inside surfaces 630*w*3 which engage with corners 207*t*1 and/or portions 207*t* of edge 207 to prevent the exterior portion 630*w* of the spring cleat 630 from moving back through the aperture 634 in direction 6G-A1 in FIG. 6G. Accordingly, the spring cleat 630 has a hook portion 630*h* formed by surfaces 630*b* and 630*w*3 to engage side wall or side plate 206*rt*, 206*lt* and keep the spring cleat 630 from moving back through the aperture 634 when in an operational position and the spring 640 maintains the spring cleat 630 in its operational position.

The process of removing an idler roller beam 605 will now be described. After opening a bottom panel 602 (see FIGS. 1G & 6A) and/or a rear panel 604 (see FIGS. 1C & 6B), a person may gain access to the area below the idler roller beams 605 and the spring cleats 630 associated therewith. With reference to FIG. 6C, a first spring cleat 630 associated with a beam 605 is released from a side plate 206*rt*, 206*lt* by moving the spring cleat 630 toward the associated idler roller beam 605 (upward as shown by arrow 6C-A1 in FIG. 6C; in the direction opposite of arrow 6H-A1 in FIG. 6H; in the direction of arrow 6I-A1 in FIG. 6I) by manually overcoming the bias of spring 640 and then pulling the exterior portion 630*w* of the cleat 630 through aperture 634. The first spring cleat 630 may then be set aside. According to some embodiments, wherein the spring 640 is not coupled to either the beam 605 or the cleat 630, the associated spring 640 is also set aside. This process is repeated for the second spring cleat 630 and/or spring 640 associated with the beam 605. The beam 605 and the idler rollers 610 thereon may then be moved away from the lower transport plate 570 and removed from the banknote processing device 10 (see, e.g., arrow 6I-A2 in FIG. 6I).

The idler rollers 610 may then be manually pulled off respective idler roller mounting posts or axles 612 of the beam 605. New idler rollers may then be manually pushed onto the respective idler roller mounting posts or axles 612 of the beam 605.

The idler roller beam 605 and/or springs 640 may be reinstalled in the banknote processing device 10 and/or a new idler roller beam 605 and/or new springs 640 may be installed in the banknote processing device 10.

The process of installing an idler roller beam 605 into banknote processing device 10 will now be described. The beam 605 to be installed and the idler rollers 610 thereon are moved toward the lower transport plate 570 and the idler rollers 610 are aligned with idler roller apertures 570*ap* in the lower transport plate 570 (see FIG. 6B). If one end of a spring 640 is coupled to an end of the beam 605 about one of the spring posts 614, the other end of the spring is positioned about spring post 638 of a first spring cleat 630 and the first spring cleat is releasably coupled to or hooked on one of the side plates 206*rt*, 206*lt* by inserting the exterior portion 630*w* through a corresponding spring cleat retaining aperture or slot 634 and moving and/or allowing the spring 640 to move the first cleat 630 to its operational position. If one end of a spring 640 is not coupled to an end of the beam 605 about one of the spring posts 614, one end of the spring is positioned about spring post 638 of the first spring cleat 630 and the other end of the spring is positioned about one of the spring posts 614 of the beam 605 and then the cleat 630 is releasably coupled to one of the side plates 206*rt*, 206*lt* via a retaining aperture 634. If one end of a spring 640 is coupled to spring post 638 of a first spring cleat 630, the other end of the spring is positioned about one of the spring posts 614 on the beam 605 and the spring cleat is releasably coupled to one of the side plates 206*rt*, 206*lt* by inserting the exterior portion 630*w* through a corresponding spring cleat retaining aperture or slot 634 and moving and/or allowing the spring 640 to move the first cleat 630 to its operational position. This process is then repeated to releasably couple a second spring cleat 630 to an opposing one of the side plates 206*rt*, 206*lt* to thereby support a second end of the beam 605 with a spring 640 between a second post 614 on the beam 605 and post 638 on the second cleat 630. Any opened bottom panel 602 (see FIGS. 1G & 6A) and/or rear panel 604 (see FIGS. 1C & 6B) may then be closed.

The spring-loaded idler rollers 610 are used opposite the driven rollers (drive or drum roll 275, downstream driven rolls 298) to provide pressure to press banknotes or documents to be transported against corresponding driven rollers. According to some embodiments, the above spring cleat/beam design makes it easy to install and remove idler rollers 610 from an associated idler roller beam 605 and to install and remove idler or passive roller assemblies 600 from a banknote processing device such as banknote processing device 10. According to some embodiments, the above design includes spring cleats 630 that individually releasably mount onto the side plates 206*rt*, 206*lt* without the use of any screws, tools, or hardware.

FIG. 6J1 is an enlarged perspective view of a spring post 614 of an idler roller beam 605 and a spring post 638 of a spring cleat 630. FIG. 6J2 is an enlarged perspective view of a coil spring 640. According so some embodiments, the spring posts 638 are dimensioned to hold a spring 640 thereon when the spring cleat 640 is removed from a side plate 206*rt*, 206*lt*. For example, a spring post 638 may be dimensioned to be slightly larger than the interior circumference or diameter of a circular end of a coil spring 640 such that the spring is frictionally coupled to the post 638. According to some embodiments, the dimension of the post 638 and the interior circumference or diameter of a circular end of a coil spring 640 may be set so that the spring is releasably coupled to the post 638 and may be manually coupled to and removed from the post. According to some such embodiments, the other end of an associated spring 640 is not coupled to a post 614 of a beam 605 but is merely configured to abut and be constrained by the post 614 such as being laterally constrained (laterally being in a direction orthogonal to the axis of spring compression between the two ends of the coil spring).

With reference to FIG. 6J1, according to some embodiments, spring post 614 has a base portion 614*b* which is the widest part of spring post 614. According to some embodiments, the base portion 614*b* has a width 614*d* slightly less than the inside diameter 640*d* of the spring 640. According to some embodiments, spring post 638 of a spring cleat 630 has a base portion 638*b* and a rim portion 638*r* located distal of the base portion 638*b*. When in its operational position, the spring 640 has one end nested about the narrower base potion 638*b* and constrained and held in its operational position by the wider rim portion 638*r*. According to some embodiments, the rim portion 638*r* has a width 638*d*2 slightly larger than the inside diameter 640*d* of the spring 640 whereas the base portion 638*b* has a width 638*d*1 which may be slightly less than the inside diameter 640*d* of the spring 640. The rim portion 638*r* thus holds the spring 640 in its operational position and inhibits the end of the spring 640 positioned about the base portion 638*b* from moving in the direction of arrow 6J1-A1 in FIG. 6J1. In some embodiments, the width 638*d*2 of rim portion 638*r* is set to constrain an end of the spring 640 from moving out of a position about base portion 638*b* but narrow enough to allow a person to manually pull, push, and/or twist the end of the spring over rim portion 638*r* in order to remove the spring 640 from the cleat 630 and allow a person to manually pull, push, and/or twist the end of the spring over rim portion 638*r* in order to install a spring 640 onto the cleat 630 about base portion 638*b*.

According to some embodiments, the spring cleats 630 support associated springs 640 which apply spring pressure to the axles of associated idler rollers 610.

Some of the advantages of various embodiments of the above described designs include one or more of the following: (1) providing idler or passive roller assemblies 600 that are very easy to assemble and disassemble without tools during production and/or field service and/or to install into and/or to remove from a banknote processing device without tools during production and/or field service; (2) providing a very low-cost solution for providing the idler roll spring pressure used to transport documents through a banknote processing device; and/or (3) transferring idler roller spring pressure from a transport plate such as lower transport plate 570 (which in some embodiments may be made of plastic) to side walls or plates 206*rt,* 206*lt* (which in some embodiments may be made of metal such as steel) which can in some embodiments prevent or reduce any undue stress being applied to an associated transport plate 570. For example, with reference to FIGS. 23 and 24 of U.S. Pat. No. 5,815,592, in a prior banknote processing device, a pair of H-shaped leaf springs 252 and 253 were mounted to a lower transport plate and used to bias passive or idler rolls 250 and 251 into contact with driven rollers on the opposite side of the transport path. With such arrangements wherein the leaf springs are supported by a plastic lower transport plate, the constant pressure applied by the leaf springs that is used to provide a tight grip between the passive rolls and the opposing driven rollers can cause the plastic transport plate to bow and become deformed. According to some embodiments of the present disclosure, by transferring the support/force of the springs 640 from the lower transport plate 570 to the side plates 206*lt,* 206*rt,* spring pressure which might otherwise cause the transport plate 570 to become bowed or deformed is eliminated or reduced. According to some embodiments, by transferring the idler spring pressure to the side walls 206*rt,* 206*lt* rather than the transport plate 570, both elastic and long-term creep deflection of a plastic transport plate 570 is avoided. According to some embodiments, deflection of the transport plate 570 may affect the performance of the denominating, imaging, and/or other gap-sensitive sensors as well as cause poor feeding or jamming of the banknotes.

Figure 2B:
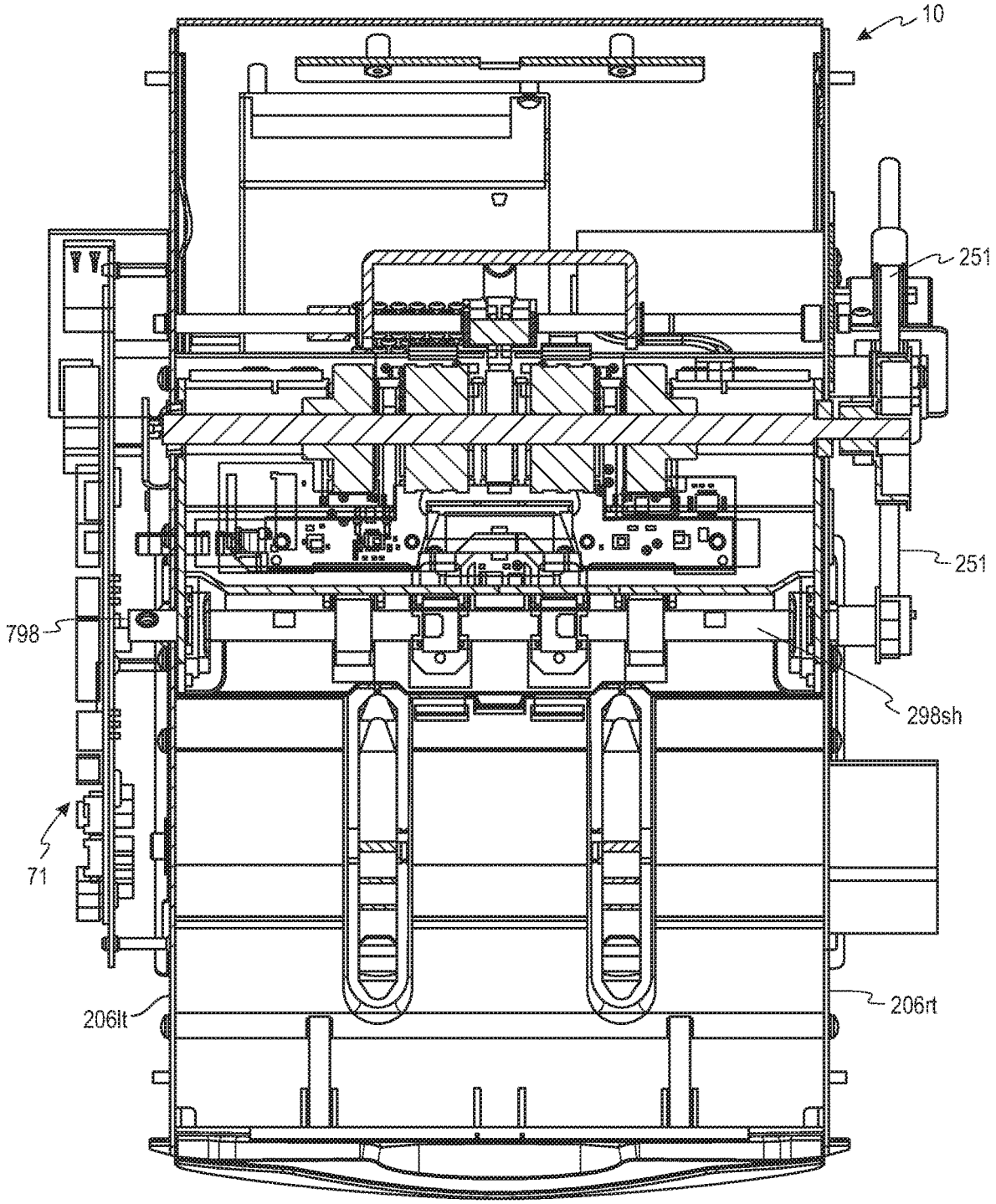
FIG. 2B is a top view of some components of the banknote processing device of FIG. 1A.
Figure 2C:
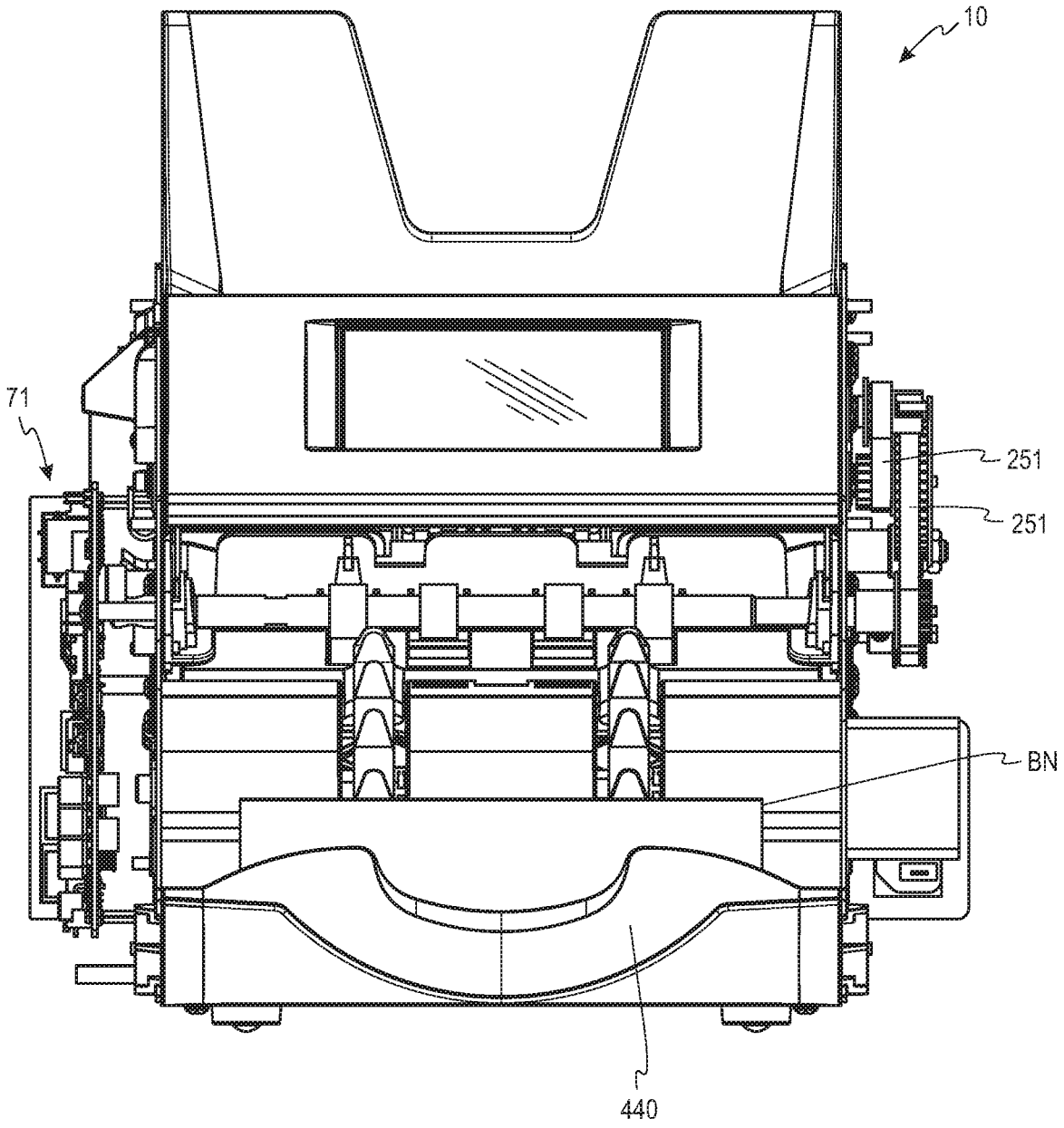
FIG. 2C is a front view of some components of the banknote processing device of FIG. 1A.
Figure 2D:
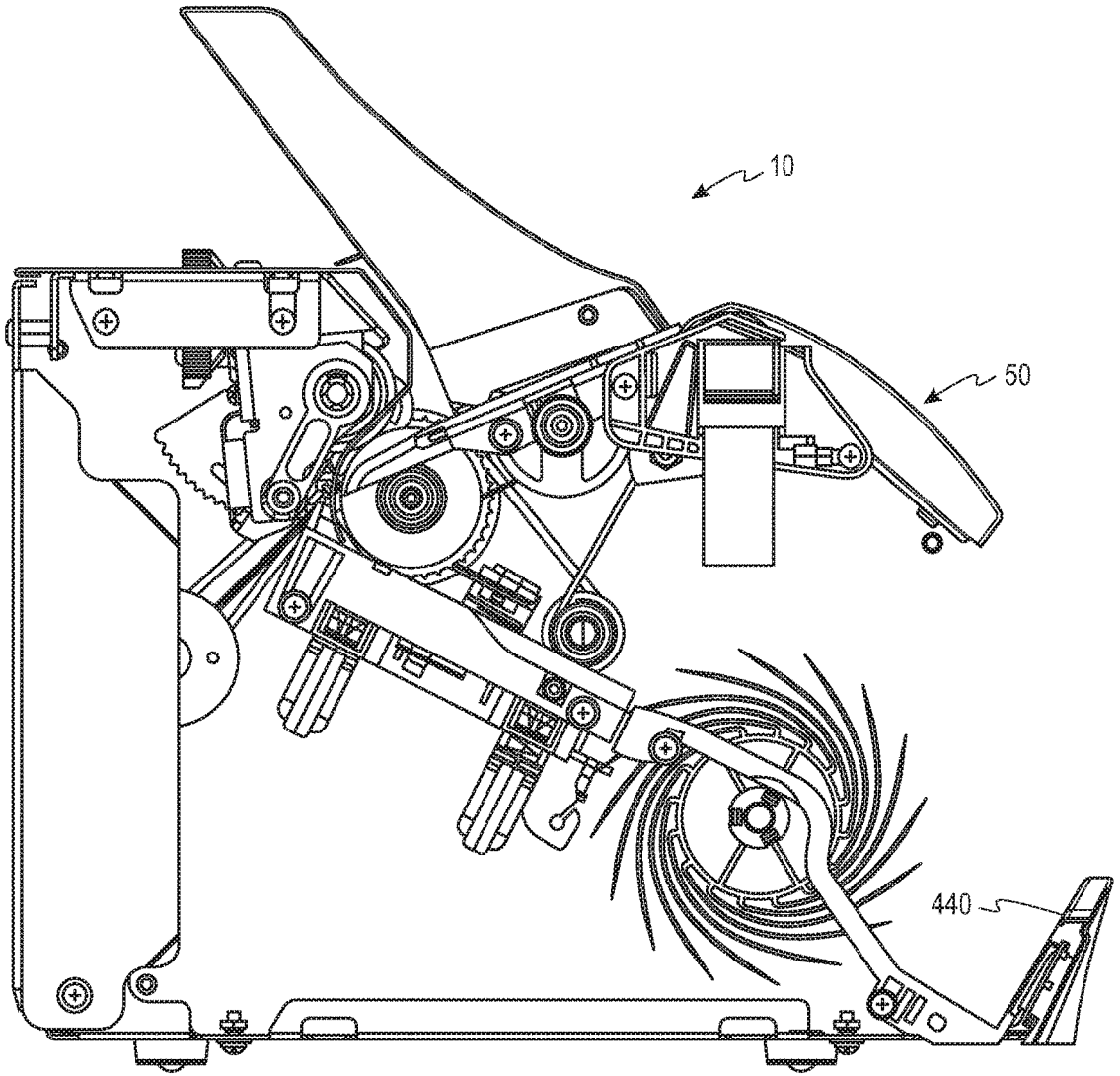
FIG. 2D is a side view of some components of the banknote processing device of FIG. 1A.
Figure 2E:
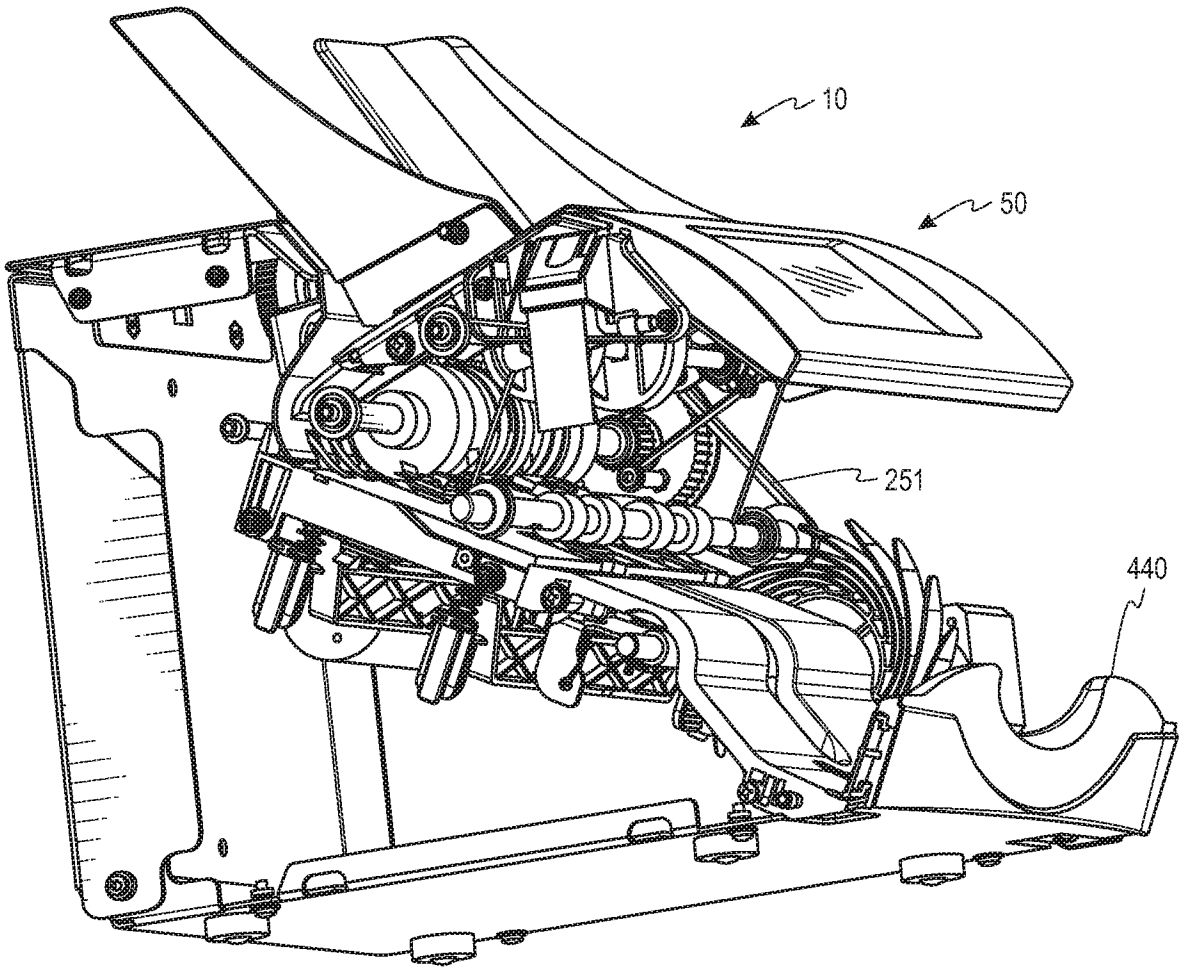
FIG. 2E is a side perspective view of some components of the banknote processing device of FIG. 1A.
Figure 7A:
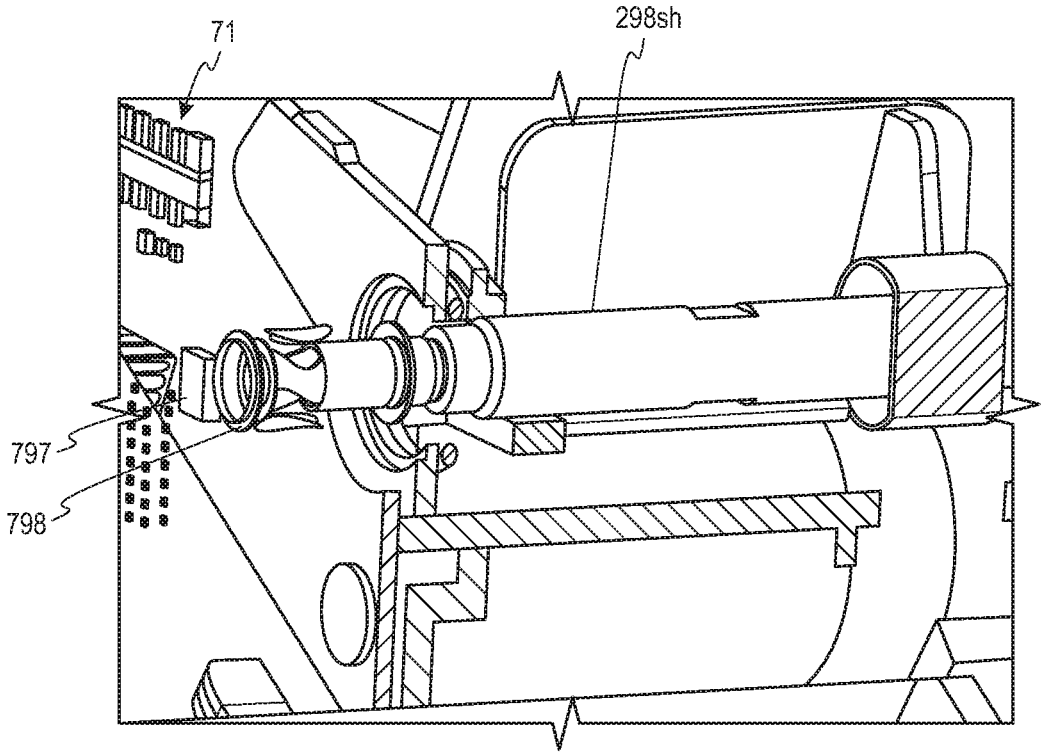
FIG. 7A is a perspective view of some components of a banknote processing device according to some embodiments illustrating a magnetic encoder.
Figure 7B:
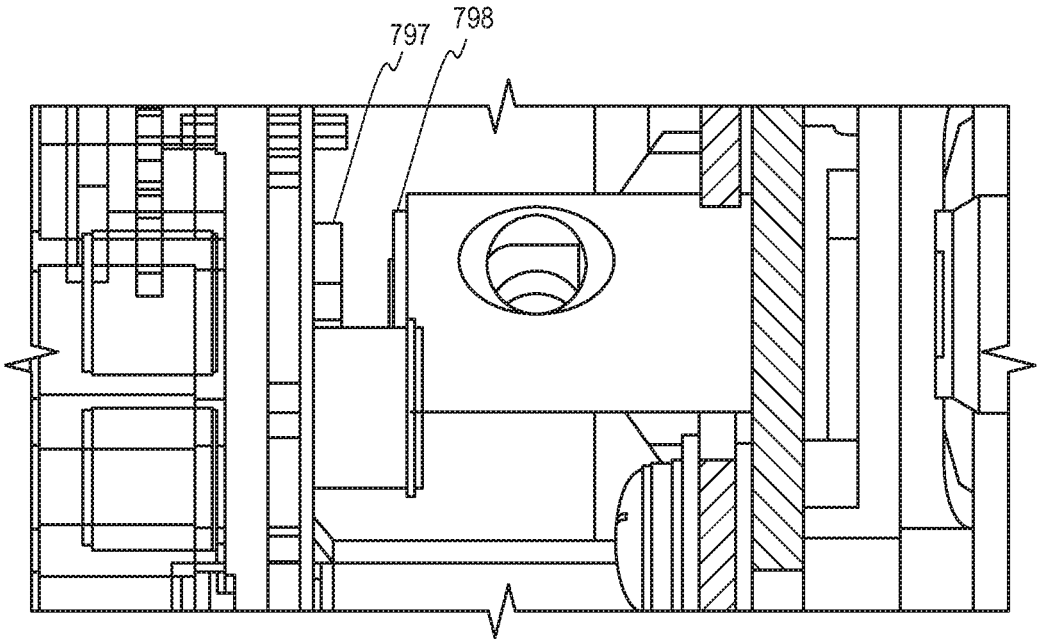
FIG. 7B is an enlarged view of a portion of FIG. 2B illustrating a magnetic encoder adjacent a magnet on the end of a driven roller shaft.

According to some embodiments, a banknote processing device such as banknote processing device 10 employs a magnetic encoder to monitor the movement of the transport mechanism. FIG. 7A is a perspective view of some components of a banknote processing device according to some embodiments illustrating a magnetic encoder 797. FIG. 7B is an enlarged view of a portion of FIG. 2B illustrating a magnetic encoder 797 adjacent a magnet 798 on the end of a driven roller shaft 298*sh*. Referring to FIGS. 2B, 2F, 7A and 7B, according to some embodiments, a magnet 798 is coupled to the end of one of the driven roller shafts such as downstream driven roll shaft 298*sh* which serves as an encoder shaft and is positioned adjacent to a magnetic encoder 797 which according to some embodiments is located on a printed circuit board 70. As the encoder shaft 298*sh* with the magnet 798 spins, the encoder 797 reads the rotating magnetic field and determines the angular position of the shaft.

Use of the magnetic encoder has an advantage in that a physical connection is not required between the magnetic encoder 797 and the shaft it is monitoring. According to some embodiments, a magnetic encoder is used to provide the system information about the position of a shaft. According to some embodiments, the implementation of the magnetic encoder does not require a physical connection of the encoder to a spinning shaft driving by a motor. Conversely, an optical encoder requires a physical connection to the spinning shaft to be monitored. Magnetic encoders are more tolerant of dust and lower cost than optical encoders. According to some embodiments, magnetic encoder 797 is an off-the-shelf magnetic encoder and is located on the back side of a printed circuit board 70 that may contain a main processor or CPU. According to some embodiments, the magnetic encoder 797 is an Infineon #TLE5012B magnetic encoder.

Figure 2F:
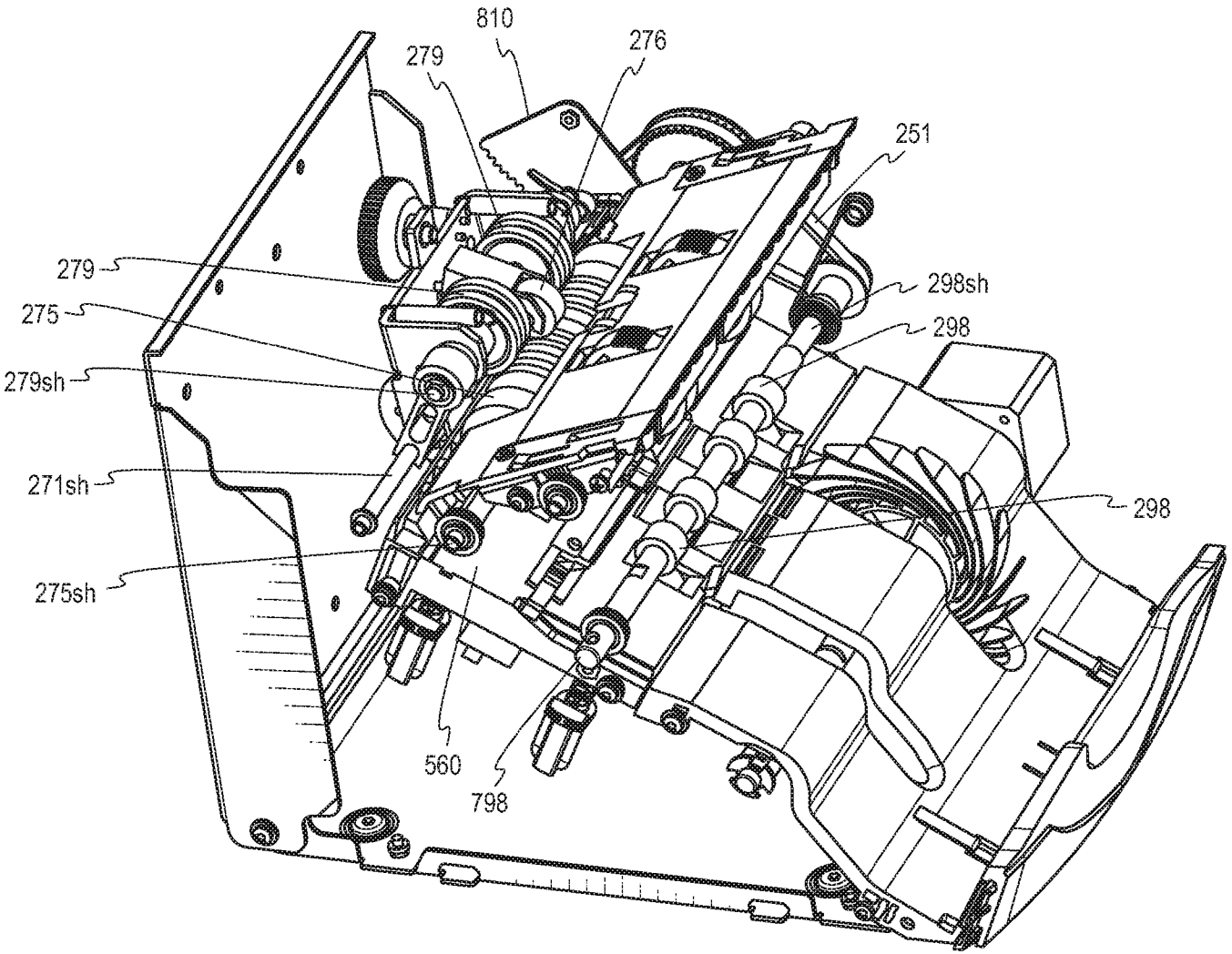
FIG. 2F is a downward perspective view of some components of the banknote processing device of FIG. 1A.
Figure 2G:
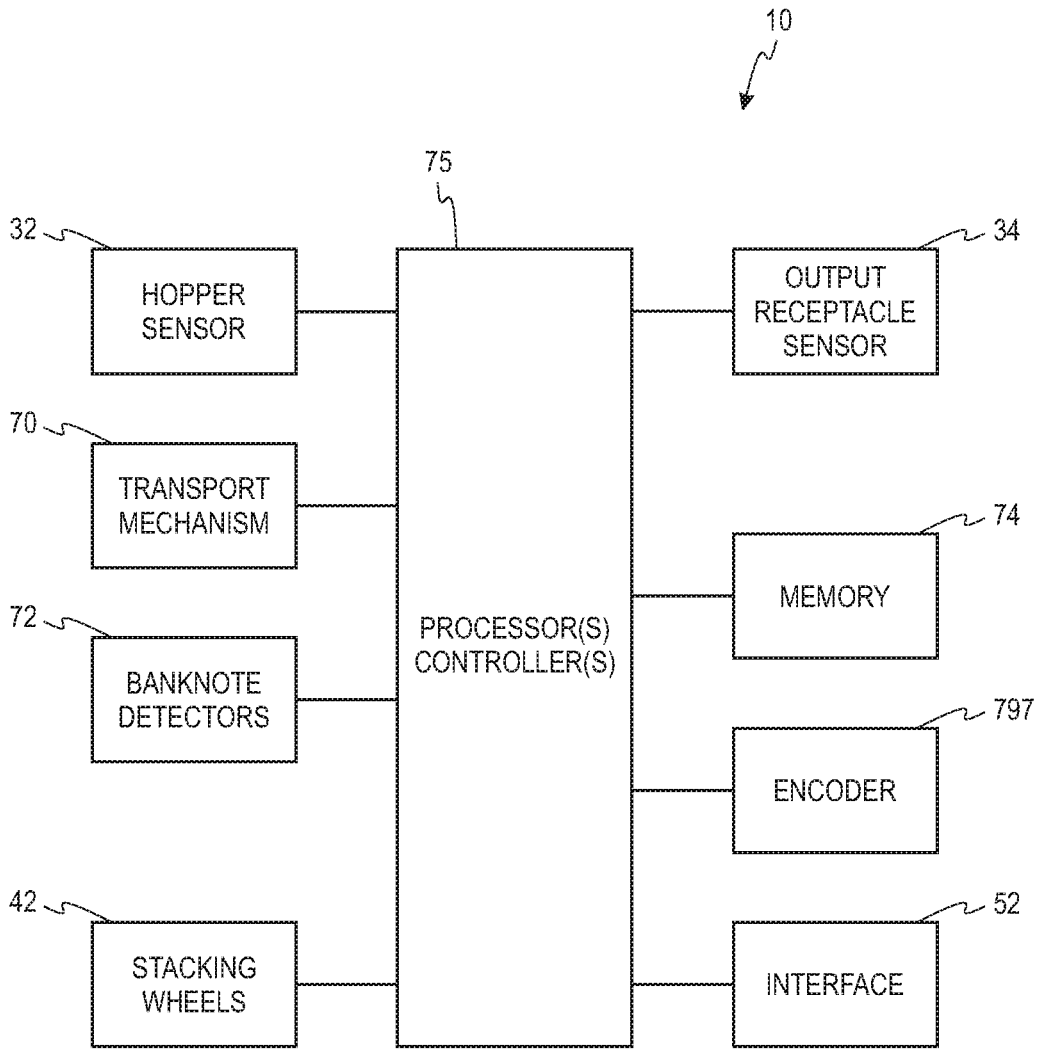
FIG. 2G is a block diagram of some components of the banknote processing device 10 according to some embodiments.
Figure 8A:
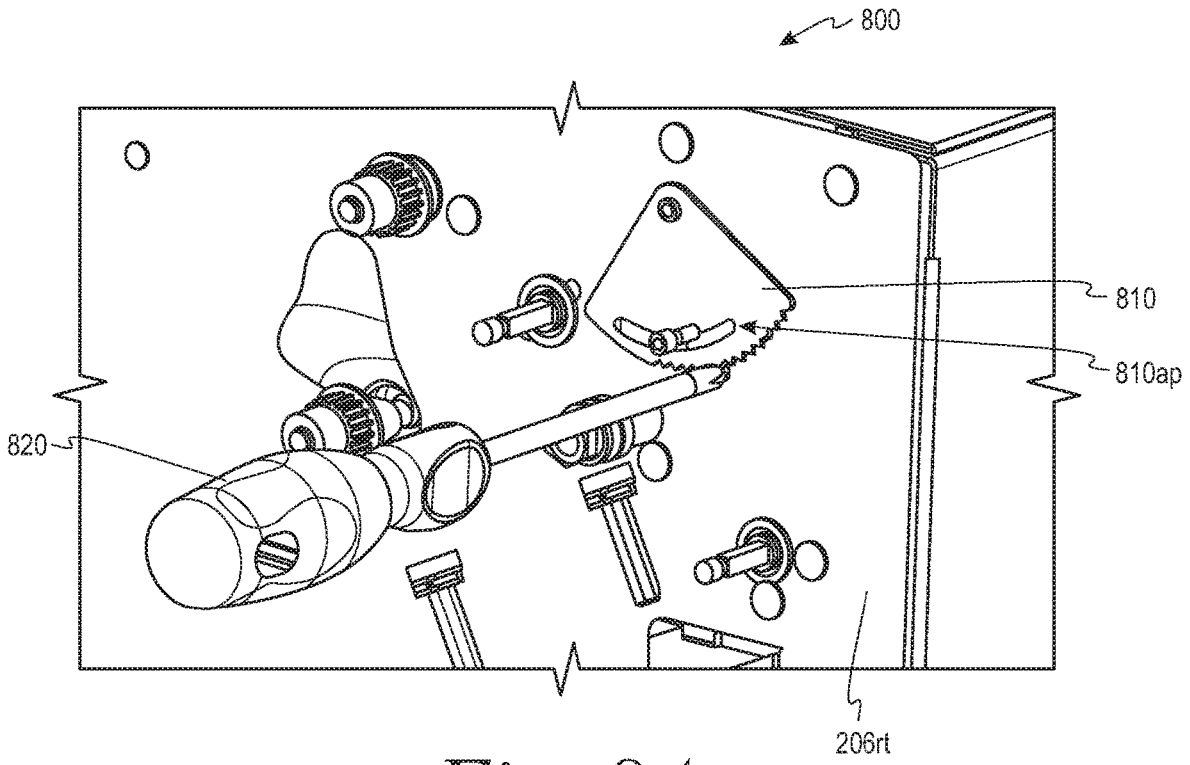
FIG. 8A is a perspective view of some components of a banknote processing device according to some embodiments illustrating a shaft adjustment mechanism.
Figure 8B:
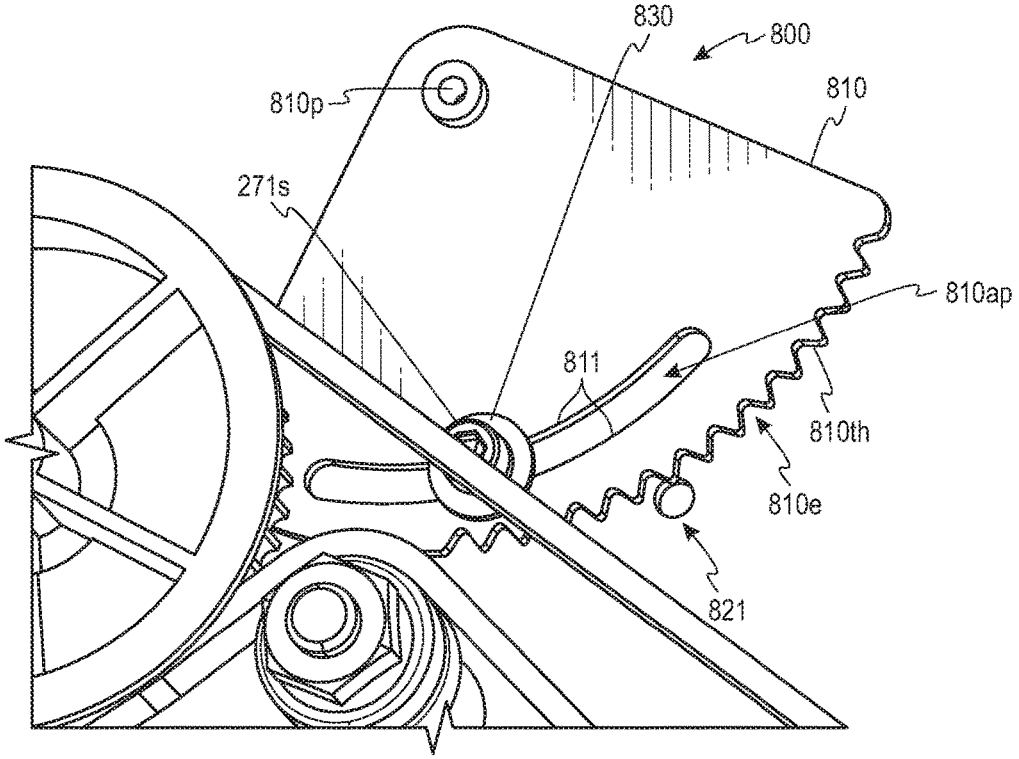
FIG. 8B is a perspective view of a shaft adjustment mechanism according to some embodiments.
Figure 8C:
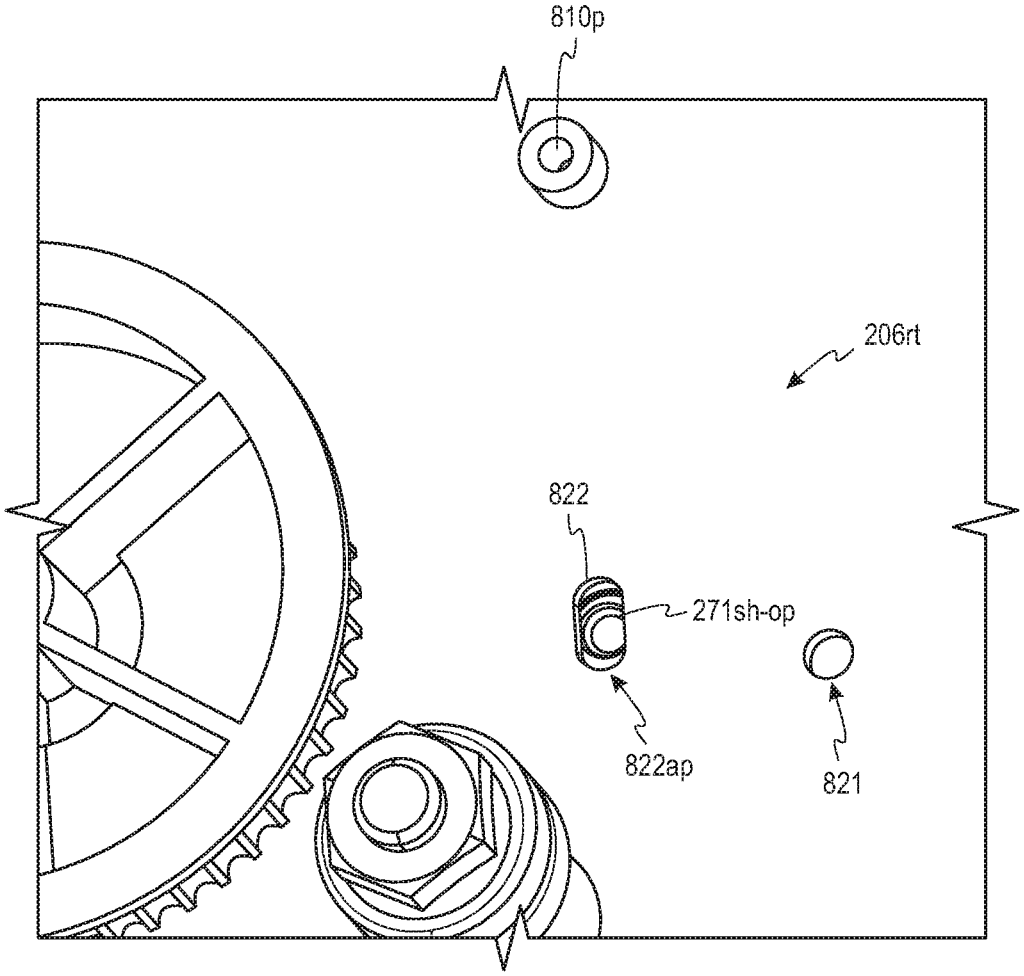
FIG. 8C is a perspective view of that shown in FIG. 8B with the adjustment plate removed.

FIG. 8A is a perspective view of some components of a banknote processing device according to some embodiments illustrating a shaft adjustment mechanism 800. FIG. 8B is a perspective view of a shaft adjustment mechanism 800. FIG. 8C is a perspective view of that shown in FIG. 8B with the adjustment plate 810 removed. With reference to FIGS. 2F, 8A, and 8B, shaft adjustment mechanism 800 comprises an adjustment plate 810 pivotally mounted about axis 810*p* to one of the side walls or plates 206*rt,* 206*lt.* The adjustment plate 810 also comprises an arc-shaped aperture 810*ap* defined by an arc-shaped edge 811. The arc-shaped aperture and edge 811 are slightly non-concentric with respect to axis 810*p*. The adjustment plate 810 has an arc-shaped edge 810e which is concentric with respect to axis 810*p*. The arc-shaped edge 810*e* has a plurality of teeth 810$^{th}$ which collectively comprise a rack. A shaft hold-down screw 271*s* is threadingly screwed into an opening 271*sh-op* in a first end of a shaft to be adjusted by the shaft adjustment mechanism 800 (such as retard roller shaft 271*sh* (see FIG. 2F)). A washer 830 may be positioned between a head of hold-down screw 271*s* and an outside surface of adjustment plate. A second end of the shaft to be adjusted by the shaft adjustment mechanism 800 (such as retard roller shaft 271*sh* (see FIG. 2F)) is coupled to a second, opposing one of the side walls or plates 206*rt,* 206*lt.* According to some embodiments, the movement of the shaft hold-down screw 271*s* is constrained to vertical movement within a vertical slot or aperture 822*ap* in the side plate 206*rt* defined by edge 822 and is also constrained by the position of adjustment plate 810 via edges 811 therein.

To adjust the position of the first end of the shaft 271*sh,* the hold-down screw is loosened and an end of an adjustment tool 820 is inserted into an adjustment tool receiving aperture 821 in the side plate 206*rt.* According to some embodiment, the tool 820 has a plurality of teeth thereon and may be a cross-recessed head screwdriver or equivalent (e.g., Torx driver, phillips head screwdriver) that would allow a rack and pinion type of mesh between the adjustment plate teeth 810$^{th}$ and the teeth on the end of the tool 820. While turning the adjustment tool 820, the rotation of the adjustment plate 810 causes the arc opening 810*p* and edge 811 to move which in turn vertically moves the end of the shaft 271*sh* allowing a service technician to easily and accurately adjust position of the shaft. By rotating the adjustment tool 820, the eccentric arc of edge 811 vertically moves the hold down screw 271*s* in vertical slot 822*ap.* Once the end of the shaft is in a desired position, the hold-down screw 271*s* is tightened so the end of the shaft 271*sh* no longer moves.

According to some embodiments, to ensure the proper feeding of banknotes or documents along a transport path, it can be important that shafts on which transport rollers are mounted (or which indirectly determined the position of such transport rollers) which are adjacent to each other on opposite sides of a transport path and in between which documents to be transported pass are parallel to each other. Turning to FIG. 2F, to enhance feeding of banknotes, it may be desirable that retard roller shaft 271*sh* is parallel to drive or drum roll shaft 275*sh.* However, during operation of a banknote processing device such as device 10, sometimes shafts 271*sh* and 275*sh* move relative to each other such that they are no longer parallel. During a service call, a service technician may need to adjust the positions of the shafts 271*sh* and 275*sh* relative to each other to re-align them so that they become parallel again. However, with current banknote processing devices, this adjustment may be difficult to do and is done manually using feeler gauges, a slot and a hold down screw. Such a process is an iterative process of adjusting the shaft 271*sh,* locking it in place and checking spacing. According to some embodiments, a service technician determines the end of an adjustable shaft is in a desired position by inserting a piece of paper or a banknote or feeler gauge(s) between two or more pairs of rollers on opposite sides of a transport path and at least some of whose positions are determined by the position of the adjustable shaft controlled by the adjustment plate 810. The pairs of rollers are spaced laterally respect to each other in a direction generally orthogonal to the direction of transport. The position of one end of the adjustable shaft is then adjusted until matching or similar tension is exerted by the different pairs of opposing rollers on the object (e.g, banknote, feeler gauge) placed therebetween.

According to some embodiments, use of the shaft adjustment mechanism 800 simplifies the precise setting of two independent assemblies, in this case a drum shaft assembly and the retard bracket assembly 279RA. According to some embodiments, for enhanced accuracy, feeler gauges are used to verify that the gap between the left and right pair of drum rollers 275 and retard rollers 279 are the same.

The shaft adjustment mechanism 800 aids in making the adjustment as to relative parallelism being shafts 271*sh* and 275*sh* much easier. The adjustment plate 810 having a pivot point 810*p* is coupled to the side plate 206*rt* with a corresponding arc (810*ap,* 811) that allows the adjustment plate 810 to be easily and accurately pivoted using adjustment tool 820. The shaft adjustment mechanism 800 thus enables a precise adjustment to the relative positions of shafts 271*s* and 275*sh* such as to set them to be parallel to each other. Furthermore, according to some embodiments, the adjustment mechanism 800 provides a cost-effective means of achieving a precise adjustment between shafts without the shafts moving or slipping relative to each other before the hold-down screw 830 can be tightened.

According to some embodiment, one or more time-of-flight ("ToF") sensors 32, 34 (see, e.g., FIG. 3K) are located in the input hopper 30 to detect for the presence of one or more banknotes therein, in the output receptacle 40 to detect for the presence of one or more banknotes therein, or both. Time-of-Flight (ToF) is a method for measuring the distance between a ToF sensor and an object, based on the time difference between the emission of a signal and its return to the sensor, after being reflected by an object. According to some embodiments, a ToF hopper sensor 32 located in the hopper detects for the presence of one or more banknotes or documents or other objects therein. Likewise, according to some embodiments, a ToF stacker sensor 34 located in the output receptacle 40 detects for the presence of one or more banknotes or documents or other objects therein. According to some embodiments, a time-of-flight sensor is employed in both the both the hopper 30 and the output receptacle 40 and each ToF sensor measures the distance between the sensor and the notes. According to some embodiments, hopper time-of-flight sensors 32 and output receptacle time-of-flight sensor 34 are ST Microelectronics #VL6180X sensors.

According to some embodiments, time-of-flight sensors are more tolerant of dust accumulation than the use of a light source such as a visible light source, a reflective mirror, and a photodetector arrangement hopper and/or output receptacle sensor. According to some embodiments, the use of ToF hopper 32 and/or stacker 34 sensors allows for mounting the sensors on one side of the input hopper 30 and/or on side of the output receptacle 40 such as on the bottom of input hopper 30 and/or in the stacker tray 440 (see, e.g., FIG. 1F, 2A, and 3K) without the use of reflected mirrors or receiving sensors, making it simpler and less costly to mount the sensors in the banknote processing device 10. For example, the use of a hopper and/or output receptacle time-of-flight sensor reduces the number of parts needed such as by eliminating the need for a specialized reflector in each of the hopper 30 and the output receptacle 40 or a separate transmitter and receiver located on opposite sides of hopper 30 and/or output receptacle 40. According to some embodiments, the time-of-flight sensor(s) operate using light at a wavelength that reduces the chances of ambient light interference and/or the time-of-flight sensor(s) is(are) capable of detecting transparent areas of some banknote designs that may not be detector by traditional optical detectors.

According to some embodiments, a hopper time-of-flight sensor detects the presence/absence of notes in the hopper 30 and likewise the output receptacle time-of-flight sensor detects the presence/absence of notes in the output receptacle 40. The hopper and output receptacle time-of-flight sensors are communicatively coupled to one or more processors 75 which in turn use the received signals reflecting information about the presence or absence of banknotes in the hopper 30 and/or output receptacle 40 to control the operation of the banknote processing device 10 such as automatically starting or stopping the transport mechanism motor(s) and/or the stacker wheel motor thereby allowing the device 10 to auto start and stop.

According to some embodiments, one or more light sources positioned in or adjacent to the output receptacle 40 may illuminate the output receptacle 40 with a plurality of different colors and/or a plurality of intensities or modulation patterns, e.g., flashing. A processor 75 communicatively coupled to the light source(s) controls which color of light is used to illuminate the output receptacle 40 and/or whether and how the light source(s) should flash or modulate in intensity. The processor 75 may cause the output receptacle 40 to be illuminated with different colors based on the occurrence of different stopping or error conditions and/or control whether the light source(s) flash or modulate in intensity based on the occurrence of different stopping or error conditions. According to some embodiments, the differing colors of light or lighting conditions may be used as a way for the device 10 to communicate to an operator about the occurrence of different stopping or error conditions and/or the action that is required to be taken by the operator. For example, flashing the pocket light and/or illuminating the pocket with alternating colors may be used to draw focused attention to unusual or simultaneous conditions. According to some embodiments, the entire output receptacle or pocket 40 may be flooded with light upon the occurrence of a given condition such as a given error condition. Flooding the pocket 40 with light may be accomplished by illuminating more light sources positioned in or adjacent to the output receptacle 40 and/or increasing the intensity of one or more light sources.

For example, upon the detection of a no call banknote, the pocket light source(s) may illuminate yellow indicating that action needs to be taken by an operator such as making a decision about whether to add the value of the no call banknote to the total being maintained in the memory of the device 10 for a stack of banknotes being processed. As another example, upon the detection of a hard error such as a double detection error, the pocket light source(s) may be red indicating that all notes must be removed from the output receptacle or pocket 40. According to some embodiments, the processor 75 controls the user interface 52 such as a display or touch screen to cause a message to be displayed while the special pocket light illumination is occurring explaining the nature of the stopping or error condition and/or indicating what action should be taken by the operator. After a short time period, the operator may learn the nature of stopping or error condition and what action is expected of them simply by relying upon the pocket lighting indications without the continued need to read messages and/or instructions be displayed on the user interface 52 and/or the minimizing the times the operator needs to consult the display of the user interface 52, thereby leading to improvement in the efficiency in which an operator is able to process banknotes using device 10.

Figure 1E:
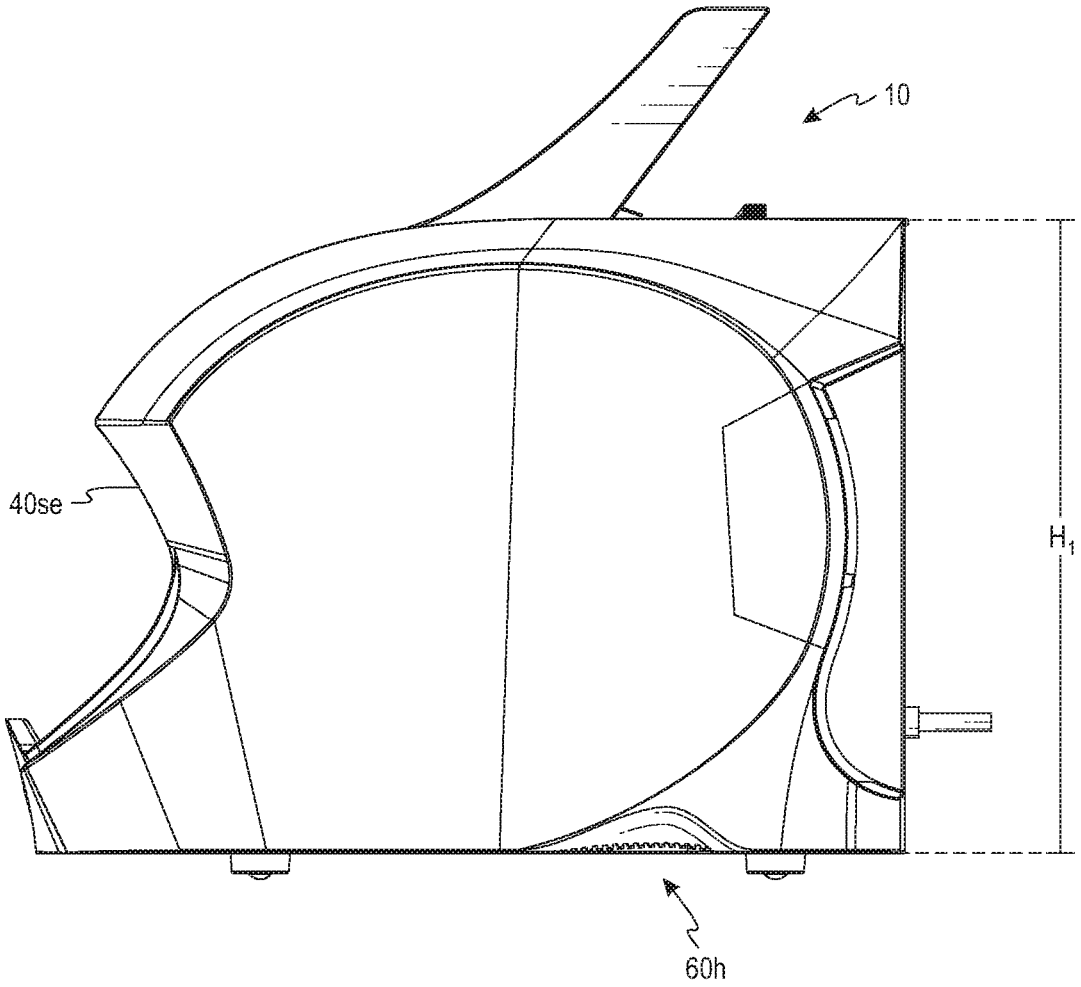
FIG. 1E is a right side view of the banknote processing device of FIG. 1A.
Figure 1F:
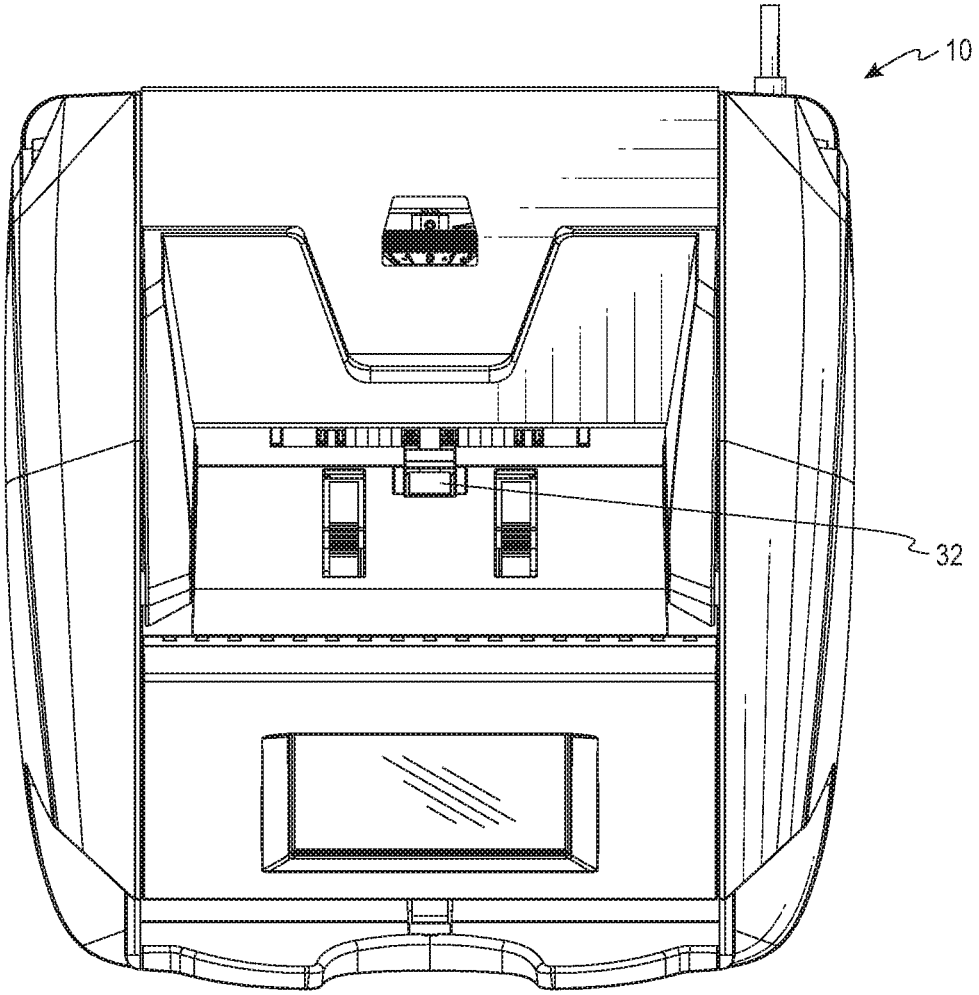
FIG. 1F is a top view of the banknote processing device of FIG. 1A.
Figure 1G:
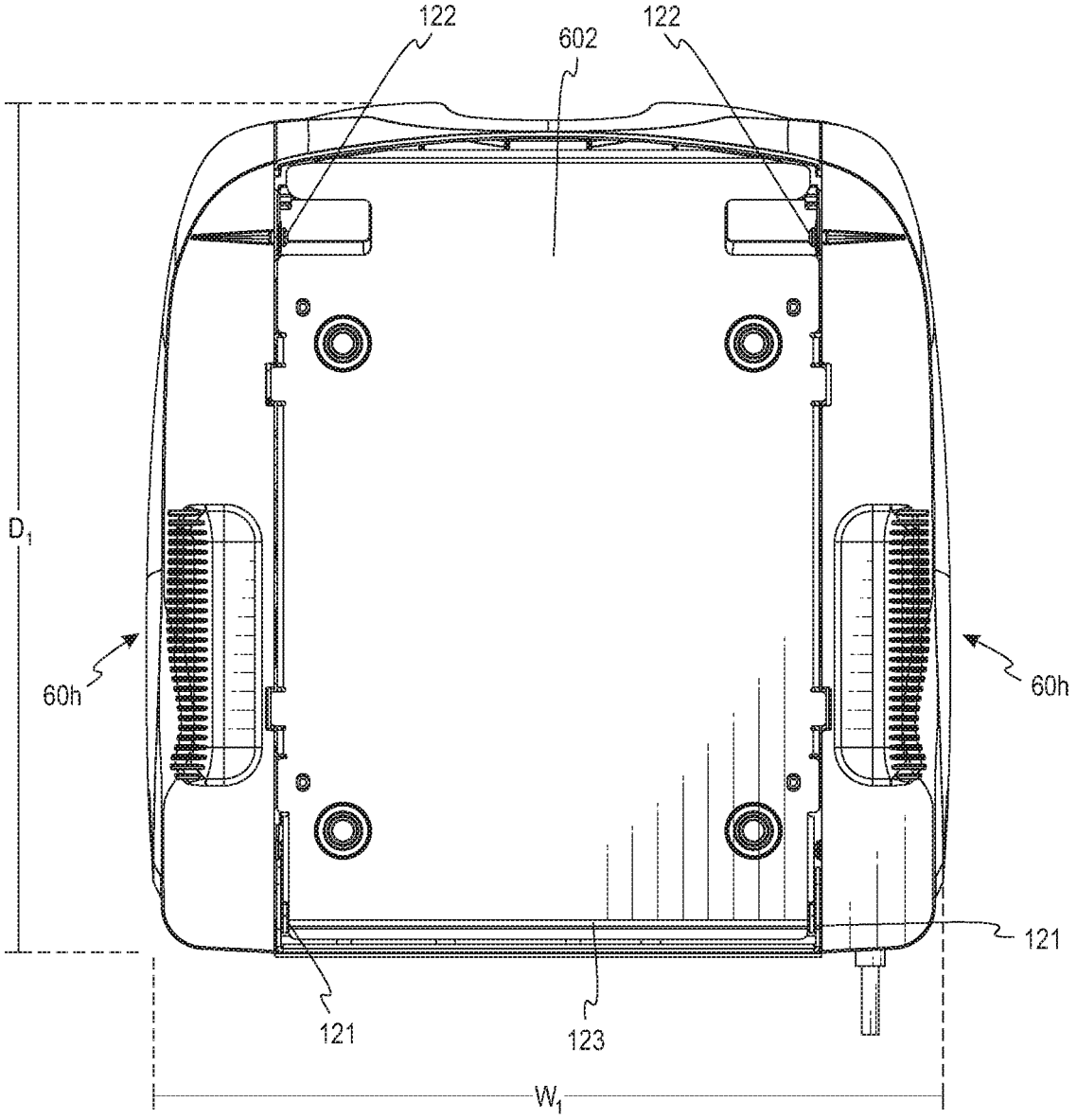
FIG. 1G is a bottom side view of the banknote processing device of FIG. 1A.

With reference to FIGS. 1D, 1E, and 1G, according to some embodiments, the banknote processing device 10 comprises a handle 60*h* located at the bottom of each of the left and right sides of the device 10. The curve of the side cover 60*rt*, 60*lt* in the vicinity of the handles 60*h* guides a person such as an operator to slide the fingers of a hand under the bottom of each side of the device 10 in the area of handles 60*h* and then using two hands easily pick up the device 10 and move it if desired. According to some embodiments, the handles are formed in the side covers 60*rt*, 60*lt*. According to some embodiments, the side covers are made of plastic. As shown, the handles 60*h* positioned at the bottom of each of the side covers 60*rt*, 60*lt* and close to the two side walls or plates 206*rt*, 206*lt*.

Figure 9A:
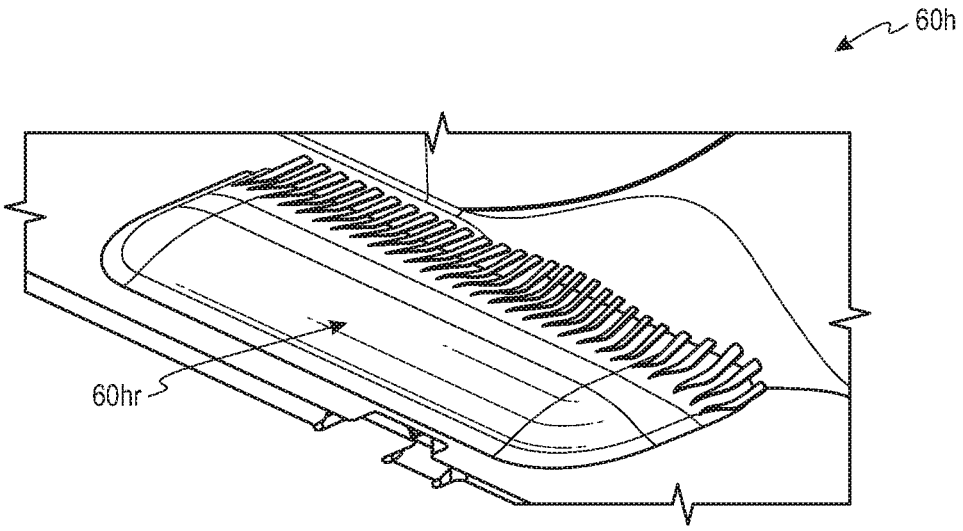
FIG. 9A is an upward bottom perspective view of a handle according to some embodiments.
Figure 9B:
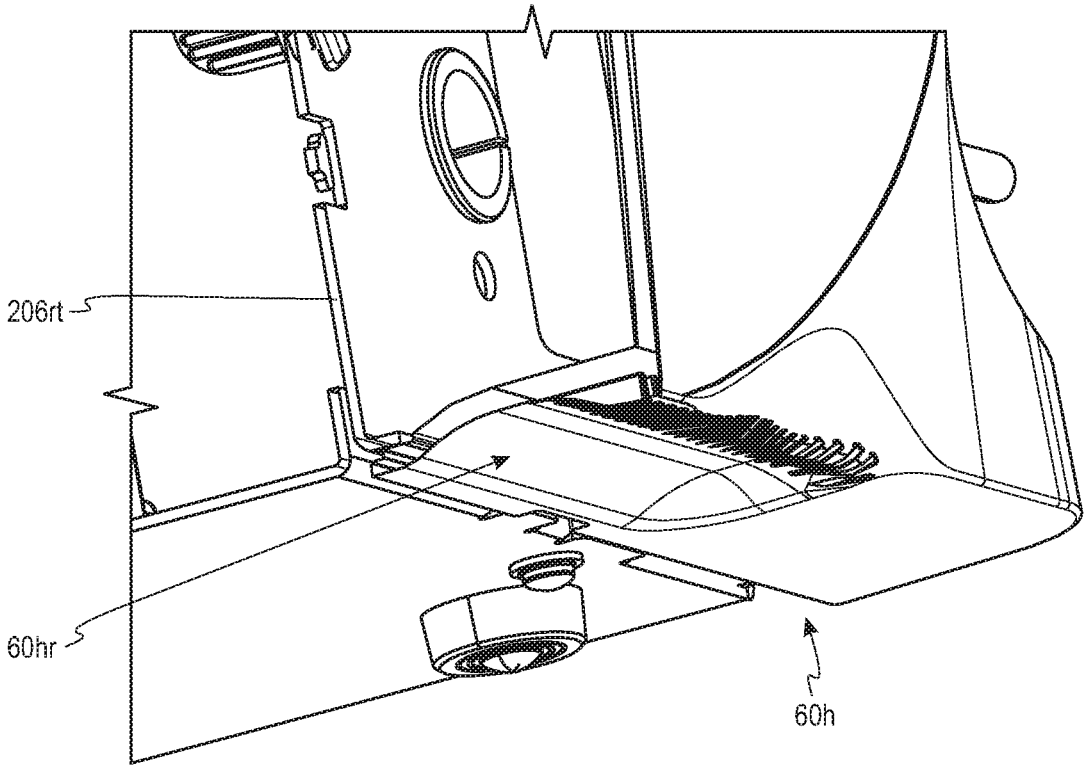
FIG. 9B is an upward cross-sectional bottom perspective view of a handle according to some embodiments.

FIG. 9A is an upward bottom perspective view of a handle 60*h*. FIG. 9B is an upward cross-sectional bottom perspective view of a handle 60*h*. According to some embodiments, the handles 60*h* have an upwardly recessed area 60*hr* configured to accommodate the finger tips of a person holding banknote processing device 10. In FIG. 9B, it can be seen that the handle 60*h* and particularly the recessed area 60*hr* are located close to side plate 206*rt*. The bottom location of the handles 60*h* facilitates the carrying of the banknote processing device 10 by a person and also facilitates the transfer of the load imposed by the weight of the device 10 away from the 60 covers 60*rt*, 60*lt* which may be made of plastic to the side plates 206*rt*, 206*lt* which may be made of metal such as steel. As a result of the transfer of the load to the side plates 206*rt*, 206*lt*, the side covers 60*rt*, 60*lt* may be made of a lighter, less rugged type of plastic.

With reference to FIGS. 1E and 1G, according to some embodiments, a width $W_1$ of the banknote processing device 10 is less than between about 11 inches (28 cm) and about 13 inches (33 cm). According to some embodiments, the width $W_1$ of the banknote processing device 10 is less than or about 11.7 inches (30 cm). According to some embodiments, a depth $D_1$ of the banknote processing device 10 is less than between about 12 inches (30 cm) and about 14 inches (36 cm). According to some embodiments, the depth $D_1$ of the banknote processing device 10 is less than or about 12.4 inches (31 cm). According to some embodiments, a height $H_1$ of the banknote processing device 10 is less than between about 11 inches (28 cm) and about 13 inches (33 cm). According to some embodiments, the height $H_1$ of the banknote processing device 10 is less than or about 12 inches (30 cm).

According to some embodiments, the banknote processing device 10 has a footprint of less than about 1.3 square feet. According to some embodiments, the banknote processing device 10 has a footprint of less than about 1 square feet. According to some embodiments, the banknote processing device 10 has a footprint of less than 1.1 square feet.

According to some embodiments, the banknote processing device 10 occupies less than about 1.4 cubic feet. According to some embodiments, the banknote processing device 10 occupies less than about 1.2 cubic feet. According to some embodiments, the banknote processing device 10 occupies less than about 1 cubic feet. According to some embodiments, the banknote processing device 10 occupies less than about 1.1 cubic feet.

According to some embodiments, the banknote processing device 10 weighs between about 14 pounds (31 kg) and 18 pounds (40 kg). According to some embodiments, the banknote processing device 10 weighs between about 15 pounds (33 kg) and 20 pounds (44 kg). According to some embodiments, the banknote processing device 10 weighs about or less than about 16.5 pounds (36 kg). According to some embodiments, the banknote processing device 10 weighs about or less than about 17 pounds (38 kg). According to some embodiments, the banknote processing device 10 weighs about or less than about 15 pounds (33 kg).

Figure 10A:
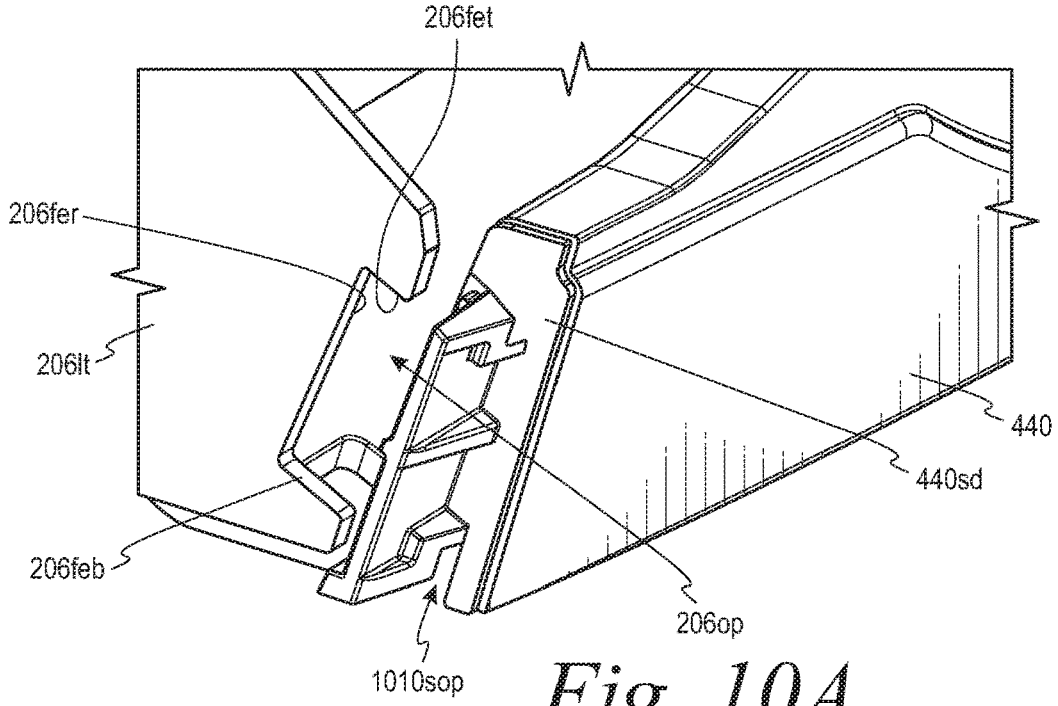
FIG. 10A is a perspective view illustrating an assembly of a stacker tray and a side plate according to some embodiments.
Figure 10B:
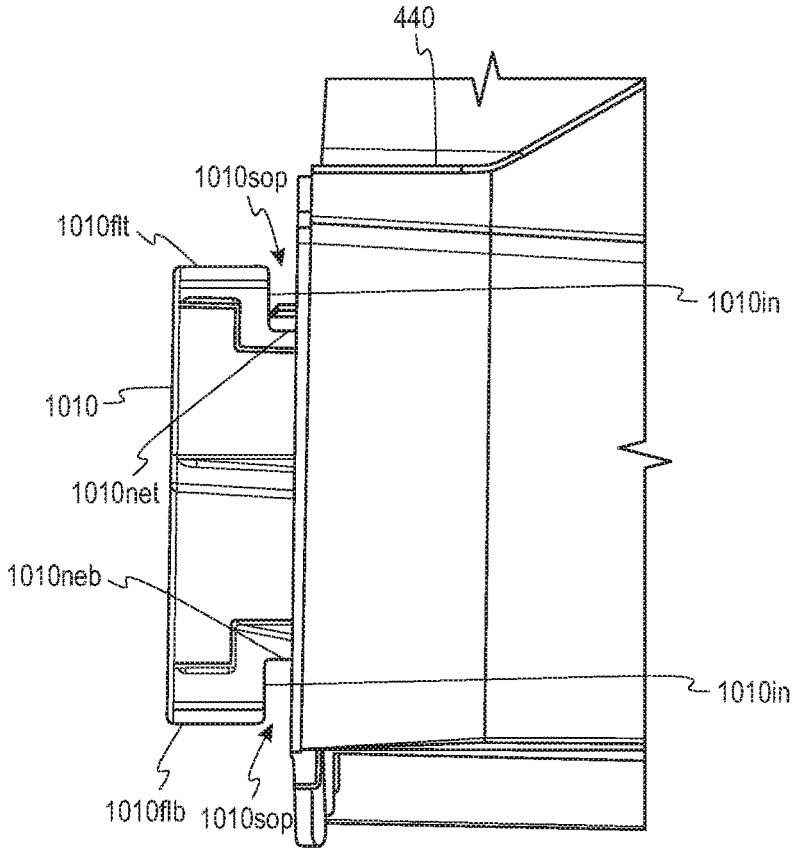
FIG. 10B is a front view of a stacker tray according to some embodiments.
Figure 10C:
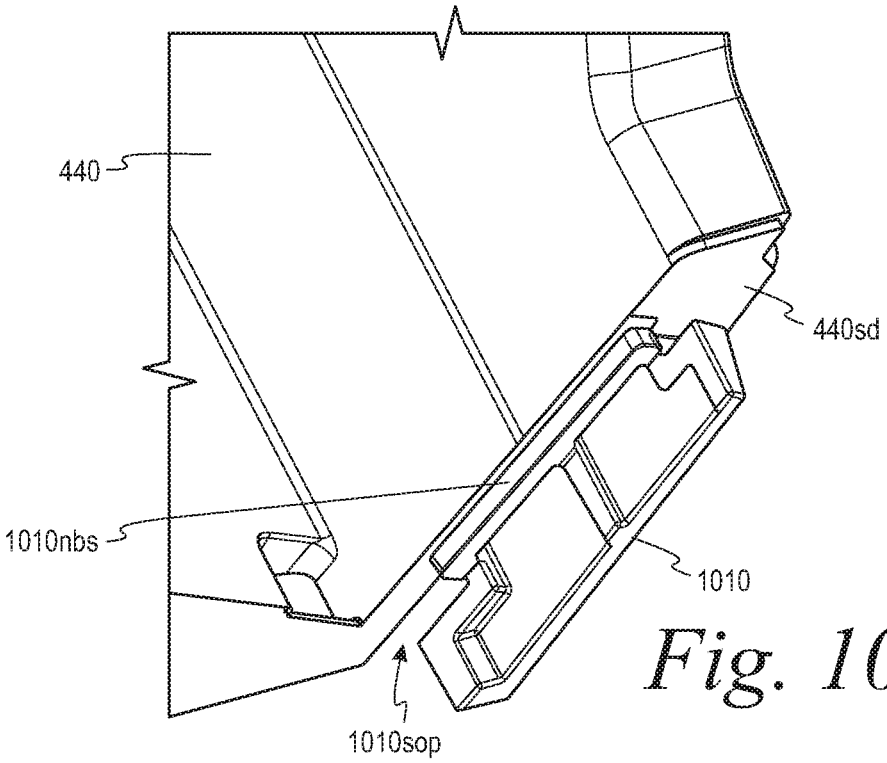
FIG. 10C is a rear perspective view of a positioning tab of a stacker tray.
Figure 10D:
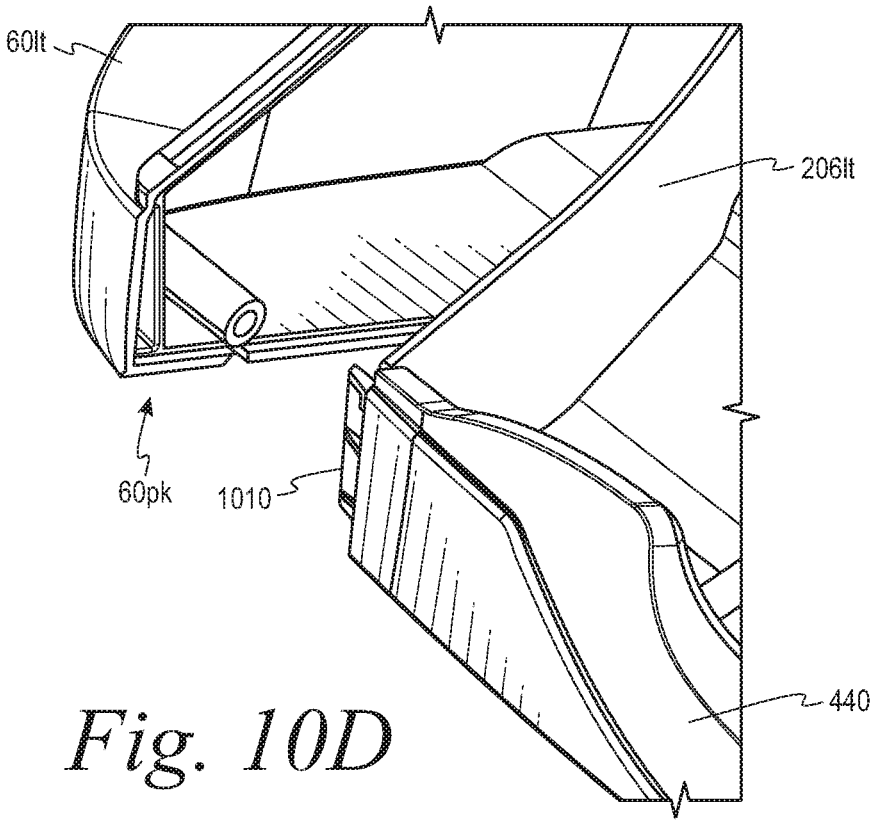
FIG. 10D is a perspective view illustrating an assembly of a stacker tray and a side plate with a side cover according to some embodiments.

According to some embodiments, the side walls 206*lt*, 206*rt*, the stacker tray 440, and the side covers 60*lt*, 60*rt* are designed to aid in the easy and accurate assembly to each other. FIG. 10A is a perspective view illustrating an assembly of a stacker tray 440 and a side plate 206*lt* according to some embodiments. FIG. 10B is a front view of a stacker tray 440 according to some embodiments. FIG. 10C is a rear perspective view of a positioning tab 1010 of a stacker tray 440. FIG. 10D is a perspective view illustrating an assembly of a stacker tray 440 and a side plate 206*lt* with a side cover 60*lt* according to some embodiments. Although not shown, the right side plate 206*rt*, the right side of the stacker tray 440, and the right cover 60*rt* have a mirror design according to some embodiments.

According to some embodiments, a positioning tab 1010 is located on the end of the stacker tray 440. The positioning tab 1010 has upper and lower side openings 1010*sop* between an inside edge 1010*in* of upper 1010*flt* and lower 1010*flb* flange on the tab 1010 and a side surface 440*sd* of the stacker tray 440. The upper and a lower side openings 1010*sop* define a neck area of the positioning tab 1010. The side plate 206*lt* has a cutout or opening 206*op* defined by a generally U-shaped front edge having a bottom edge 206*feb*, a rear edge 206*fer*, and a top edge 206*fet*. The side plate cutout 206*op* is configured to guide a front edge of the side plate 206*lt* to fit accurately about the stacking tray positioning tab 1010 by constraining the vertical position of the side plate 206*lt* through the abutment of the bottom cutout edge 206*feb* adjacent to a bottom neck edge 1010*neb* on the positioning tab 1010 and the abutment of an top cutout edge 206*fet* adjacent to a top neck edge 1010*net* on the positioning tab 1010. Similarly, the lateral position of the side plate 206*lt* is constrained by the thickness of the side plate and the distance between an inner surface 1010*in* of flanges 1010*flt*, 1010*flb* of positioning tab 1010 and the side surface 440*sd* of the stacking tray 440. When assembled, a neck back side 1010*nbs* of the positioning tab 1010 abuts the rear edge 206*fer* of the cutout 206*op* of the left side plate 206*lt*.

By controlling and setting the tolerances for the thickness of the side plate 206*lt* near the front edge thereof and the distance between an inner surface 1010*in* and the side surface 440*sd*, the side plate 60*lt* can be accurately laterally positioned snugly against the side surface 440*sd*. Likewise, by controlling and setting the tolerances for the distance between edges 206*fet* and 206*feb* on the side plate 206*lt* and the distance between 1010*net* and 1010*neb* of positioning tab 1010, the side plate 60*lt* can be accurately vertically positioned relative to the stacking tray 440. Likewise, by controlling and setting the tolerances for the position of rear edge 206*fer* of the cutout 206*op* of the left side plate 206*lt* and the neck back side 1010*nbs* of the positioning tab 1010, the side plate 60*lt* can be accurately positioned depth wise (front/back) relative to the stacking tray 440. Accordingly, positioning tab 1010 and the side plate dimensions near the side plate cutout 206*op* provide a way to easily and accurately position in three dimensions the side plate 206 relative to the stacker tray 440.

With respect to FIG. 10D, according to some embodiments, when assembled, the positioning tab 1010 is dimensioned and configured to fit snugly in a positioning tab pocket 60*pk* in the left side cover 60*lt*. Accordingly, according to some embodiments, the positioning tab 1010 of the stacker tray 440 is used to easily and accurately position in three dimensions the side cover 60*lt* to the stacker tray 440 and side plate 206*lt* by inserting the positioning tab 1010 into the positioning tab pocket 60*pk* in the left side cover 60*lt*. As stated above, although not shown, the right side plate 206*rt*, the right side of the stacker tray 440 having a corresponding positioning tab 1010, and the right cover 60*rt* have a mirror design according to some embodiments.

The above design utilizing positioning tabs 1010 facilitates the easy and accurate assembly of the stacker tray 440, the side plates 206*lt*, 206*rt*, and the side covers 60*lt*, 60*rt* to each other while eliminating or reducing issues related to the visual alignment problems between these components in a highly visible area of the banknote processing device 10 by using one multipurpose positioning tab 1010 on the stacker tray 440.

According to some embodiments, the device 10 communicates information by displaying a QR code on a display screen such on interface 52. For example, during a service call, a service technician could interact with the interface 52 to cause the processor 75 to display an appropriate QR code in the display 52. The technician could then scan the QR code using a QR code scanner such as by using a camera on their smartphone or other device (e.g., an Apple iPhone or iPad). After scanning the QR code, the QR code scanner (e.g., iPad, iPhone) then displays appropriate information to the service technician.

For example, the QR code scanner may display a message about an activity that should be performed (e.g., replace left idler roller 610 on downstream idler roller beam 605) and/or instructions and/or accompanying pictures or graphics explaining on how to perform the indicated activity (e.g., (1) open bottom plate 602, (2) remove downstream idler roller beam 605, (3) remove left idler roller 610 and replace with a new idler roller 610, (4) re-install idler roller bean 605, (5) closed bottom plate). Furthermore, the QR scanner could provide more detailed instructions and/or accompanying pictures or graphics on how to accomplish each step (e.g., step 1 details—(a) remove two screws 122, (b) rotate panel 602 open about axis 123 together with photos or graphics similar to that shown in FIG. 1G and/or with various parts highlighted and/or with arrows pointing to various portions such as screws 122.

Likewise, for example, a customer operator could interact with the interface 52 to cause the processor 75 to display an appropriate QR code in the display 52. The operator could then scan the QR code using a QR code scanner such as by using a camera on their smartphone or other device (e.g., an Apple iPhone or iPad). After scanning the QR code, the QR code scanner (e.g., iPad, iPhone) then displays appropriate information to the operator. According to some embodiments, scanning a QR code may cause a portion of a user manual or user guide to be displayed on the QR scanner. According to some embodiments, scanning the QR code will provide information to the customer such as note processing statistics. According to some embodiments, the QR code may used to get diagnostic, machine-specific, or service data, which can be sent by the customer using the QR scanner (e.g., iPhone) to the manufacturer of device 10 and/or service personnel associated with the manufacturer of device 10 and/or third-party service personnel.

According to some embodiments, the QR scanner (e.g., iPhone or iPad) may have an appropriate app downloaded thereon (such as device specific app or a manufacture app) and used to scan the QR code (e.g., a Cummins service app; a Cummins customer app).

According to some embodiments, a device 10 specific app and/or a manufacture specific app (e.g., a Cummins service app; a Cummins customer app) may be downloaded onto a customer or service technician computer device such as a mobile smartphone or tablet (e.g., iPhone or iPad). According to some embodiments, the app provides a link to one or more user manuals and/or one or more service manuals for device 10. According to some embodiments, such an app provides a customer/operator access to a user guide to help the operator resolve an issue with device 10 on his or her own.

According to some embodiments, a customer may use the app to place a service call for the device 10. According to some embodiments, the app may use data received by processor 75 and memory 74 about the details of device 10, its operational state, its past operational statistics, any current or historical error codes generated by device 10, the model and/or serial number of device 10, the location of device 10 (e.g., company name of customer and address), etc. According to some embodiments, the app may be used to populate fields in various reports such as service reports or forms requesting a service call.

According to some embodiments, the use of a customer employee's personal computer device such as a mobile smartphone or tablet may be used to avoid potential problems associated using a customer's company network for some remote management functions, for example, due to firewall or other computer network security features. For example, if a banknote processing device such as device 10 stops operating, via the app and/or QR code scanning feature, an employee may be able to easily collect and send information to a service personnel that enables the service personnel to be able to identify the device and any problems associated therewith and potentially provide instructions to the customer employee on how the device 10 may be fixed and/or what replacement parts the service technician needs to bring to the location of the device 10 for a service call.

According to some embodiments, if, for example, a customer wanted to know how many notes were processed by device 10, the processor 75 may be programmed to provide an appropriate QR code that contains the note processing history in the code. The customer could then open a manufacturer's app (e.g., a Cummins Allison application) on their smartphone or tablet, take a picture of the QR code, and the QR code would be deciphered and the desired statistical information could be displayed on the customer's phone or tablet. This information could also be used in diagnostics so that the customer could send that information to service personnel so diagnostics could be done remotely. This could be a very valuable tool for both the customer and the field service representatives.

According to some embodiments, the QR code may provide information to the customer such as note processing statistics. According to some embodiments, the QR code is used to get diagnostic, machine-specific, and/or service data, which can be sent by the customer's QR scanner to the device manufacturer and/or service personnel. A camera on a QR scanner (e.g., iPhone or iPad) accessed by the app on a mobile device of a customer or a service technician may be used to retrieve the information via the QR code themselves.

According to some embodiments, the use of a QR code allows an easier way to pull data from a machine such as device 10 other than pairing a wired or wireless device to the machine or connecting a thumb drive to the machine, which requires a PC to view that information. According to some embodiments, the customer scans a QR code displayed on an interface of a machine such as device 10 using a QR code scanner and the QR code scanner sends the information to a remote service technician for troubleshooting the machine.

According to some embodiments, there are number of uses for a banknote processing device being able to generate customized QR codes for use in connection with a QR scanning device having a customized app thereon to scan and decode the QR and/or take further action(s). A first use would be during the production of a banknote processing device such as part of a Quality Control (QC) process. Currently during the manufacture of banknote processing devices, a QC personnel may hand write a report for each machine's serial number, calibration, sensor readings, etc. Prior electronic means for capturing this type info have been found to be too cumbersome to integrate with production and/or QC processes. According to some embodiments, of the present disclosure, a manufacturing and/or QC personnel will be able to press a single button in a menu displayed on a user interface (e.g., interface 52 of device 10) labeled, for example, 'QC Report' and the banknote processing device will display a customized QR code. According to some embodiments, displayed QR code will contain all or a portion of desired QC report data. Then using a mobile device with a camera such as a tablet with a QR decoding app, the manufacturing or QC personnel may take a picture of the banknote processing screen displaying the customized QR code. The mobile device via app may decode the QR code, extract the data contained therein, and populate corresponding fields in a QC report, e.g., serial number, various calibration settings, sensor readings, etc. The QR decoding app can then be used to send the generated QC report to a central location such as a network shared drive for storage. According to some embodiments, the generated QC report may use the serial number of the device (decoded from the QR code) in its file name.

Another use of QR codes and/or customized apps would be in service contexts such as by service technicians. Service technicians may be asked to capture a device's serial number and piece count statistics when they perform service on a device such as a banknote processing device. They may enter this data into a networked service tracking system/program such as by using an iPad to interface with the service tracking system. According to some embodiments of the present disclosure, at the end of a service call, a technician will instruct the banknote processing device being service through one or service screens displayed on the interface such as interface 52 of the device to display a service QR code on the display screen of the device. Once the device does this, the technician may use an extension of a service app on an iPad to access the iPad's camera and take a picture of the screen of the device being serviced. The service app may then decode the contents or the QR code and use the decoded data to populate corresponding fields for serial number, model, and machine statistics in a service report. The service report may also contain other data entered by the service technician such as, for example, notes about the service call and/or the machine serviced. The iPad may then send the service report for the device via a network to a main service database in which the service report may be saved and stored. A device's service history may also be stored in the main service database along with the new service report. In one embodiment, the scanning of the QR code could be used to create a service record for the machine and populate corresponding data fields therein. According to some embodiments, a service app on the iPad might require a successful QR scan in order to close out the service call, as the device will not render the QR code until its own diagnostics indicate that the device is in a functional state. The QR code might also encode piece counts of perishable parts and/or trend reports so that predictions can be made on subsequent service visits to the same device regarding which replacement parts to bring.

Another use of QR codes and/or customized apps may be by users or operators of banknote or currency processing devices. For example, as parts wear out on a device or as the device itself detects it needs or will require service in the near future, the device can provide the operator a screen (e.g., on interface 52) where it renders a QR code to generate a service call containing information to aid a service technician in being able to come prepared to resolve the issue. The QR code displayed on the device screen may be scanned by the operator using a mobile device such as a smartphone or tablet with a camera with a custom app (e.g., a Cummins Allison service app) installed thereon. Upon decoding the QR code, mobile device may use a web-based interface to automatically schedule and/or initiate a service call for the device with the operator's local service branch. According to some embodiments, the service app may, alternatively or in addition to placing a service call, recommend a course of action to the operator such as a cleaning of the machine or other simple ways to resolve issues. According to some embodiments, the app may reference an operator manual and select a specific page or pages that addresses the issue that the device is currently experiencing.

The various above QR related embodiments, may require a device with a camera on which a software application (app) runs to decode the QR code and act on its content.

According to some embodiments, the banknote processing device 10 comprises a microphone coupled to the processor 75 and the processor 75 is configured to respond to voice commands from a person such as an operator or service technician. According to such embodiments, an operator may simply give a banknote processing device such as device 10 verbal instructions and the device would comply. For example, an operator may give a verbal instruction to the banknote processing device to end a batch or change modes without actually having to press keys or a touch screen on the banknote processing device much in the same way Alexa and other voice control devices work. According to some embodiments, adding voice control to banknote processing devices such as currency desktop machines improves efficiency by reducing the amount of physical interactions with a user interface 52 such as a touch screen providing the user with more time to dress and strap notes.

According to some embodiments, the banknote processing device 10 comprises a Bluetooth communication receiver coupled to the processor 75, thus permitting a banknote processing device such as device 10 with the ability to accommodate Bluetooth near field communication. According to some such embodiments, providing Bluetooth capability which is a wireless form of communications may eliminate the need to physically connect a cable to a banknote processing device such as device 10.

In one example embodiment, an input hopper for a banknote processing device comprises a feeder bracket fixedly coupled to side walls of a banknote processing device, the feeder bracket having longitudinal length and a pair of hopper lug openings positioned near opposite ends of the longitudinal length of the feeder bracket, a feeder plate resting upon but not coupled the feeder bracket, the feeder plate having longitudinal length and a pair of slot openings positioned near opposite ends of the longitudinal length of the feeder plate; wherein when the feeder plate is properly positioned relative to the feeder bracket, the slot openings of the feeder plate align with the hopper lug openings of the feeder bracket, and a hopper bracket having a bottom surface resting on an upper surface of the feeder plate, the hopper bracket having a longitudinal length and a pair of hopper lugs positioned near opposite ends of the longitudinal length of the hopper bracket and extending downward from the bottom surface of the hopper bracket through the slot openings of the feeder plate and the hopper lug openings of the feeder bracket, wherein when the hopper bracket and feeder plate are in an operational position with respect to the feeder bracket, top surfaces of the hopper lugs contact a bottom surface of the feeder bracket establishing an interference fit therebetween so as to maintain the hopper bracket and feeder plate in their operational positions without either the hopper bracket or the feeder plate being fixedly coupled to feeder plate or the rest of the banknote processing device; wherein the hopper bracket is instead removably coupled to the feeder bracket and the feeder plate is sandwiched therebetween.

In another example embodiment, an output receptacle of a banknote processing device comprises a stacker tray having a longitudinal length and having an upper edge that has a central, downward curved portion in a middle portion of the longitudinal length and two curved portions, one on each side of the middle portion, wherein the two curved portions arc upward toward the middle of the stacker tray and a middle of the output receptacle.

In another example embodiment, a banknote processing device comprises a display assembly being pivotally mounted about a first axis near a first end of the transport plate, the display assembly having an operational position and an open position, a banknote transport path defined at least in part by a transport plate on one side of the transport path, the transport plate being pivotally mounted about a second axis near a first upstream end of the transport plate, the transport plate having an operational position and an open position, and a linkage coupled on one end to the display assembly and coupled on a second end to the transport plate near a second downstream end of the transport plate, wherein when the display assembling is rotated from its operational position to an open position, the linkage causes the transport plate to move from its operational position to an open position.

In one or more of the above examples, the linkage is a spring link.

In one or more of the above examples, the spring link is a generally straight wire coupled on one end to the display assembly and coupled on a second end to the transport plate near a second downstream end of the transport plate.

In another example embodiment, a banknote processing device comprises a pair of opposing side plates in spaced relation from each other, each side plate having at least one spring cleat aperture therein, an idler roller beam having a longitudinal length having two ends which when the beam is positioned in an operational position the longitudinal length extends between the two side plates, the idler roller beam having one or more idler rollers coupled thereto, each end of the beam having a beam spring post, a pair of spring cleats, each cleat having a cleat spring post thereon, each spring cleat having an exterior portion designed to fit through one of the spring cleat apertures in respective ones of the side plates when the cleat is positioned in a non-operational position with respect to the corresponding cleat aperture, each cleat having a larger surface that abuts an inside surface of a respective side plate when the spring cleat is in an operational position, the larger surface not fitting through a corresponding cleat aperture when the cleat is in its operational position, each cleat having one or more inside hook surfaces that abut portions of an edge of a respective cleat aperture when the cleat is in its operational position, wherein the exterior portion of each spring cleat has an inside surface configure to engage of portion of the edge of a respective cleat aperture preventing the exterior portion of the spring cleat from moving through the aperture when the spring cleat is in an operational position, a pair of springs, each of the spring being mounted between a respective one of the beam spring posts and a corresponding cleat spring posts, each spring biasing a corresponding spring cleat into its operational position and biasing a respective end of the idler roller beam into its operational position, wherein a spring cleat may be manually moved into a non-operational position and removed from the banknote processing device without the use of any tools by pulling the cleat through the corresponding cleat aperture, and wherein the idler roller beam may be removed from the banknote processing device without the use of any tools by removing the pair of cleats from the banknote processing device.

In another example embodiment, a banknote processing device comprises a pair of opposing side plates in spaced relation from each other, each side plate having at least one spring cleat aperture therein, an idler roller beam having a longitudinal length having two ends which when the beam is positioned in an operational position the longitudinal length extends between the two side plates, the idler roller beam having one or more idler rollers coupled thereto, each end of the beam having a beam spring post, a pair of spring cleats, each cleat having a cleat spring post thereon, each spring cleat having an operational position and a non-operational position, wherein when the cleat is in its operational position, the spring cleat is coupled to a respective side plate and the spring cleat engages an edge of a respective spring cleat aperture preventing the spring cleat from being decoupled from the respective side plate, wherein when the cleat is in its non-operational position, the spring cleat does not engage an edge of a respective spring cleat aperture and is not prevented from being decoupled from the respective side plate, a pair of springs, each of the spring being mounted between a respective one of the beam spring posts and a corresponding cleat spring posts, each spring biasing a corresponding spring cleat into its operational position, wherein a spring cleat may be manually moved into a non-operational position and removed from the banknote processing device without the use of any tools, and wherein the idler roller beam may be removed from the banknote processing device without the use of any tools by removing the pair of cleats from the banknote processing device.

In another example embodiment, a banknote processing device comprises a pair of opposing side plates in spaced relation from each other, each side plate having at least one cleat hooked thereon, a beam having a longitudinal length having two ends which when the beam is positioned in an operational position the longitudinal length extends between the two side plates, and a pair of springs, each of the spring being mounted between a respective end of the beam and a corresponding cleat.

In one or more of the above examples, each cleat has an operational position and a non-operational position, wherein when each cleat is in its non-operational position, the cleat may be unhooked and decoupled from a respective side plate, wherein when each cleat is in its operational position, the cleat may not be unhooked and decoupled from a respective side plate, wherein each spring biases a corresponding cleat into its operational position.

In one or more of the above examples, each cleat may be manually moved into its non-operational position and removed from the banknote processing device without the use of any tools.

In one or more of the above examples, the beam may be removed from the banknote processing device without the use of any tools by removing the pair of cleats from the banknote processing device.

In another example embodiment, a banknote processing device comprises a driven transport shaft having a magnetic coupled to an end thereof, and a magnetic encoder adjacent to but spaced from the magnet.

In one or more of the above examples, the driven transport shaft is mounted between two sides plates of the banknote processing device and wherein the end of the driven transport shaft having the magnet coupled thereto extends through an aperture in a first one of the side plates such that the magnet is not positioned between the two side plates, and further comprising a printed circuit board positioned outside of a space between the two side plates and positioned adjacent to the first one of the side plates, wherein the magnetic encoder is coupled to the printed circuit board.

In another example embodiment, a banknote processing device comprises a transport shaft mounted between two sides plates of the banknote processing device, wherein a first end of the shaft is coupled to a hold-down screw, a shaft adjustment mechanism comprising an adjustment plate pivotally mounted about a first axis to a first one of the side plates, wherein the adjustment plate comprises an arc-shaped aperture defined by an arc-shaped edge, wherein the arc-shaped aperture and edge are slightly non-concentric with respect to the first axis; wherein the adjustment plate comprises an arc-shaped edge which is concentric with respect to the first axis and wherein the arc-shaped edge has a plurality of teeth, wherein the first one of the side plates has a vertical slot opening therein and wherein the hold-down screw passes through both the arc-shaped aperture in the adjustment plate and the vertical slot opening in the first one of the side plates, wherein the first one of the side plates has an adjustment tool receiving aperture therein, wherein when an end of an adjustment tool having a plurality of teeth thereon is inserted in the adjustment tool receiving aperture, a rack and pinion type of mesh is established between the adjustment plate teeth and the teeth on the end of the adjustment tool such that rotating the adjustment tool causes the rotation of the adjustment plate and the associated adjustment plate arc opening and adjustment plate arc opening edge which in turn vertically moves the hold-down screw within the vertical slot opening and vertically moves the end of the shaft to which the hold-down screw is coupled.

In one or more of the above examples, the hold-down screw is threadingly screwed into an opening in the first end of the shaft and wherein when the hold-down is tightened into the shaft, adjustment plate is prevented from rotating about the first axis.

In another example embodiment, a banknote processing device comprises a banknote transport path defined at least in part by a transport plate on one side of the banknote transport path, the banknote transport plate being pivotally mounted about a first axis near an upstream end of the transport plate, the transport plate including a working position and an open position, a display assembly being pivotally mounted about a second axis spaced a defined distance apart from the first axis, the display assembly including an operational position and a non-operational position, and a linkage coupled to display assembly and to the transport plate near a downstream end of the transport plate, wherein, when the display assembly is rotated from the operational position to the non-operational position, the linkage causes the transport plate to move from the working position to the open position.

In one or more of the above examples, the linkage is a spring link.

In one or more of the above examples, the spring link is a generally straight wire coupled on one end to the display assembly and coupled on a second end to the transport plate near the downstream end of the transport plate.

In one or more of the above examples, when the display assembly is rotated from the non-operational position to the operational position, the spring link exerts a downward force on the transport plate to hold the transport plate in the working position.

In one or more of the above examples, the display assembly includes a display bezel including a bezel cover, a bezel backing plate coupled to the bezel cover, and a display disposed within the bezel cover.

In one or more of the above examples, the display assembly includes one or more display assembly stops operable to engage the bezel backing plate when the display assembly is rotated from the non-operational position to the operational position.

In one or more of the above examples, when the display assembly is operable to rotate a distance between the operational position and the non-operational position to adjust a viewing angle of the display.

In one or more of the above examples, the movement of the transport plate from the working position to the open position provides an opening to access a paper path of the banknote processing device.

In one or more of the above examples, the banknote processing device further comprises a first side cover portion disposed adjacent a first side surface of the display assembly; and a second side cover portion disposed adjacent a second side surface of the display assembly, wherein, when the display assembly is in the operational position, the first side cover portion is flush with the first side surface of the display assembly and the second side cover portion is flush with the second side surface of the display assembly.

In one or more of the above examples, the transport plate is in a non-working position when the first side cover portion and the second side cover portion are not flush with the first side surface and the second side surface of the display assembly, respectively.

In another example embodiment, a method of a banknote processing device comprises rotating a display assembly from an operational position to a non-operational position, wherein a linkage is coupled to the display assembly and to a transport plate near a downstream end of the transport plate, wherein the transport plate defines, at least in part, a banknote transport path, wherein the transport plate is pivotally mounted about a first axis near an upstream end of the transport plate, and wherein the display assembly is pivotally mounted about a second axis spaced a defined distance apart from the first axis, and moving the transport plate from a working position to an open position, wherein the movement is caused by the coupling of the linkage to the display assembly and the transport plate and the rotation of the display assembly.

In one or more of the above examples, the linkage is a spring link.

In one or more of the above examples, the spring link is a generally straight wire coupled on one end to the display assembly and coupled on a second end to the transport plate near the downstream end of the transport plate.

In one or more of the above examples, the method further comprises exerting, by the spring link when the display assembly is rotated from the non-operational position to the operational position, a downward force on the transport plate to hold the transport plate in the working position.

In one or more of the above examples, the display assembly includes a display bezel including a bezel cover, a bezel backing plate coupled to the bezel cover, and a display disposed within the bezel cover.

In one or more of the above examples, the method further comprises engaging, by one or more display assembly stops, the bezel backing plate when the display assembly is rotated from the non-operational position to the operational position.

In one or more of the above examples, the method further comprises rotating the display assembly a distance between the operational position and the non-operational position to adjust a viewing angle of the display.

In one or more of the above examples, the method further comprises providing an opening to access a paper path of the banknote processing device due to the movement of the transport plate from the working position to the open position.

In one or more of the above examples, when the display assembly is in the operational position, a first side cover portion is flush with a first side surface of the display assembly and a second side cover portion is flush with a second side surface of the display assembly.

In one or more of the above examples, the transport plate is in a non-working position when the first side cover portion and the second side cover portion are not flush with the first side surface and the second side surface of the display assembly, respectively.

While the concepts disclosed herein are susceptible to various modifications and alternative forms, specific embodiments thereof have been shown by way of example in the drawings and herein described in detail. It should be understood, however, that it is not intended to limit the inventions to the particular forms disclosed, but on the contrary, the intention is to cover all modifications, equivalents, and alternatives falling within the spirit and scope of the inventions as defined by the appended claims.

What is claimed is:

1. A banknote processing device comprising:

a banknote transport path defined at least in part by a transport plate on one side of the banknote transport path, the banknote transport plate being pivotally mounted about a first axis near an upstream end of the transport plate, the transport plate including a working position and an open position;

a display assembly being pivotally mounted about a second axis spaced a defined distance apart from the first axis, the display assembly including an operational position and a non-operational position; and a linkage coupled to the display assembly and to the transport plate near a downstream end of the transport plate, wherein, when the display assembly is rotated from the operational position to the non-operational position, the linkage causes the transport plate to move from the working position to the open position.

2. The banknote processing device of claim 1, wherein the linkage is a spring link.

3. The banknote processing device of claim 2, wherein the spring link is a generally straight wire coupled on one end to the display assembly and coupled on a second end to the transport plate near the downstream end of the transport plate.

4. The banknote processing device of claim 3, wherein, when the display assembly is rotated from the non-operational position to the operational position, the spring link exerts a downward force on the transport plate to hold the transport plate in the working position.

5. The banknote processing device of claim 1, wherein the display assembly includes a display bezel including a bezel cover, a bezel backing plate coupled to the bezel cover, and a display disposed within the bezel cover.

6. The banknote processing device of claim 5, wherein the display assembly includes one or more display assembly stops operable to engage the bezel backing plate when the display assembly is rotated from the non-operational position to the operational position.

7. The banknote processing device of claim 6, wherein, when the display assembly is operable to rotate a distance between the operational position and the non-operational position to adjust a viewing angle of the display.

8. The banknote processing device of claim 1, wherein the movement of the transport plate from the working position to the open position provides an opening to access a paper path of the banknote processing device.

9. The banknote processing device of claim 1, further comprising:

a first side cover portion disposed adjacent a first side surface of the display assembly; and a second side cover portion disposed adjacent a second side surface of the display assembly, wherein, when the display assembly is in the operational position, the first side cover portion is flush with the first side surface of the display assembly and the second side cover portion is flush with the second side surface of the display assembly.

10. The banknote processing device of claim 9, wherein the transport plate is in a non-working position when the first side cover portion and the second side cover portion are not flush with the first side surface and the second side surface of the display assembly, respectively.

11. A method of a banknote processing device, the method comprising:

rotating a display assembly from an operational position to a non-operational position, wherein a linkage is coupled to the display assembly and to a transport plate near a downstream end of the transport plate, wherein the transport plate defines, at least in part, a banknote transport path, wherein the transport plate is pivotally mounted about a first axis near an upstream end of the transport plate, and wherein the display assembly is pivotally mounted about a second axis spaced a defined distance apart from the first axis; and moving the transport plate from a working position to an open position, wherein the movement is caused by the coupling of the linkage to the display assembly and the transport plate and the rotation of the display assembly.

12. The method of claim 11, wherein the linkage is a spring link.

13. The method of claim 12, wherein the spring link is a generally straight wire coupled on one end to the display assembly and coupled on a second end to the transport plate near the downstream end of the transport plate.

14. The method of claim 13, further comprising exerting, by the spring link when the display assembly is rotated from the non-operational position to the operational position, a downward force on the transport plate to hold the transport plate in the working position.

15. The method of claim 11, wherein the display assembly includes a display bezel including a bezel cover, a bezel backing plate coupled to the bezel cover, and a display disposed within the bezel cover.

16. The method of claim 15, further comprising engaging, by one or more display assembly stops, the bezel backing plate when the display assembly is rotated from the non-operational position to the operational position.

17. The method of claim 16, further comprising rotating the display assembly a distance between the operational position and the non-operational position to adjust a viewing angle of the display.

18. The method of claim 11, further comprising providing an opening to access a paper path of the banknote processing device due to the movement of the transport plate from the working position to the open position.

19. The method of claim 11, wherein, when the display assembly is in the operational position, a first side cover portion is flush with a first side surface of the display assembly and a second side cover portion is flush with a second side surface of the display assembly.

20. The method of claim 19, wherein the transport plate is in a non-working position when the first side cover portion and the second side cover portion are not flush with the first side surface and the second side surface of the display assembly, respectively.

* * * * *